US006171030B1

(12) United States Patent
Miyake et al.

(10) Patent No.: US 6,171,030 B1
(45) Date of Patent: Jan. 9, 2001

(54) SOIL IMPROVING MACHINE WITH EXCAVATING MEANS

(75) Inventors: Shigehiko Miyake, Okayama; Hisayoshi Hashimoto, Ushiku; Toshikazu Murai; Takami Kusaki, both of Chiyoda-machi; Tetsushiro Miura, Yokohama; Hiroyosi Itaya, Kurashiki; Fumiki Nakagiri, Odawara; Satoshi Sekino, Ryugasaki, all of (JP)

(73) Assignee: Hitachi Construction Machinery Co., Ltd., Tokyo (JP)

( * ) Notice: Under 35 U.S.C. 154(b), the term of this patent shall be extended for 0 days.

(21) Appl. No.: 09/147,565

(22) PCT Filed: May 20, 1998

(86) PCT No.: PCT/JP98/02208

§ 371 Date: Jan. 21, 1999

§ 102(e) Date: Jan. 21, 1999

(87) PCT Pub. No.: WO98/53148

PCT Pub. Date: Nov. 26, 1998

(30) Foreign Application Priority Data

May 21, 1997 (JP) ..... 9/146073

(51) Int. Cl.[7] ..... C09K 17/00; E02D 3/12; E02F 5/22

(52) U.S. Cl. ..... 405/258; 405/263; 405/303; 37/142.5

(58) Field of Search ..... 405/258, 263, 405/269, 303; 37/142.5, 403, 461, 466

(56) References Cited

U.S. PATENT DOCUMENTS 5,242,246 * 9/1993 Manchak, III et al. ..... 405/128
5,490,741 * 2/1996 Fryer ..... 405/128
5,558,471 * 9/1996 Payne ..... 405/269
5,566,627 * 10/1996 Pryor ..... 405/258 X
5,631,160 * 5/1997 Bruso ..... 405/263 X
5,639,182 * 6/1997 Paris ..... 405/258 X
5,830,752 * 11/1998 Bruso ..... 405/263 X
5,837,325 * 11/1998 Heacock ..... 405/258 X
6,017,169 * 1/2000 Toor et al. ..... 405/258

FOREIGN PATENT DOCUMENTS

S56-733 1/1981 (JP) .
H1-49538 10/1989 (JP) .

* cited by examiner

*Primary Examiner*—David Bagnell
*Assistant Examiner*—Tara L. Mayo
(74) *Attorney, Agent, or Firm*—Oblon, Spivak, McClelland, Maier & Neustadt, P.C.

(57) ABSTRACT

A vehicular soil treating machine having a base carrier with a crawler type vehicle drive, an upper rotary body rotatably mounted on the base carrier, and an excavation means mounted on the upper rotary body and equipped with a soil excavating bucket. Provided on the base carrier is an elongated continuous soil processing trough having a predetermined length in the longitudinal direction of the base carrier and internally provided with a tumbling/mixing means for uniformly mixing additive soil improving material into sand and soil which is fed from the excavation means. A soil hopper is provided over one end of the continuous processing trough, and an additive feed means is located behind the soil hopper to feed additive soil improving material to the continuous processing trough.

48 Claims, 33 Drawing Sheets

SOIL IMPROVING MACHINE WITH EXCAVATING MEANS

CROSS-REFERENCE TO RELATED APPLICATIONS

This application was filed under 35 U.S.C. § 371 from Patent Cooperation Treaty Application No. PCT/JP98/02208, filed on May 20, 1998, and this application claims priority under 35 U.S.C. § 119 to Japanese patent application no. 9/146073, filed on May 21, 1997, both of which applications are hereby incorporated by reference.

FIELD OF THE ART

The present invention relates to a vehicular soil treating machine with an excavation means, which is particularly suitable for use, for example, in improving foundational soil of a ground at a construction site or at a civil or other geotechnological engineering site, by excavating sand and soil out of a ground which needs improvements, treating soil with an additive and refilling the excavated ground with improved soil.

BACKGROUND OF THE ART

As for soil treatment for improving a soft foundation of a ground into a strong and solid one, for example, it has been known well known in the art to consolidate the constituent sand and soil of the foundation by the use of cement or a similar soil construction modifier. More specifically, generally a geotechnological engineering method of this sort includes the steps of excavating foundational sand and soil of a ground, adding and mixing a soil improving material uniformly into excavated soil and sand, refilling the excavated ground with improved soil, and finally compacting the refilled ground. For carrying out such a foundational soil treatment, there have to be provided various equipments including means for excavating foundational sand and soil of a ground, means for feeding a soil improving material, means for mixing soil improving material uniformly with excavated sand and soil, and means for refilling and compacting the ground.

For a soil treating operation as mentioned above, at least an excavation machine like a hydraulic power shovel is inevitably required. In this regard, a hydraulic power shovel is generally resorted to as an excavation means. In case of a vehicular or traveling type power shovel, the base carrier is provided with either a crawler or wheel type vehicle drive mechanism. As a vehicle drive, it is preferable for the hydraulic power shovel to have a crawler type drive mechanism, taking into consideration the conditions of the grounds which in many cases have rough and soft surfaces, and at the same time from the standpoint of securing stability of the vehicle body under inferior travel conditions or against large excavational resistance forces.

On the other hand, for producing soil of improved construction or properties by uniformly mixing excavated sand and soil with a soil improving material, there have been known a number of methods, which can be largely categorized into a method of mixing a soil improving material with sand and soil by the use of a mixer machine, and a sprinkling method or a method of sprinkling an additive soil improving material over excavated sand and soil as the latter is turned over by an excavator.

As for the mixer machine, it should be at least equipped with a mixing tank with a soil mixing mechanism and an additive feed mechanism. Excavated sand and soil can be fed to a mixing tank directly by and from a hydraulic power shovel which is used for excavation of sand and soil. However, due to varying positional relations in operation between a mixer machine and a hydraulic power shovel, it has been the general practice to pile up excavated sand and soil in a predetermined depository place which is convenient for transfer to a mixer machine. In this connection, for example, there has been known a mixing machine as disclosed in Japanese Patent Publication H1-49538 (i.e., B2 publication), which is in the form of a traveling type mixing machine having, on a wheel type base carrier, a soil feed mechanism with a bucket for transferring sand and soil from a depository place with a heap of sand and soil which has been excavated beforehand by the use of a hydraulic power shovel or the like, along with a mixing tank and an additive feed section. The soil feed mechanism is horizontally rotatable within a limited angle relative to a vehicle body. A fixed amount of excavated sand and soil is thrown into the mixing tank along with a fixed amount of soil improving material and mixed together by a mixing means to produce improved soil batchwise. Improved soil of each batch is discharged from the mixing tank at a predetermined place.

In the case of the above-described conventional soil treating system using a traveling type mixing machine, it is inevitably necessitated to excavate sand and soil beforehand by the use of a hydraulic power shovel or the like. This traveling type mixing machine is provided with a soil feed mechanism with a bucket which, however, is difficult to use directly for excavation of a ground, partly because the wheel type base carrier is not suitable for travels on soft and hazardous ground surfaces at ground working sites and partly because the soil feed mechanism can rotate in the horizontal direction only in a limited angle range to limit the position of ground excavation by the machine. In addition to incapability of ensuring stability of the vehicle against large excavational resistance. It follows that sand and soil has to be excavated separately by the use of a hydraulic power shovel or the like and heaped up at a depository place which is accessible by the traveling mixing machine, resulting in an increased number of working steps. Besides, the batchwise soil treatment by a mixer tank is unsatisfactorily inferior in throughput capacity.

In contrast, in the case of the method of sprinkling additive soil improving material over a ground as mentioned above, firstly soil improving material is sprinkled over a ground which needs improvements to its foundation, and then the ground is excavated in such a manner as to mix soil improving material with sand and soil as the latter is dug out and turned over by an excavation means. In this instance, for mixing soil improving material into sand and soil being excavated, it is conceivable to use an excavation machine with a bucket like a hydraulic power shovel. However, without meticulous skills, it is difficult to mix a soil improving material uniformly into excavated sand and soil in a broad working area by the use of an excavating machine of this sort. In this connection, Japanese Laid-Open Utility Model Specification S56-733 discloses a machine with excavating and mixing means. According to this laid-open Utility Model Specification, the excavating and mixing means is constructed in the form of a rotor with a large number of radial cutter blades connected to a rotational shaft, as an attachment to a front working mechanism of a hydraulic power shovel. This excavating and mixing rotor is mounted on a distal end of an arm which is connected to a boom of the hydraulic power shovel. While the hydraulic power shovel is driven to travel along a ground surface, the rotational shaft of the excavating and mixing rotor is put in rotation and its rotating cutter blades are pushed against the ground surface through operations of the boom and arm of the hydraulic power shovel, and at the same time a soil improving material is sprinkled over and mixed with sand and soil being dug up by the rotor blades.

A soil treating system using an excavating and mixing means, which can excavate and treat soil continuously as described above without necessitating to heap up excavated sand and soil at one depository place beforehand, has a higher soil processing capacity. However, such a system has an inherent problem in that the sprinkling of soil improving material could pose adverse effects on the environment, in addition to the problem of loud noises which are produced by the rotor in such a level as would invite prohibition of its use in or in the neighborhood of densely populated areas. Besides, the depth of excavation by the rotor depends on the length of its cutter blades. Currently available cutter blades are limited to a length of about 1 meter at the longest and therefore not suitable for application to foundational soil treatments involving deep excavations.

Further, for fortifying foundational soil construction of a ground, it is necessary to mix a soil improving material with excavated sand and soil uniformly in a predetermined mixing ratio. This is because it is probable that, after construction of a building on a treated ground, the foundation will sink down irregularly if the mixing ratio is varied from one place to another. A foundation of a ground can be fortified to a sufficient degree despite irregular variations in mixing ratio if a soil improving material is used in a wastefully large mixing ratio at the sacrifice of considerable increases in cost. In the case of the soil treatment using a mixing tank, it is possible to mix a soil improving material substantially uniformly with excavated sand and soil but the mixing operation takes a great deal of time. In addition, for controlling the mixing ratio, it becomes necessary to provide metering means on a mixing tank to measure the amount of charging sand and soil, and to control the feed rate of a soil improving material according to a predetermined mixing ratio. For the control of mixing ratio, the soil treating process will further require a longer operational time for each batch.

In the case of the soil treatment using a rotor type excavating and mixing means as mentioned above, it is extremely difficult to sprinkle a soil improving material uniformly over the entire sand and soil being excavated by the rotor, namely, it is difficult to suppress irregular variations in mixing ratio or rate to such a degree as to preclude the problem of non-uniform sinking which might occur to the foundation of a ground under the weight of a building or other structures.

DISCLOSURE OF THE INVENTION

With the foregoing situations in view, it is an object of the present invention to make it possible to improve foundational soil of a ground to to extremely high quality level by the use of a machine of simple construction.

It is another object of the present invention to provide a soil treating machine which can efficiently perform all necessary operations for a treatment of foundational soil of a ground, from excavation of a ground to refilling of improved soil into the excavated ground.

It is still another object of the present invention to provide a soil treating machine which can improve foundational soil of a ground accurately and efficiently to a desired depth without imposing adverse effects on the environment.

It is a further object of the present invention to provide a soil treating machine which can mix additive soil improving material continuously and uniformly with excavated sand and soil.

It is a further object of the present invention to provide a soil treating machine which can mix additive soil improving material into excavated sand and soil accurately and almost perfectly in a predetermined mixing ratio.

According to the present invention, in order to achieve the above-stated objectives, there is provided a vehicular soil treating machine which essentially includes: a traveling vehicular body including a crawler type base carrier driven by a pair of crawler belts and an upper rotary body rotatably mounted on the base carrier; an excavation means supported on the upper rotary body and provided with a bucket for excavating earth;

a continuous processing trough provided on the side of the base carrier and having a soil tumbling/mixing means within a hollow elongated body having a predetermined length in the longitudinal direction of the base carrier; a soil hopper mounted on one end of the continuous processing trough for throwing thereinto sand and soil excavated by the bucket; and an additive feed means located in a position rearward of the soil hopper to feed additive soil improving material to the continuous processing trough.

The above-mentioned continuous processing trough may be located on the base carrier, on the outer side of one of the crawler belts, or in a position between the two crawler belts. In case the continuous processing trough is located between the two crawler belts, it can be supported on a center frame of the lower carrier fixedly or horizontally movably to shift its position between a rear receded position and a forward projecting position.

The soil tumbling/mixing means can be constituted by a mixing conveyer which is provided with a large number of mixing paddles on the circumference of a rotational shaft extending internally and longitudinally of the continuous processing trough, transferring sand and soil from one to the other end of the continuous processing trough while mixing same with additive soil improving material. In such a case, for the purpose of enhancing mixing efficiency, the mixing conveyer is preferably provided with a plural number of rotational shafts which are disposed side by side within the continuous processing trough and are each arranged to rotate in the opposite direction relative to an adjacent rotational shaft. In order to simplify the drive mechanism of the mixing conveyer, it is preferable to arrange it to drive one of the rotational shafts from a hydraulic mixing motor and rotationally couple the remaining rotational shafts with the one driven rotational shaft through rotation transmission members.

In case a hydraulic cylinder is employed for driving the earth excavating means, in addition to hydraulic motors for a vehicle drive and for rotation of the upper rotary body, the mixing motor may be driven from the same hydraulic pump which drives various hydraulic actuators including the above-mentioned hydraulic cylinder and motors. In such a case, arrangements should be made to supply operating oil preferentially to the mixing motor of the soil tumbling/mixing means of the continuous processing trough, by the use of a flow rate preferential means which is connected to the discharge side of the hydraulic pump and provided with a distribution control valve having a preferential supply passage connected to the hydraulic mixing motor through a control valve to supply operating oil preferentially thereto. In this instance, a throttle is provided between the distribution control valve and the control valve to supply operating oil to the hydraulic mixing motor at a constant flow rate.

The soil hopper may be constituted by a hopper of a frame-like structure which is mounted on the continuous processing trough and provided with a sieve member to separate massive solid foreign bodies from soil, along with a forced feed means for forcibly sending sand and soil into the continuous processing trough. The soil discharge means should preferably be arranged in such a way as to transfer improved soil from the continuous processing trough in a direction perpendicular to the traveling direction of the vehicular body and to discharge it at a position on the outer side of treading portions of one crawler belt. Preferably, the soil discharge means is provided with a connecting passage between the continuous processing trough and a main soil discharging passage structure, receiving improved soil from the continuous processing trough and passing it on to the main soil discharging passage structure, which is preferably provided with a soil transfer means such as belt conveyer with or without soil dumping plates, screw conveyer or the like.

From a standpoint of availability of a sufficient space, the additive feed means is preferably mounted on the side of the upper rotary body, including an additive feeder having a tank or flexible container mounted on a frame of the upper rotary body, and a soil hopper which can pool therein a certain amount of additive soil improving material to be supplied to the continuous processing trough. For controlling the feed rate of additive soil improving material, the additive feeder is internally equipped with a container which is adapted to temporarily store a predetermined amount of additive soil improving material and provided with a shutter for the control of additive feed rate. Preferably, angular position of the upper rotary body is detected by a rotational angle detection means for the purpose of determining an appropriate timing for feeding additive soil improving material from the temporary container to an additive feed hopper, opening the above-mentioned shutter according to a signal from the rotational angle detection means.

The soil tumbling/mixing means which is provided internally of the continuous processing trough may be constituted by a rotary mixing conveyer having a fixed transfer rate per rotation. On the other hand, the additive feed means may be constituted by a mechanism which is capable of feeding additive soil improving material to the continuous processing trough substantially at a constant rate, and, for the sake of accurate control of mixing ratio, which is preferably associated with a mixing ratio control means which controls the feed rate by the additive feed means according to the feed rate of sand and soil by the soil tumbling/mixing means. For instance, in case the additive feed means is constituted by a rotary type constant feed means which is capable of feeding additive soil improving material to the continuous processing trough at a constant rate, it can may be controlled in such a manner as to follow the rotational speed of the soil mixing conveyer.

BEST MODE FOR CARRYING OUT THE INVENTION

Hereafter, the present invention is described more particularly by way of its preferred embodiments with reference to the accompanying drawings. The excavation mechanism of the soil treating machine according to the present invention, which will be described hereinbelow, is substantially same as the excavation mechanisms which are provided on hydraulic power shovels in general. Namely, the soil treating machine according to the present invention utilizes the basic construction of a hydraulic power shovel which is well known in the art, namely, it is built as a self-contained soil treating machine by incorporating a soil treating mechanism into a hydraulic power shovel without necessitating to make such material changes to its basic construction as would limit its original functions as a power shovel.

Figure 1:
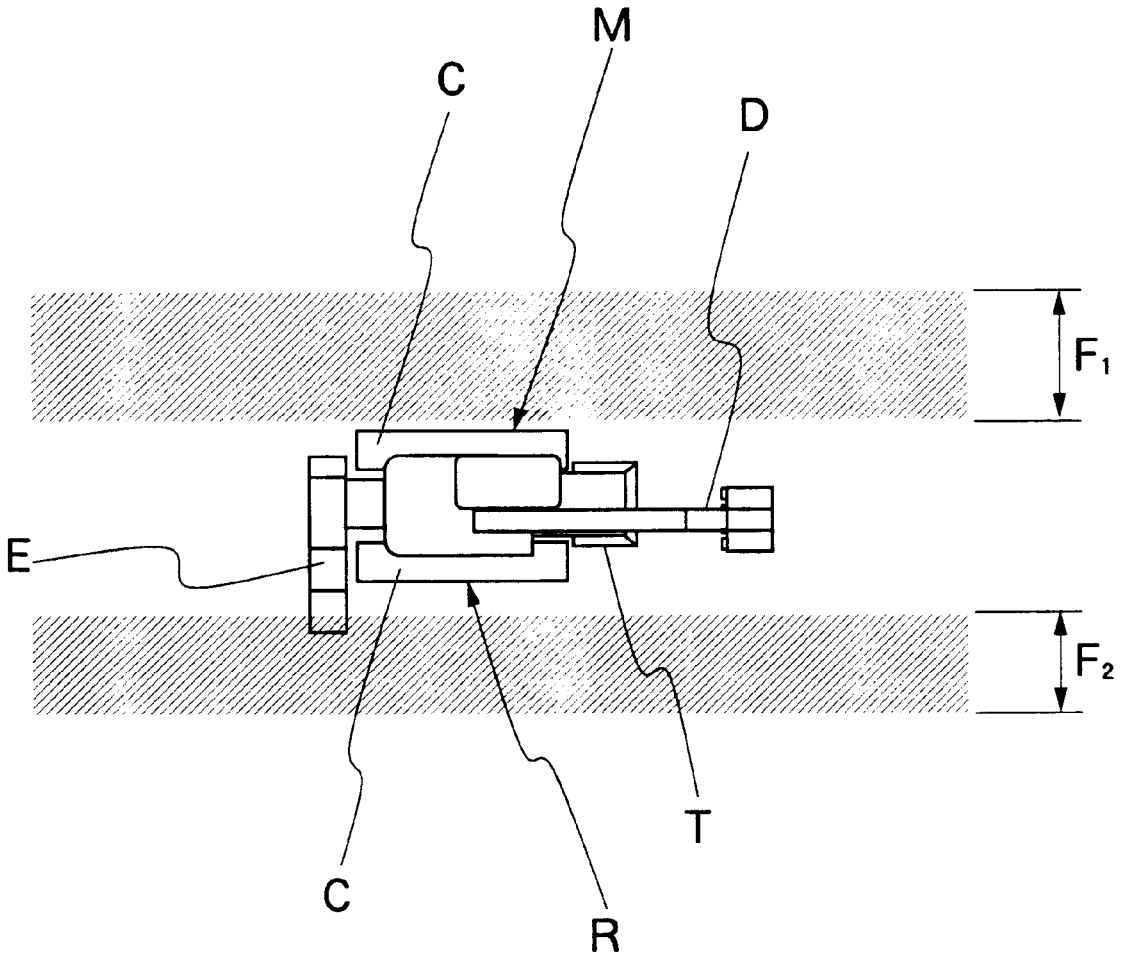
FIG. 1 schematically shows the steps of a foundational soil treatment by a soil treating machine.
Figure 2:
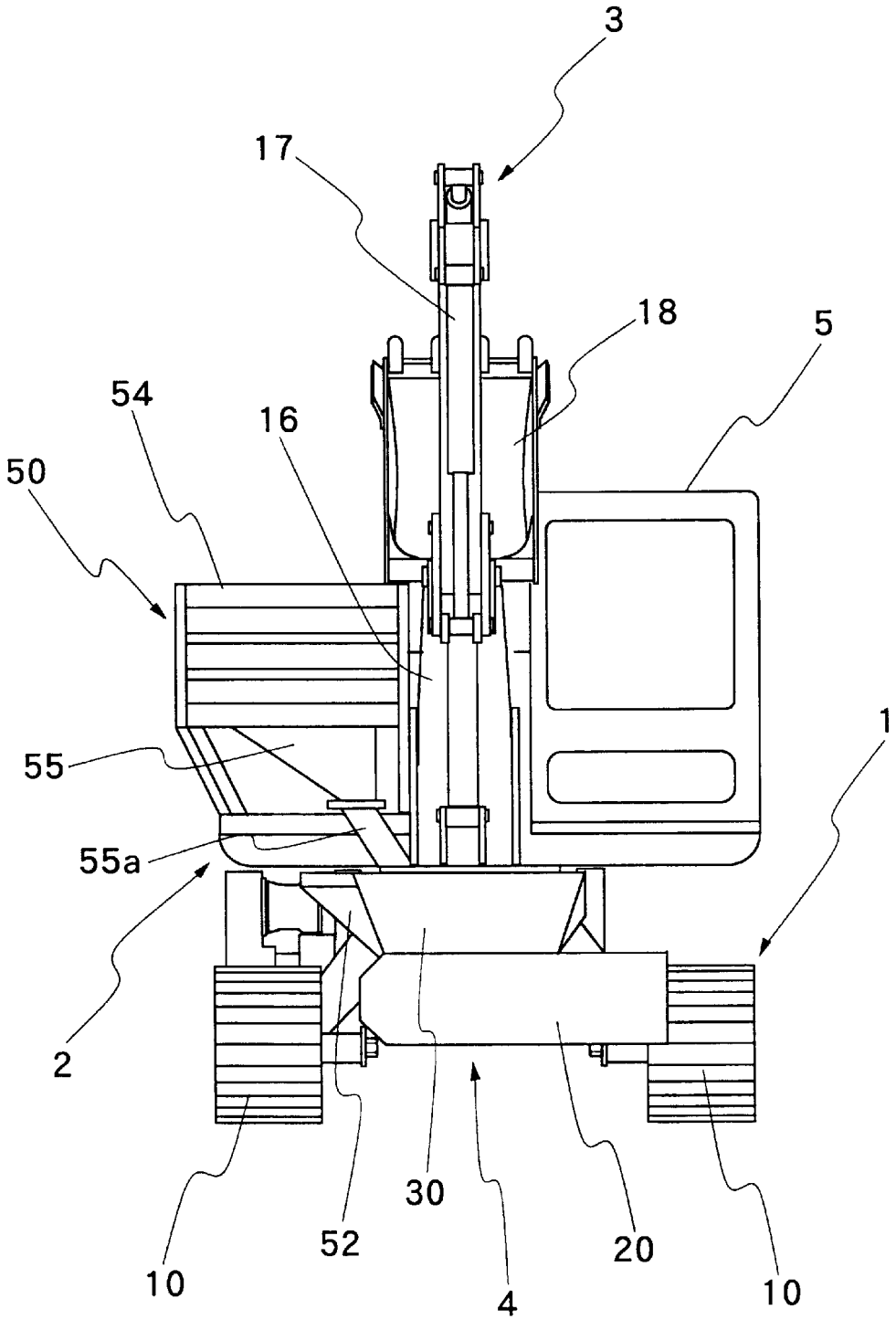
FIG. 2 is a schematic front view of a soil treating machine with an excavation means, adopted as a first embodiment in the present invention.
Figure 3:
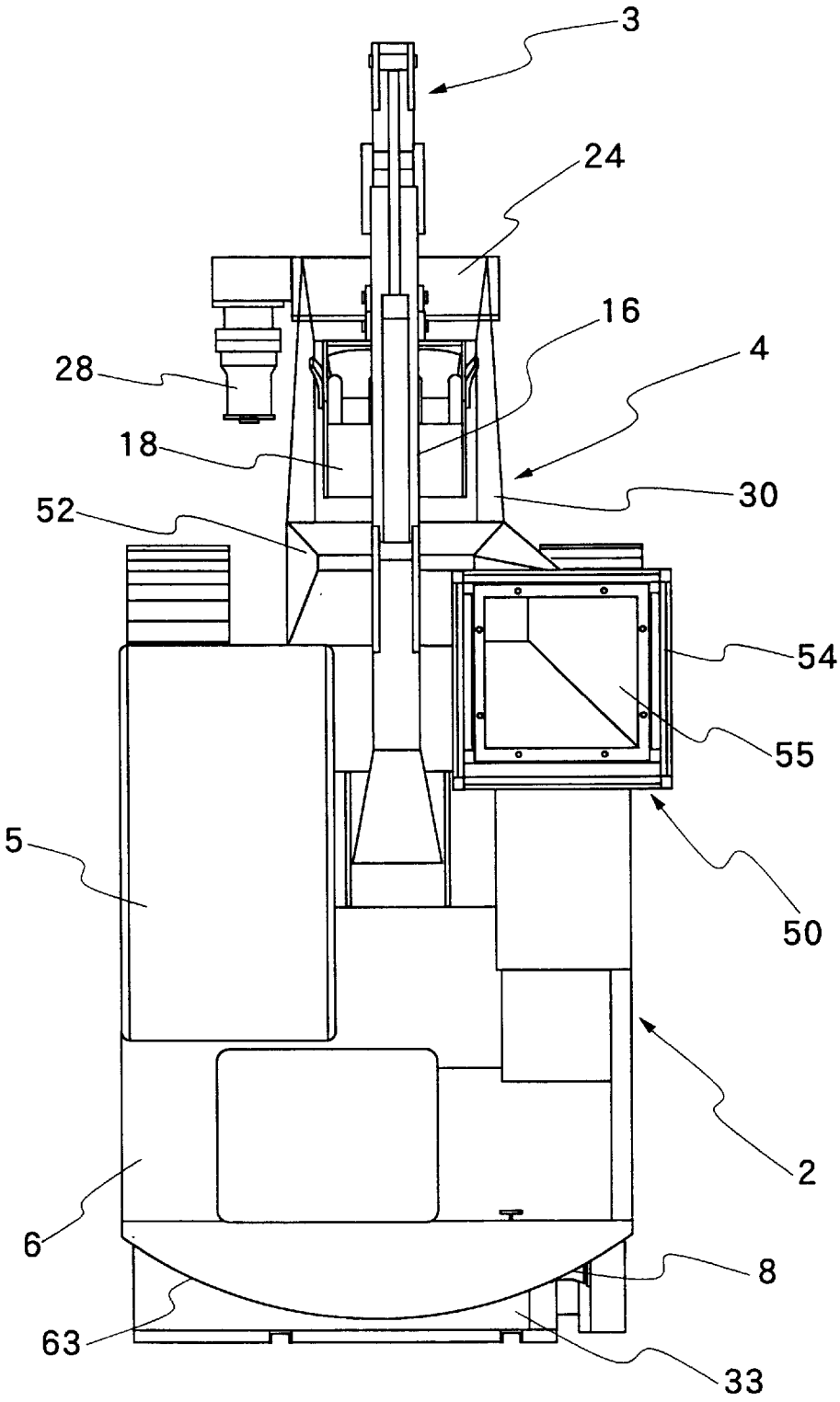
FIG. 3 is a schematic plan view of the soil treating machine of FIG. 2.

Before going into a description on the details in construction of the soil treating machine according to the present invention, a reference is firstly had to FIG. 1 to explain the steps which are generally taken in a soil treatment in geotechnological engineering, particularly, in a treatment of foundational soil at a construction site or the like.

In FIG. 1, indicated at M is a traveling or vehicular soil treating machine having a crawler type vehicular drive R having a pair of crawler belts C at opposite sides of the machine. The soil treating machine M is further provided with an excavation means D, a soil treating apparatus T and a soil discharging means E. At a geotechnological engineering site, an excavation field zone F1 and a depository field zone F2 are demaarcated on the opposite sides of the soil treating machine M While excavating the ground along the excavation field zone F1, improved soil which has undergone a treatment by the soil treating apparatus T is temporarily put on the depository field zone F2. Upon completing excavation of one excavation field zone F1, improved soil on the depository field zone F2 is refilled into the excavation field zone F1. The excavation means D is used for this refilling work as well. As soon as a soil treatment of one excavation field zone F1 is finished, the soil treating machine M is shifted to a next working position, for example, to the lower side of the drawing by a distance corresponding to the width of one excavation field zone F1. By successively shifting the working position of the soil treating machine in this manner, the soil improving operation can be extended zone by zone to cover all areas of a ground which needs a treatment. In place of linear working zones, the soil treating machine may be moved, for example, along loop-like circular zones if desired. After refilling the excavated ground with improved soil, the ground surfaces are leveled and compacted into a flat form. The refilled soil may be leveled and compacted by the use of a blade which is attached to the soil improving machine M or by reading thereon with the crawler belts C of the machine.

In strengthening a soft and weak foundation of a ground by a soil treatment as described above, for example, cement can be suitably used as a soil improving material to be mixed into excavated sand and soil for solidification purposes. In order to carry out the soil treatment efficiently, it is advantageous to use a single self-contained machine is capable of performing two different operations concurrently, i.e., an operation of excavating sand and soil out of a ground and an operation of adding and mixing a soil improving material into excavated sand and soil. In doing so, excavated sand and soil should be mixed with a soil improving material by a continuous soil processing operation. Further, in order to produce improved soil of high quality in a prompt and efficient manner, a soil improving material should be blended with excavated sand and soil efficiently and accurately in a predetermined mixing ratio under strict control.

Above all, it is important to mix a soil improving material with excavated sand and soil accurately in a specific mixing ratio. In case the proportion of sand and soil is too large, it becomes difficult to strengthen the foundational soil construction to a satisfactory degree. On the other hand, a larger proportion of a soil improving material can contribute to fortification of the foundation to a greater degree, but a wastefully large proportion of a soil improving material is only reflected by increases in cost. Accordingly, it is desirable to determine the mixing ratio of a soil improving material by experiments beforehand, using sand and soil sampled from the ground of a geotechnological engineering site. In an actual soil treating process, a soil improving material has to be blended with sand and soil under accurate control of mixing ratio. As mentioned hereinbefore, it is probable that irregular variations in mixing ratio will result in uneven sink-down of the foundation.

According to the present invention, a foundation of a soft ground is strengthened efficiently and accurately to a predetermined degree by a soil treatment using a soil treating machine of the construction as described below.

Referring now to FIGS. 2 through 6, there is shown the general layout in construction of a soil treating machine according to the present invention. This soil treating machine is of an automotive vehicle type and provided with a soil excavation mechanism and a soil treating mechanism in operatively linked relations with each other. As seen in the drawings, the vehicular soil treating machine is largely constituted by a base carrier 1 and an upper rotating body 2. A front working mechanism 3 is provided on the upper rotating body 2 of the vehicle to serve as an excavation mechanism. Provided on the side of the base carrier 1 is a soil processing unit 4 for treating excavated sand and soil.

Also mounted on the upper rotating body 2 are an operator's cab 5 and a machine chamber 6 which accommodates engine, hydraulic pumps or other driving units for the machine. The operator's cab 5 is occupied by an operator at the control of operations of the machine as a whole. The upper rotating body 2 is rotatably supported on a rotational drive mechanism 7 for horizontal rotating movements on the base carrier 1. Further, the upper rotating body 2 is provided with a counterweight 8 in a rear position behind the machine chamber 6 thereby to keep the machine as a whole in a balanced state while the front working mechanism is in a ground excavating operation.

As a vehicle drive, the base carrier 1 is built in a crawler type vehicle with a pair of crawler drive units 10 which are located at the opposite sides thereof. These crawler drive units 10 are each constituted by sprocket and idler wheels 12 and 13 which are supported on the opposite ends of a truck frame 11, and a crawler belt 14 which is passed around the sprocket and idler wheels 12 and 13. The sprocket 12 of each crawler unit is driven from a hydraulic motor. The truck frames 11 at the opposite sides of the base carrier are each connected to a center frame 15 on which the above-mentioned rotating mechanism 7 is mounted. In this instance, the rotating mechanism 7 is mounted on a horizontal intermediate section of the center frame 15, and the opposite end portions of the center frame 15 which are connected to the truck frames 11 are bent downward to provide a broad space thereunder.

The front working mechanism 3 which serves as an excavation means has a boom 16 which is pivotally mounted on the upper rotating body 2 for vertically upward and downward movements, an arm 17 which is pivotally connected to the fore end of the boom 16 similarly for upward and downward movements, and a bucket 18 which is pivotally supported at the fore end of the arm 17. These boom 16, arm 17 and bucket 18 are driven from hydraulic cylinders 16*a*, 17*a* and 18*a*, respectively, at the time of excavating sand and soil out of a ground which needs a foundational soil treatment.

The operations of the foregoing machine components, including the vehicular traveling operation by the crawler belts 14, rotation of the upper rotary body 2 by the rotational mechanism and excavation of sand and soil by operation of the front working mechanism 3 are manually controlled by an operator by way of various control levers or other control means which are provided in the operator's cab 5. In this regard, the soil treating machine is operated substantially in the same manner as hydraulic power shovels in general. However, the soil treating machine differs from hydraulic power shovels in general in that it integrally includes, in addition to the above-mentioned excavation means, a soil processing unit 4 for admixing a soil improving material to excavated sand and soil.

Figure 7:
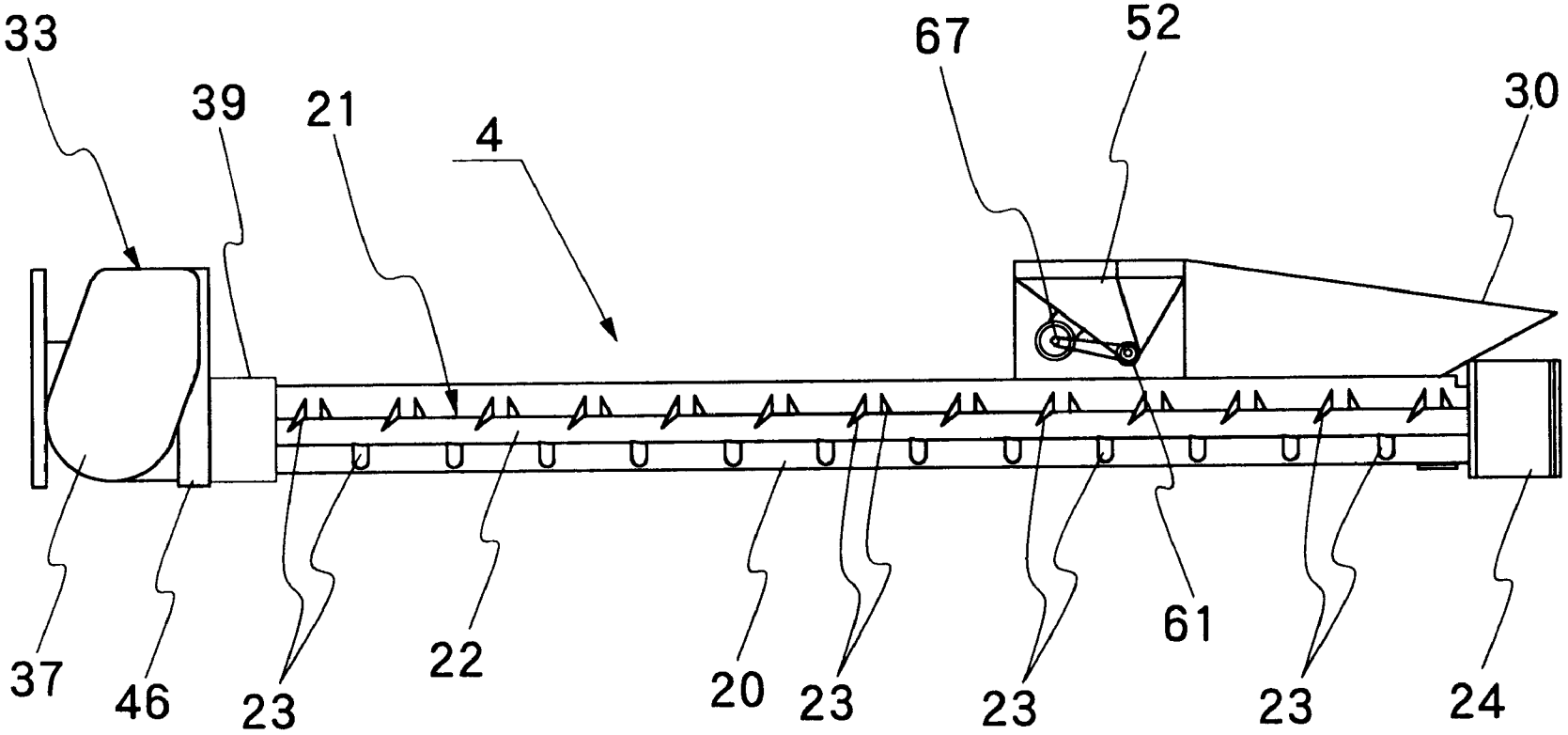
FIG. 7 is a schematic side view of a soil processing unit.
Figure 8:
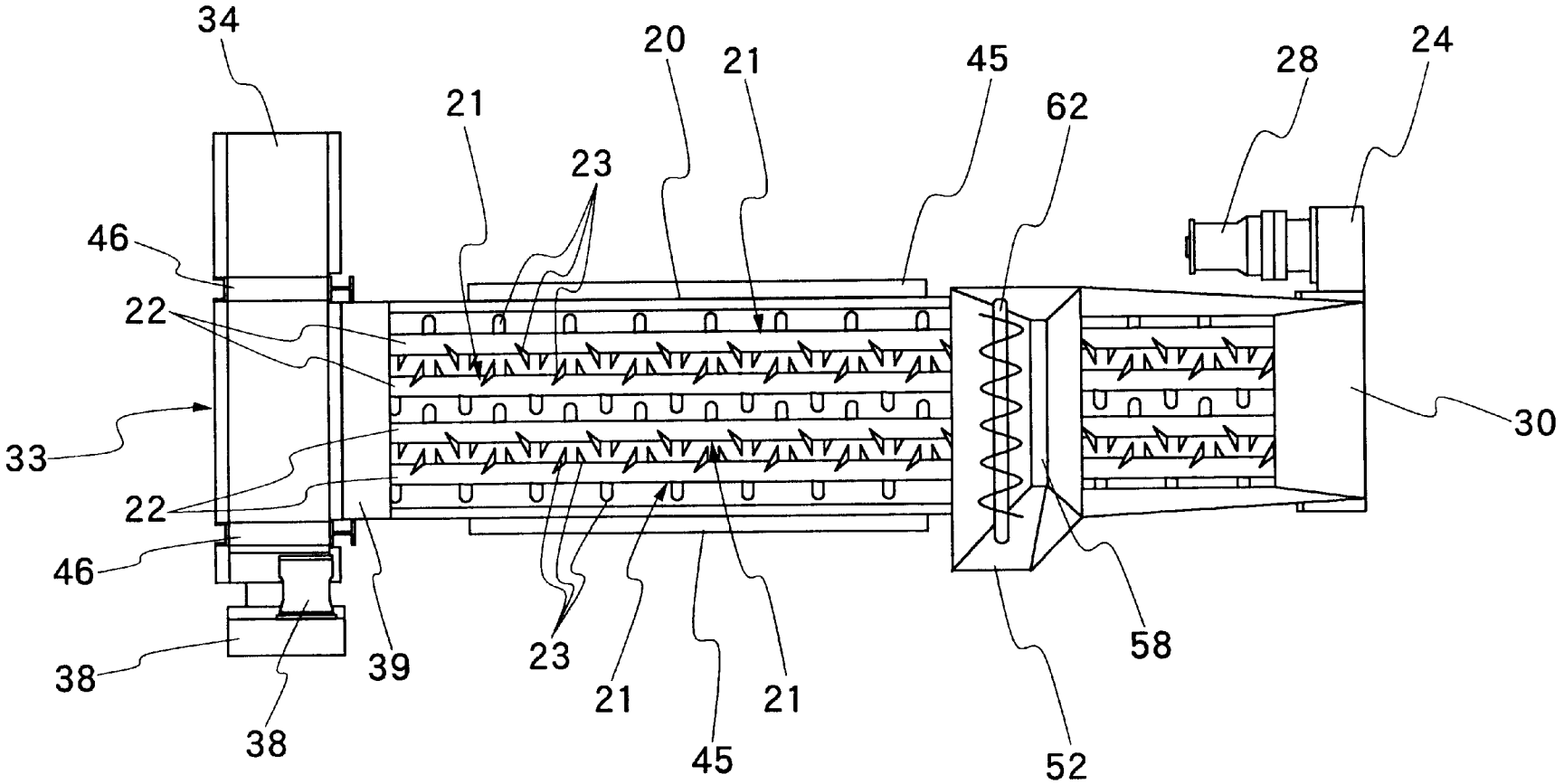
FIG. 8 is a schematic plan view of the same soil processing unit.

Turning now to the soil processing unit 4, the construction of the soil processing unit 4 as a whole is schematically shown in FIGS. 7 and 8. As seen in these figures, the soil processing unit 4 is provided with a continuous soil processing trough 20 in the form of a shallow container having a large length as compared with its width. The continuous soil processing unit 20 is opened on its upper side and at its rear end. Provided within the continuous processing trough 20 are four conveyers as soil tumbling/mixing means, that is, four screw conveyers 21 which are positioned side by side in parallel relation with each other. Each screw conveyer 21 is constituted by a rotational shaft 22 and a large number of paddles 23 which are planted on the circumferential surface of the rotational shaft regularly at predetermined intervals in both axial and circumferential directions. As the rotational shaft 22 is put in rotation, sand and soil is tumbled and mixed while it is transferred through the continuous processing trough 20 by the action of the paddles 23.

Figure 9:
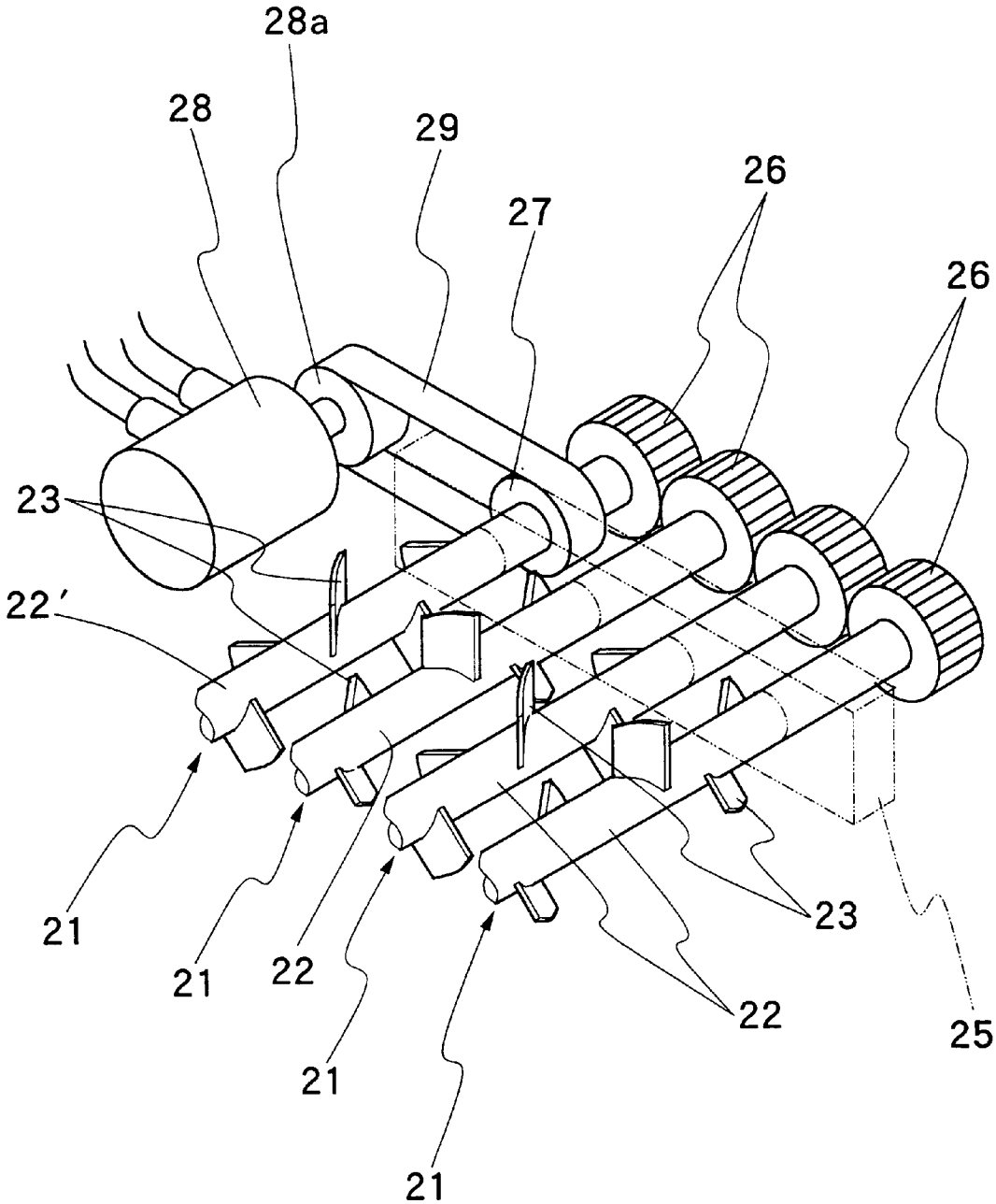
FIG. 9 is a schematic view of a screw conveyer drive mechanism.

As shown in FIGS. 2 through 6, the continuous processing trough 20 is mounted on the base carrier 1 in an intermediate position between the two crawler units 10 and under the center frame 15. A trough drive section 24 is provided at the front end of the continuous processing trough 20, which is located on the side of the front working mechanism of the machine, thereby to drive all of the screw conveyers 21 simultaneously. In the particular embodiment shown, the trough drive section 24 is arranged as schematically shown in FIG. 9. As shown particularly in that figure, the trough drive mechanism 24 is provided with a bearing unit 25 which rotatably supports fore end portions of the rotational shafts 22 of the respective screw conveyers 21. Besides, the bearing unit 25 functions to partition off the trough drive 24 from the continuous processing trough 20, thereby preventing sand and soil from entering the trough drive section 24. The four rotational shafts 22 of the screw conveyers 21 are extended into the trough drive section 24 through the bearing unit 25 and provided with transmission gears 26 at the respective fore ends. These transmission gears 26 are meshed with a transmission gear or gears of an adjacent rotational shaft or shafts, so that, when one of the rotational shafts 22 is driven into rotation, the other three rotational shafts 22 are simultaneously put in rotation in an interlinked fashion, following the rotation of the driven rotational shaft 22. In this instance, the intermeshed adjacent rotational shafts 22 are put in rotation in opposite directions.

A pulley 27 is mounted on one of the rotational shafts 22, for example, on a rotational shaft which is indicated at 22' in FIG. 9, while another pulley 28*a* is mounted on an output shaft 28 of a hydraulic mixing motor 28 which is mounted in the housing of the trough drive 24. These pulleys 27 and 28*a* are rotationally coupled through a transmission member 29 such as chain, belt or the like which is passed therearound. As a consequence, the internal spaces of the continuous processing trough 20 can be entirely agitated by the use of one and single hydraulic mixing motor 28.

In FIGS. 7 and 8, indicated at 30 is a soil hopper which is located over a front portion of the continuous processing trough 20 for charging excavated sand and soil thereinto. As shown particularly in FIG. 3, in order to receive excavated sand and soil from the front working mechanism 3, the soil hopper 30 is projected on the front side of the upper rotary body 2 and under the front working mechanism 3 when it is turned forward in the travel direction of the machine. The soil hopper 30 is comprised of a box-like frame structure which is converged in the downward direction or toward the continuous processing trough 20 and inclined toward the front end of the continuous processing trough 20.

Figure 10:
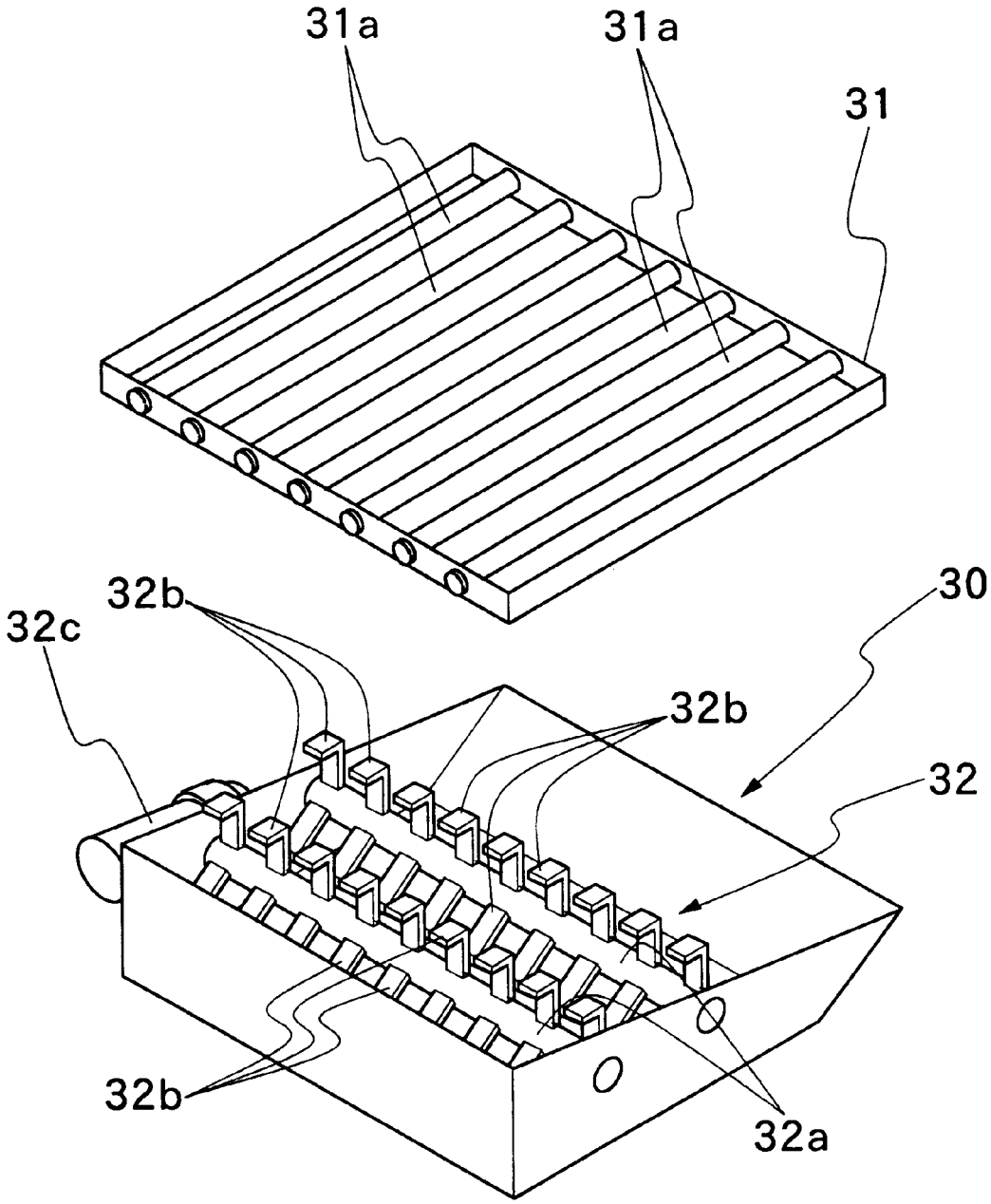
FIG. 10 is an exploded perspective view of a soil charging hopper.

If desired, a grate member 31 and a forced feed means 32 may be fitted in the soil hopper 30 as shown in FIG. 10 (although both grate member 31 and forced feed means 32 are omitted in FIG. 8). By fitting the grate 31 in an upper open end portion of the hopper, rocks or blocks of concrete or metallic material can be prevented from entering the soil processing trough 20 along with sand and soil to be treated. However, entering of pebbly stones and gravels is rather desirable in case cement is used as a soil improving material since they will contribute to strengthening the foundational soil construction of a ground all the more. In such a case, the grate member 31 is preferred to be formed of a series of rods 31*a* which are spaced from each other to such a degree as to permit passage therethrough of pebbly stones and gravels. Since the soil hopper 30 is downwardly inclined toward the front end of the processing trough 20, relatively large rocks which remain on the grate 31 tend to slide downward and fall off the grate 31 by gravity. Accordingly, large blocks remaining on the grate 31 can be easily eliminated from the hopper 30 by pushing them with the bucket 18.

The forced feed means 32 can be located within the soil charging hopper 30 and under the grate member 31. This forced feed means 32 functions to actively take in sand and soil from the grate 31 and to send incoming sand and soil smoothly to the continuous processing trough 20. For these purposes, the forced feed means 32 has a large number of raker claws 32*b* planted on rotational shafts 32*a* which are rotationally driven from a hydraulic motor 32*c*. The raker claws 32*b* are arranged to turn around between the rods 31*a* of the grate 31 and are desirably formed in such a length as to project upwardly through the grate 31 when they come to respective top positions on the rotational shafts 32*a*. When arranged in this manner, even soil which is in the form of massive blocks like clay due to a large moisture content can be broken down and passed smoothly through the grate member 31 by scraping actions of the raker claws, without lingering on the grate to cause the so-called "bridging" phenomenon.

A soil discharging means 33 is connected to the rear end of the continuous processing trough 20. This soil discharging means 33 provides an outlet for treated soil which is continuously produced in the soil treating trough 20. As clear from the drawings, the soil discharging means 33 is located on the base carrier 10 in a position rearward of the crawler belts 14 of the vehicular drive 10. The construction of the soil discharging means 33 is more particularly shown in FIGS. 11 to 13.

Figure 11:
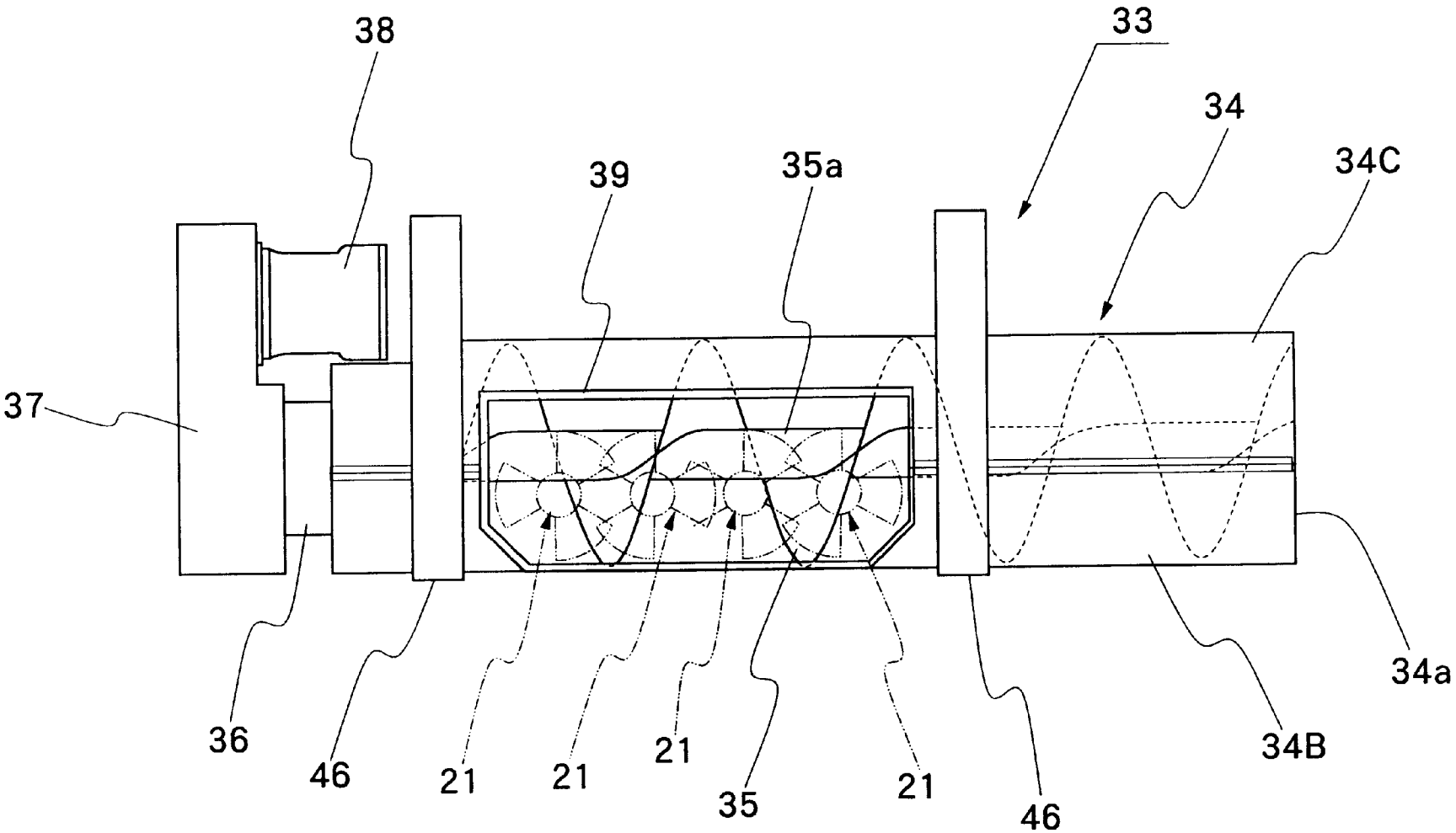
FIG. 11 is a schematic front view of a soil discharging means.

As clear from FIG. 11, the soil discharging means 33 is provided with a soil discharging passage 34 in the form of a hollow tubular structure. This hollow tubular structure of the soil discharging passage 34 is disposed perpendicularly with the travel direction of the base carrier 1 and opened at one end to provide an outlet 34*a* for treated soil. The soil discharging passage 34 is internally provided with a soil discharging screw 35 which extends from the other end of the soil discharging passage toward the soil outlet end 34*a* just mentioned. The soil discharging screw 35 is constituted by a rotational shaft 35*a* with a continuous helical vane 35*b*. The rotational shaft 35*a* is extended into a drive section 37 through a bearing unit 36, which is connected to one end of the soil discharging passage 34. At the drive section 37, the rotational shaft 35*a* is coupled with a hydraulic motor 38 serving as a rotational drive for the soil discharging screw 35.

Figure 12:
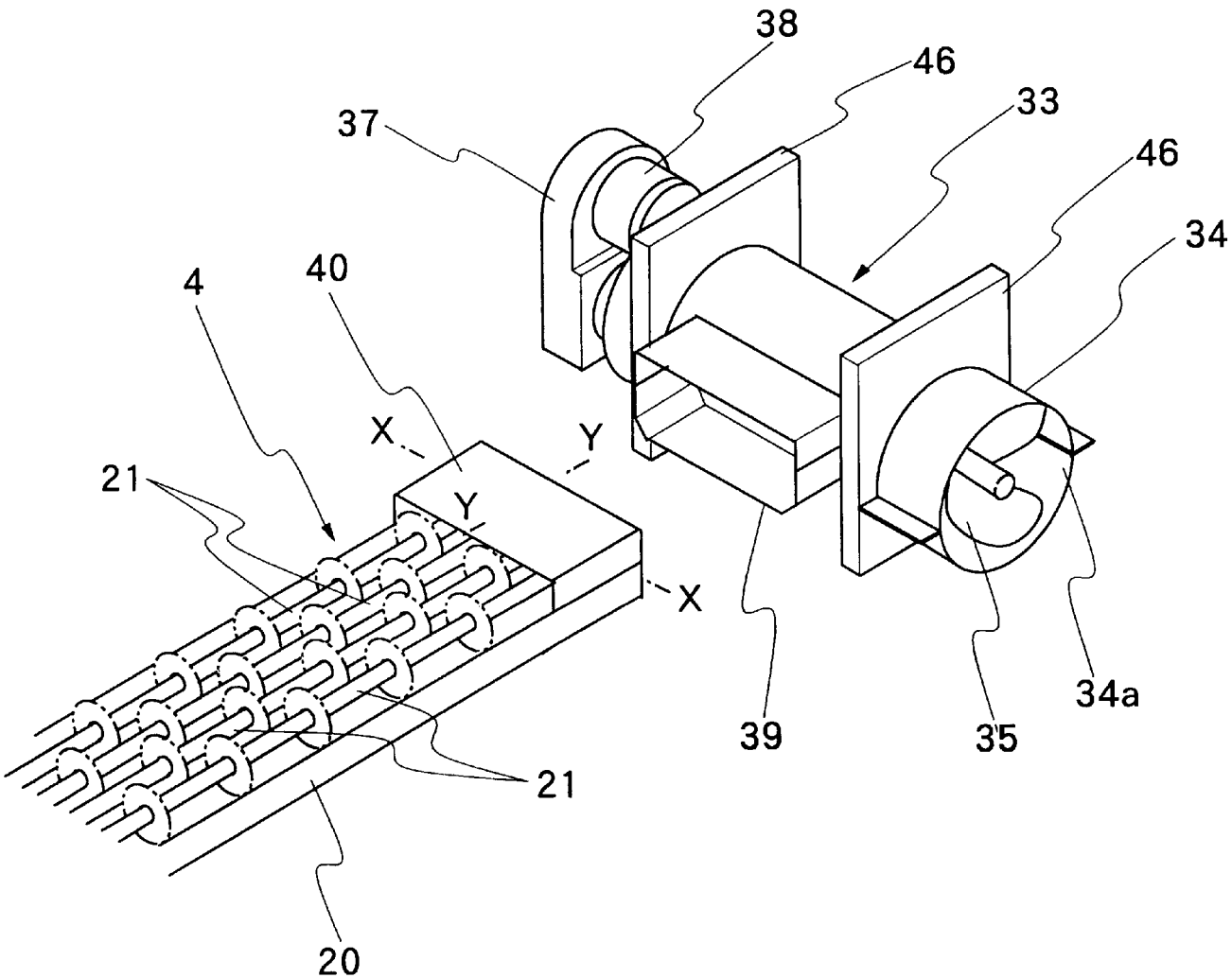
FIG. 12 is a schematic view of a coupling mechanism employed for coupling the discharging means with a continuous soil processing trough.

The soil discharging means 33 may be integrally assembled with the continuous processing trough 20 if necessary. In such a case, however, it is preferred that the soil discharging means 33 can be easily disassembled from the trough 20 at the time of cleaning its internal portions. For this purpose, coupling portions are provided on the tubular structure 34 of the soil discharging means 33 and at the rear end of the continuous processing trough 20 as shown in FIG. 12. More specifically, as seen in that figure, a socket 39 substantially of a box-like rectangular shape is provided on a lateral side of the tubular passage structure 34 of the soil discharging means 33 to receive and engage with a rear end portion of the continuous processing trough 20 which is enclosed by a box-like cover member 40 on the top side thereof. Thus, by fitting engagement with the socket box 39, the rear end portion of the continuous processing trough 20, with the cover box 40, is detachably connected to the soil discharging means 33. A rear end portion of the continuous processing trough 20 may be directly fitted in the socket box 39 if desired. However, it is desirable to fit a distal end portion of the cover box 40 in the socket box 39 on the part of the soil discharging passage since the continuous processing trough 20 can be fixedly retained in position by way of the cover box 40.

Figure 13:
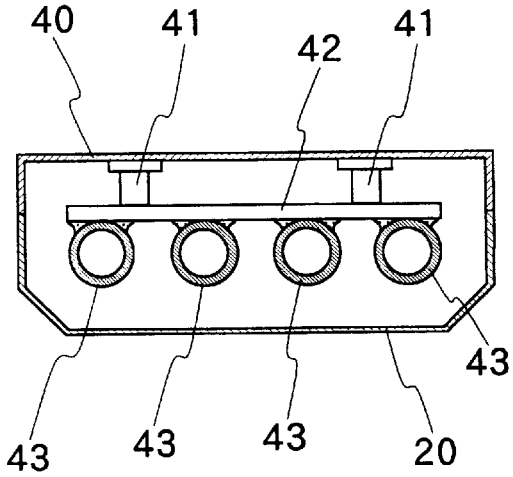
FIG. 13 is a schematic sectional view taken on line X—X of FIG. 12.
Figure 14:
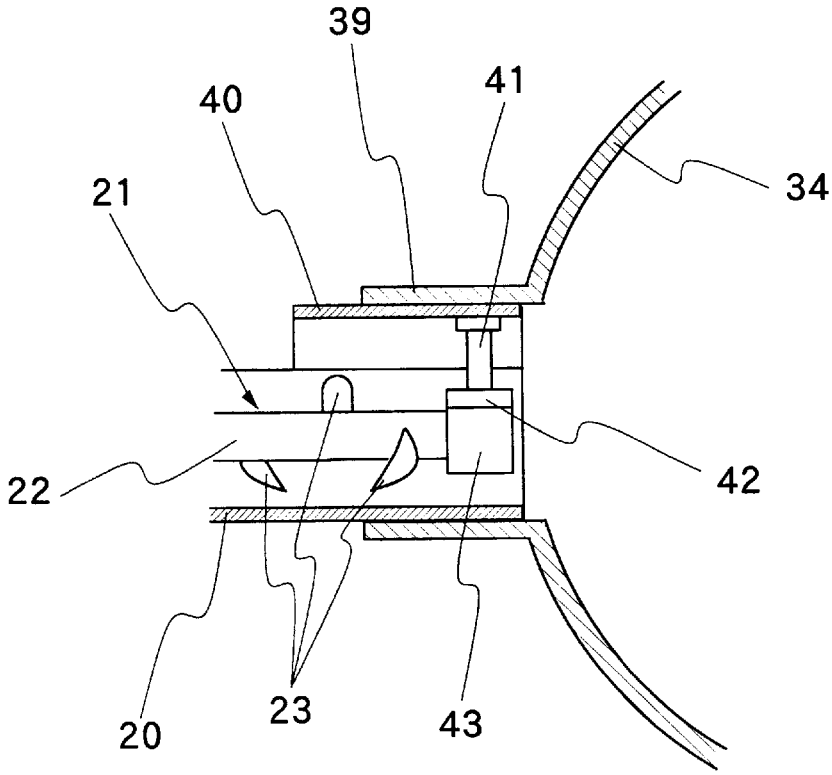
FIG. 14 is a schematic sectional view taken on line Y—Y of FIG. 12.

As explained hereinbefore, the screw conveyer 21 is extended internally of and substantially from end to end of the continuous processing trough 20. The rotational shafts 22 of the screw conveyer 21 which are rotatably supported by the bearing unit 25 at the respective front ends need to be similarly supported at the respective rear ends. However, since treated soil is delivered through the rear end of the continuous processing trough 20, the support for the rotational shafts 22 should not come into the way of treated soil. In this regard, the cover member 40 at the rear end of the continuous processing trough 20 serves as a coupler for the soil discharging means 33 and at the same time as a support for a bearing which rotatably supports rear end portions of the rotational shafts 22. To this end, as shown in FIGS. 13 and 14, a plural number of hanger posts 41 which are suspended from the ceiling of the cover box 40, and a hanger plate 42 is securely fixed to the lower ends of the respective hanger posts 41. The hanger plate 42 has bearings 43 securely fixed to its lower side by welding or by other suitable fixation means.

The soil hopper 30 is securely fixed to the continuous processing trough 20, for example, by the use of bolts, and the continuous processing trough 20 is detachably fixed to the center frame 15 of the base carrier 1. Accordingly, the soil discharging means 33 which is detachably connected to the continuous processing trough 20 is retained in a fixed state relative to the center frame 15.

Figure 15:
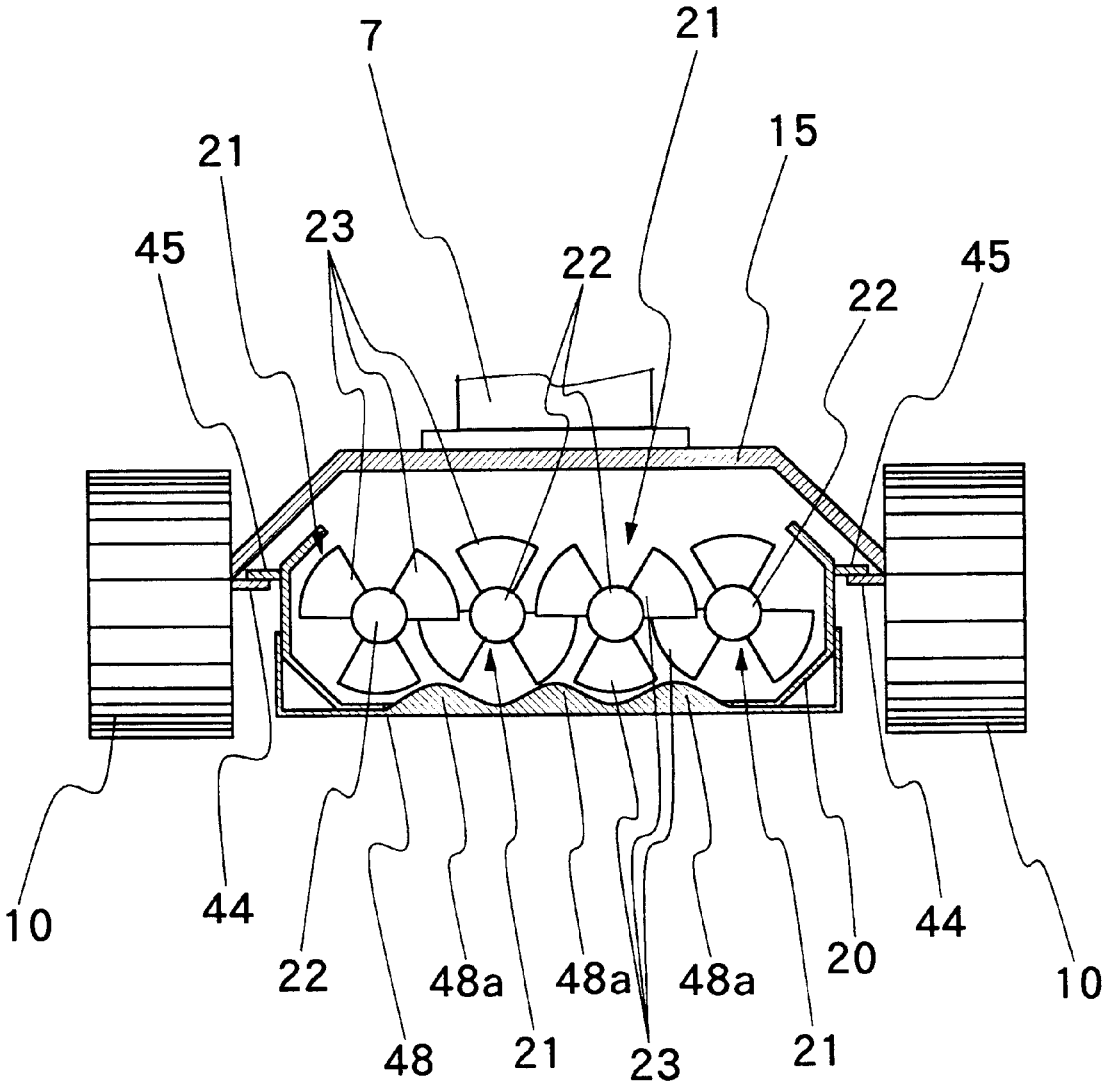
FIG. 15 is a schematic sectional view of the continuous processing trough, taken on line Y—Y of FIG. 12.

In order to support the continuous processing trough 20 on the center frame 15, inwardly projecting ledges 44 are provided on the inner side of the center frame 15, as shown in FIG. 15, holding thereon side wings 45 which are projected outward from the opposite lateral side walls of the continuous processing trough 20. Consequently, upon placing the side wings 45 on the support ledges 44, the continuous processing trough 20 is supported on the base carrier 1. In this regard, in order to support the lengthy processing trough 20 at a plural number of positions, it is desirable to provide support ledges 44 not only on the center frame 15 but also on the casing of the hydraulic motor of the sprocket 12. The side wings 45 may be fixed to the support ledges 44 by the use of bolts or a suitable stopper means may be provided therebetween in case it is difficult to retain the continuous processing trough 20 in a stable state simply by placing the side wings 45 on the support ledges 44.

Figure 4:
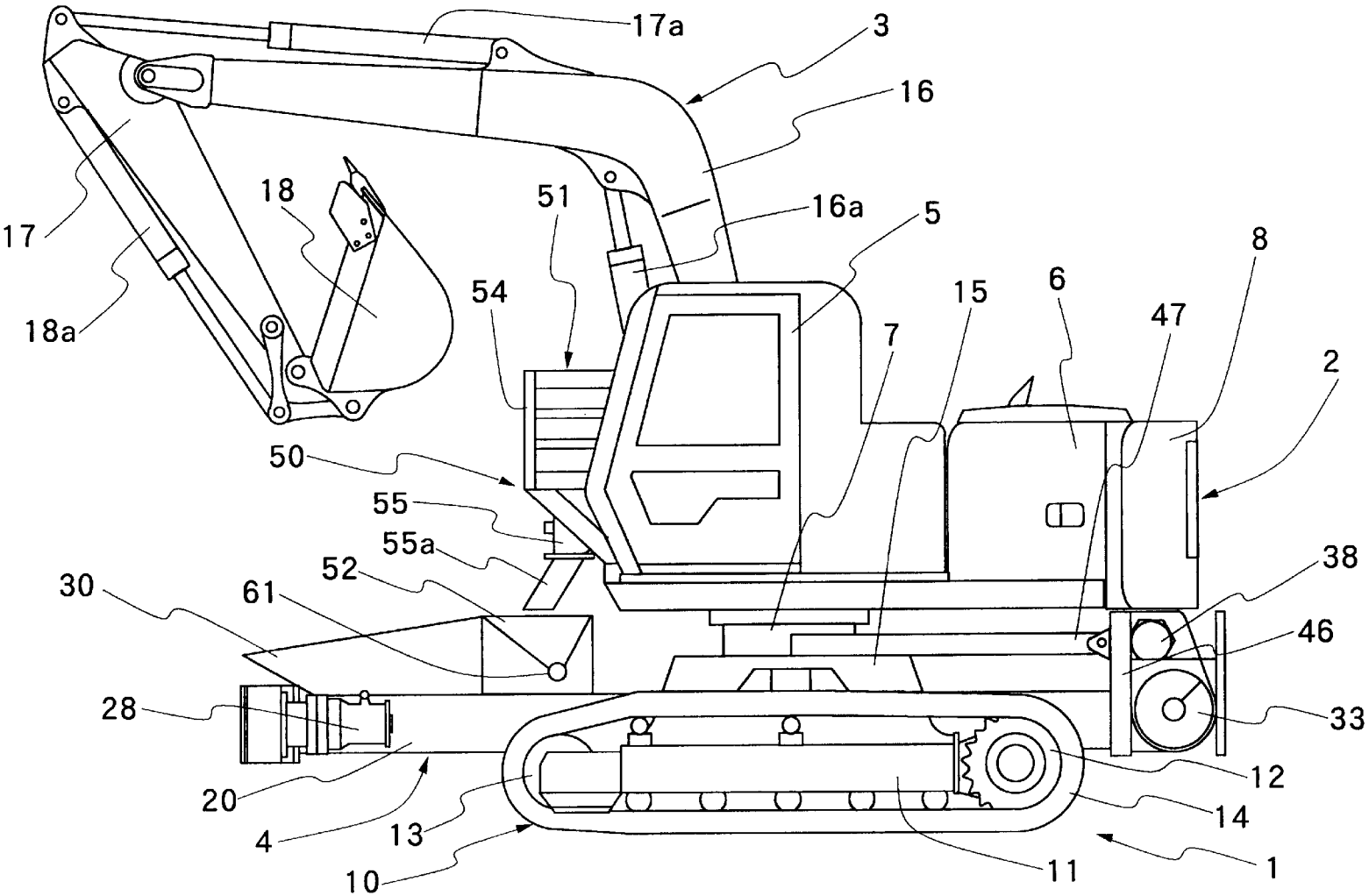
FIG. 4 is a left-hand side view of the soil treating machine of FIG. 2.
Figure 5:
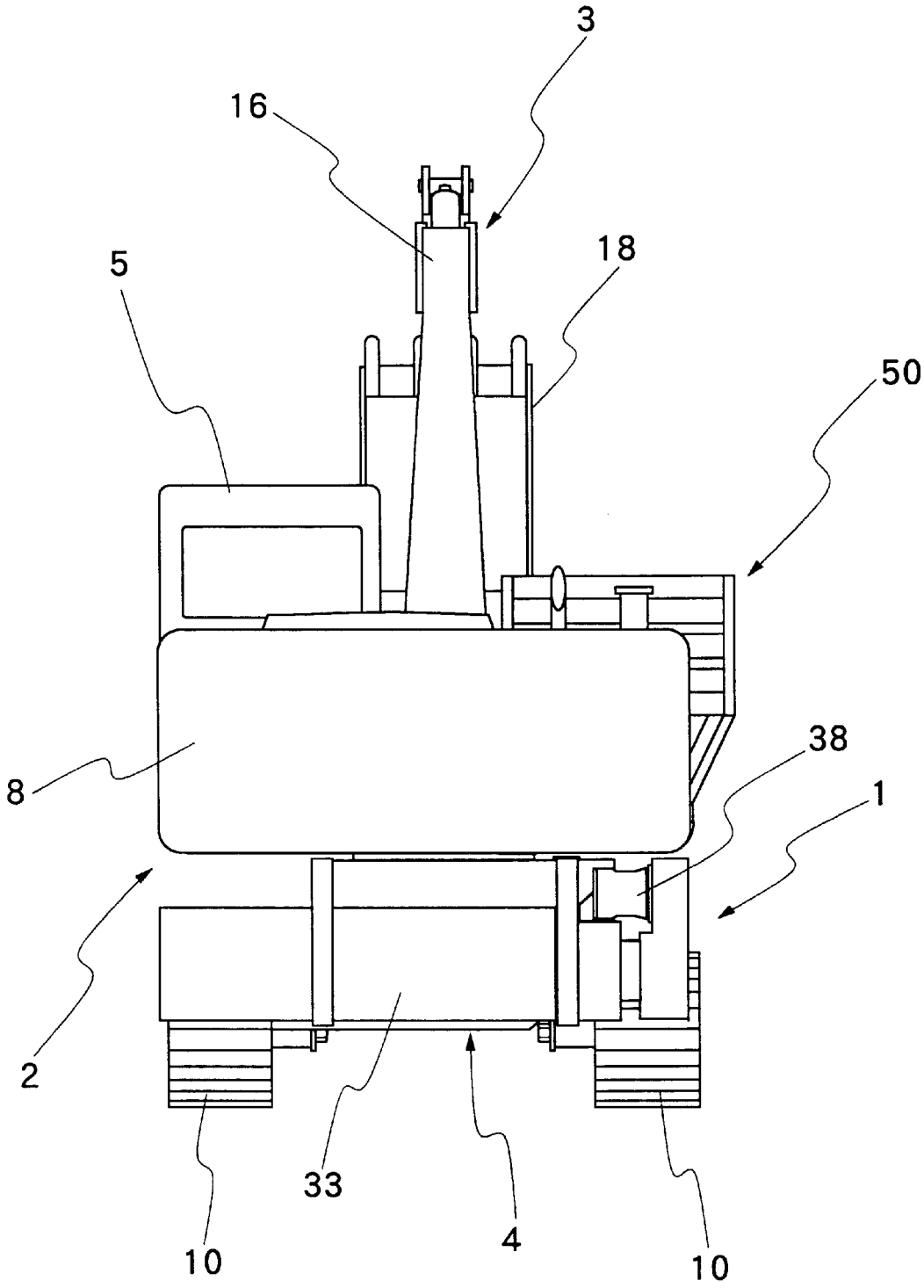
FIG. 5 is a back view of the soil treating machine of FIG. 2.
Figure 16:
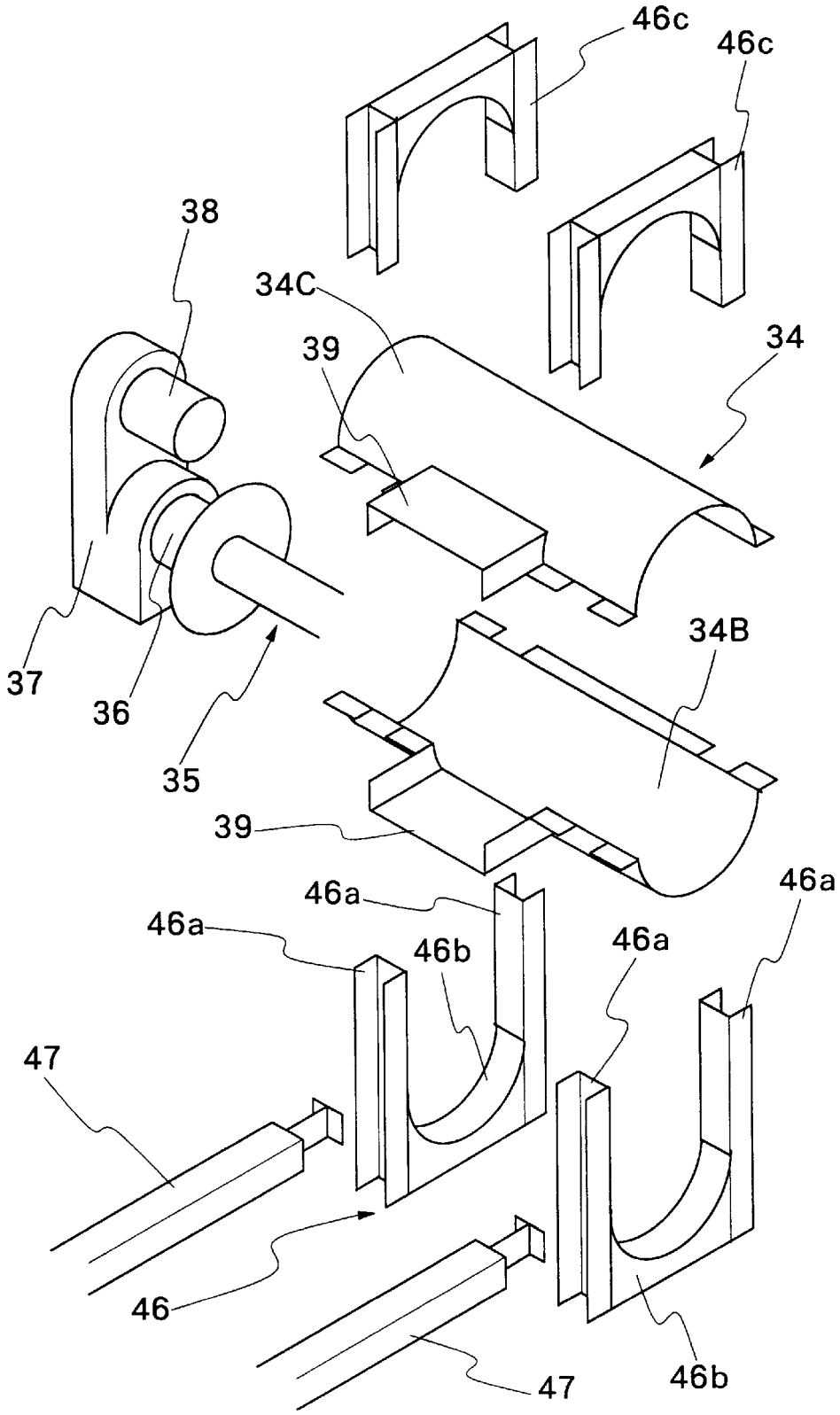
FIG. 16 is an exploded perspective view of the soil discharging means.

On the other hand, as shown in an exploded view in FIG. 16, the tubular passage structure 34 of the soil discharging means 33 is gripped in a pair of clamp frames 46. Each clamp frame 46 includes a lower seating frame comprised of a couple of column portions 46*a* of substantially U-shape in section and a seat portion 46*b* substantially of semi-circular shape which is bridged between the column portions 46*a*, and an upper clamping frame 46*c* of a similar construction. After setting the tubular passage structure 34 on the seat portions 46*b* of the lower seating frames, the upper clamping frames 46*c* are fitted on the tubular passage structure 34 from above. The seat portions 46*b* which are securely fixed to the column portions 46*a* are separable from the latter. The tubular passage structure 34 of the soil discharging means is securely clamped in position between the seat portions 46*b* and the upper clamping frames 46*c* which are securely fixed to the column portions 46*a* of the lower frames by bolts or other suitable means. Connected to the clamping frames 46 are support rods 47 which are securely fixed to the center frame 15 of the base carrier 1 as shown in FIG. 4.

It is for the purpose of facilitating cleaning jobs on the interior side that the continuous processing trough 20 and the soil discharging means 33 are mounted on the base carrier 1 independently of each other as described above. In order to facilitate the cleaning jobs furthermore, the tubular passage structure 34 is preferably dividable into a lower section 34B and an upper section 34C which are fixedly joined with each other by bolts or other suitable fixation means. The soil discharging screw 35 and its drive mechanism are fixedly retained on the lower section 34B of the passage structure 34. It follows that the soil discharging screw 34B can be cleaned easily after unfixing and removing the upper section 34C of the passage structure 34 from its lower section 34B.

Figure 6:
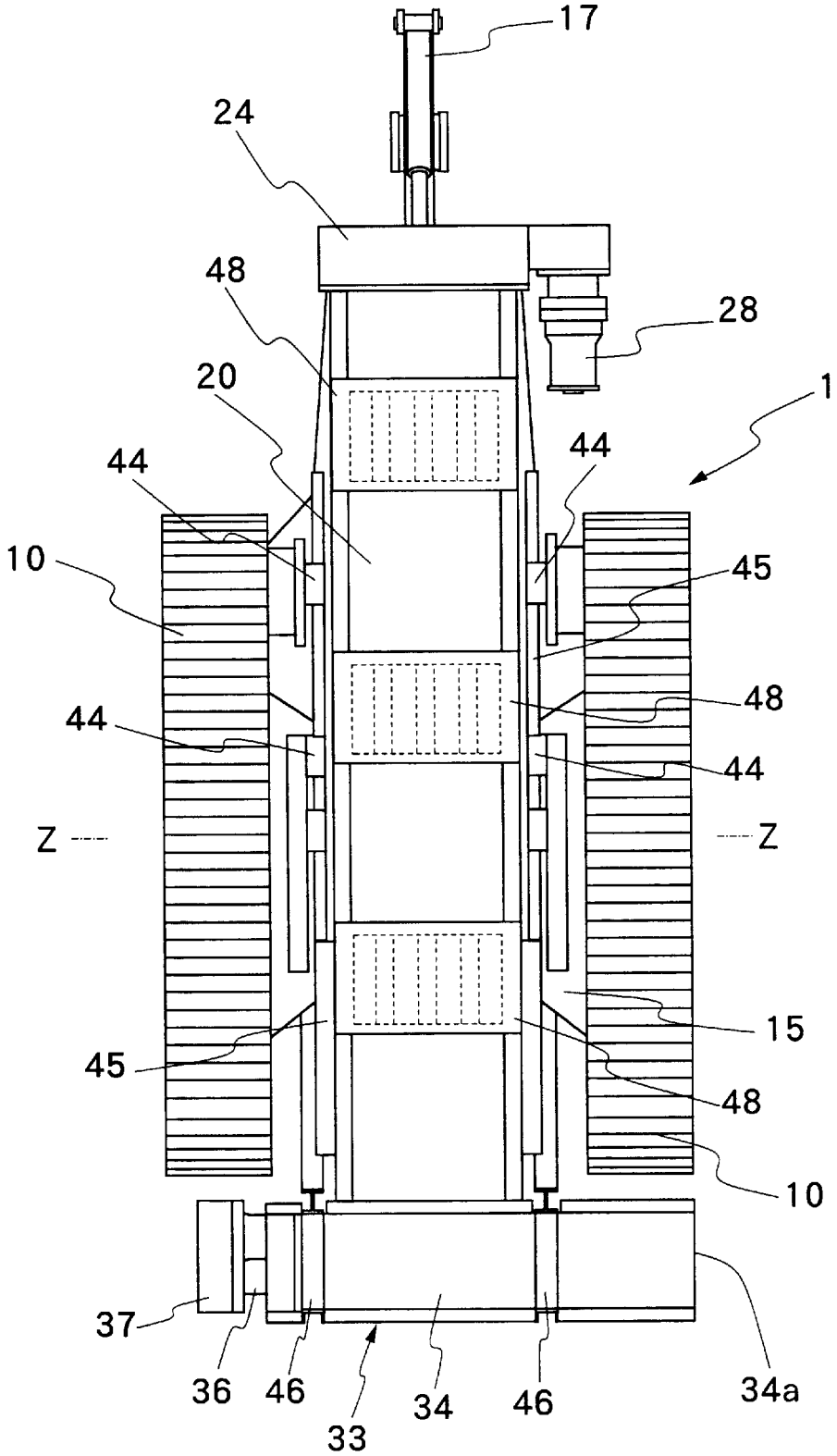
FIG. 6 is a bottom view of the soil treating machine of FIG. 2.

On the other hand, as clearly seen in FIGS. 6 and 15, the continuous processing trough 20 is provided with a plural number of apertures 20*a* (at three different positions in the case of FIG. 6) in its bottom wall. These apertures 20*a* are normally closed with cover plates 48, which are however removable at the time of cleaning the interior side of the continuous processing trough 20. The cover plates 48 are provided with three longitudinal protuberances 46*a* side by side in the transverse direction of the respective inner surfaces or of the respective surfaces facing toward the interior side of the continuous processing trough 20. These protuberances 46*a* have profiles which lie along and just outside the loci of rotational movements of the paddles 23. These protuberances 46*a* allow the screw conveyer 21 to transfer sand and soil (or a mixture of sand and soil with a soil improving material) more smoothly and in a reliable manner.

Figure 17:
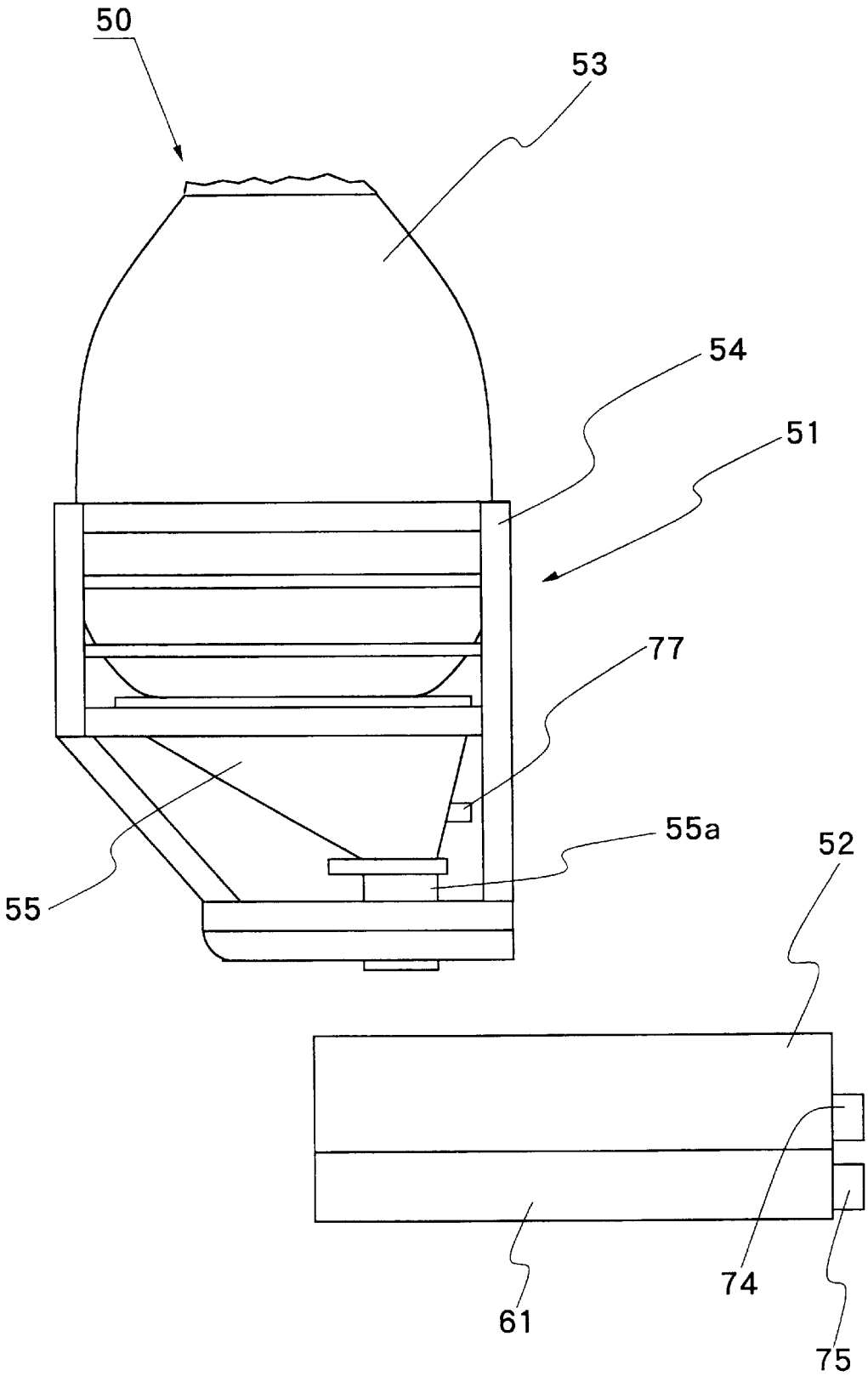
FIG. 17 is a schematic view of an additive feed means.
Figure 18:
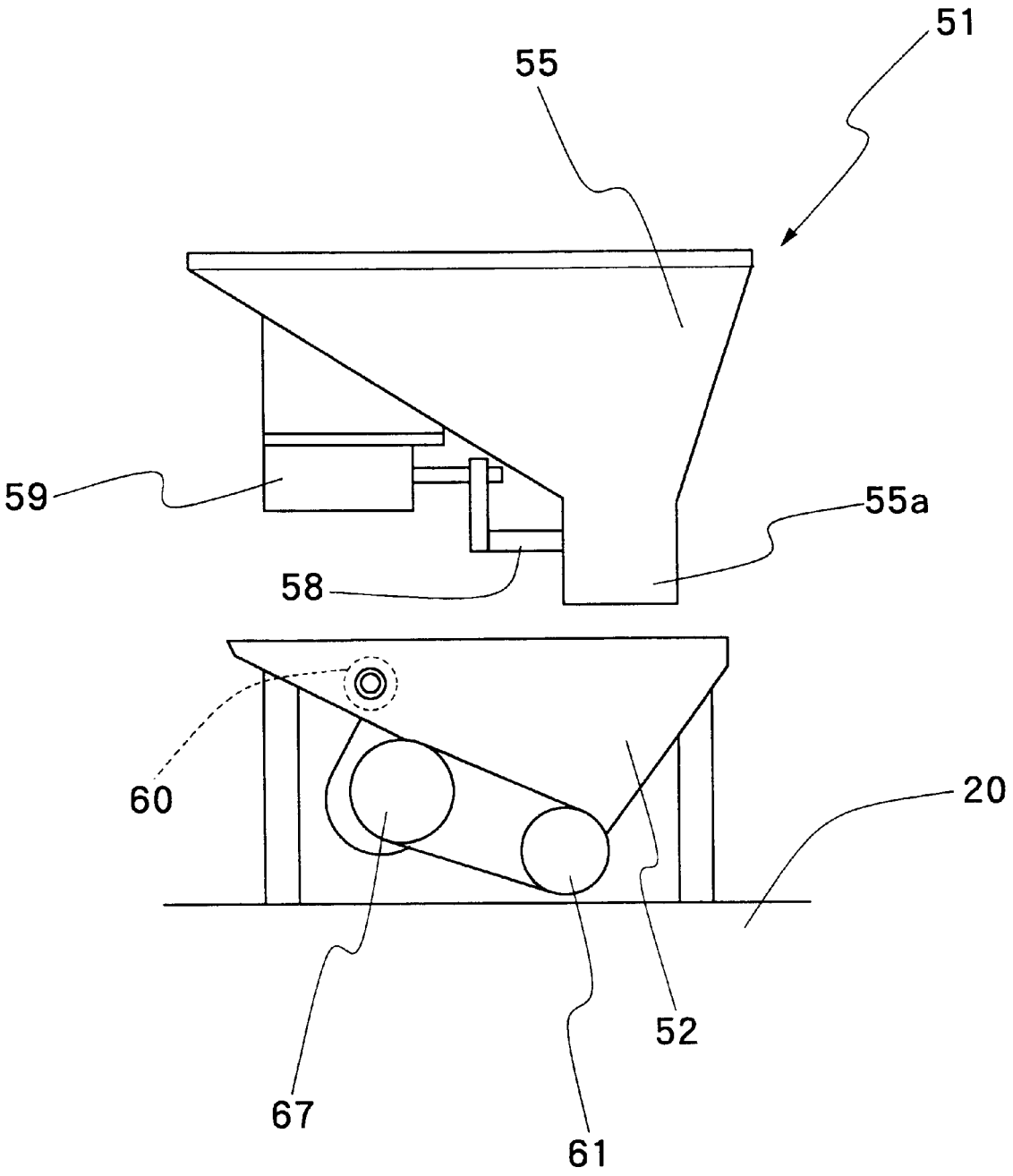
FIG. 18 is a schematic side view of a hopper and a feeder section of the additive feed means.

The soil treating machine further includes an additive feed means for supplying a soil improving material like cement to the continuous processing trough 20. The additive feed means 50 is arranged as shown in FIGS. 17 through 22. More specifically, as seen in FIGS. 17 and 18, the additive feed means 50 is largely constituted by a supply source unit 51 and a hopper 52 which is provided on the part of the base carrier 1. The supply source unit 51 has a flexible container 53 which is packed with a soil improving material to be supplied to the continuous processing trough 20 through an additive feed hopper 52.

Figure 19:
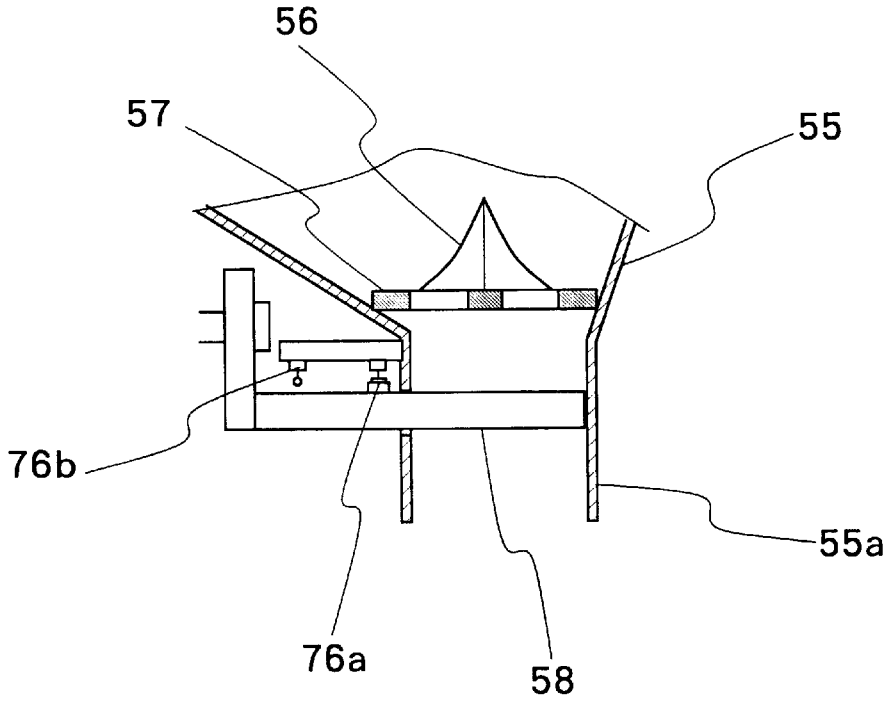
FIG. 19 is a schematic sectional view of the feeder section.
Figure 20:
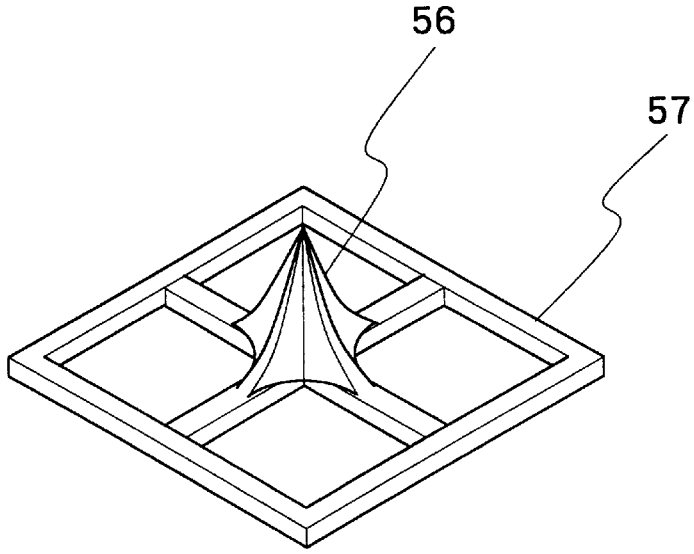
FIG. 20 is a schematic outer view of a cutter for a flexible container.

The supply source unit 51 is comprised of a support frame structure 54 which is erected on frames of the upper rotary body 2, and a feeder section 55 which is supported in a lower portion of the frame structure 54. The flexible container 53 is also supported on the frame structure 54 in such a way that its lower end is received in the feeder section 55. The feeder section 55 is provided with a cutter knife 56 which is projected upward in the shape of a spearhead or the like as shown in FIGS. 19 and 20. This cutter knife 56 is fixedly supported on inner wall surfaces of the feeder section 55 through a support frame member 57. Therefore, when the flexible container 53 is set on the frame structure 54 of the supply source 51, it is deformed into the shape of the support structure as its lower end drops into the feeder section 55 under its own weight. As a result, the lower end of the flexible container 53 is stabbed and cut open by the cutter knife 56, permitting the content of the flexible container 53 to flow into the feeder section 55.

The feeder section 55 is substantially in the shape of an inverted pyramid and its lower end is extended forward in the travel direction of the upper rotary body 2 and toward a center portion of the latter. The lower end of the feeder section 55 forms an outlet 55*a* for a soil improving material, which can be opened and closed by a power-driven shutter 58 as shown particularly in FIGS. 18 and 19. The hopper 52 for the soil improving material is located to face the shutter 58 at the lower outlet end of the feeder section 55 from beneath. The hopper 52 for the soil improving material is located over a front portion of the continuous processing trough 20, and has a width which substantially spans across the entire width of the continuous processing trough 20. Front and rear walls of the hopper 52 are gradually inclined toward each other in the downward direction. In this instance, the outlet end 55*a* of the feeder section 55 has a relatively small open area as compared with the width of the hopper 52, so that an additive feed means 60 in the form of a screw conveyer (see FIG. 8) is provided in the transverse direction of the hopper 52, thereby ensuring uniform distribution of the soil improving material across the entire width of the additive feed hopper 52.

Figure 21:
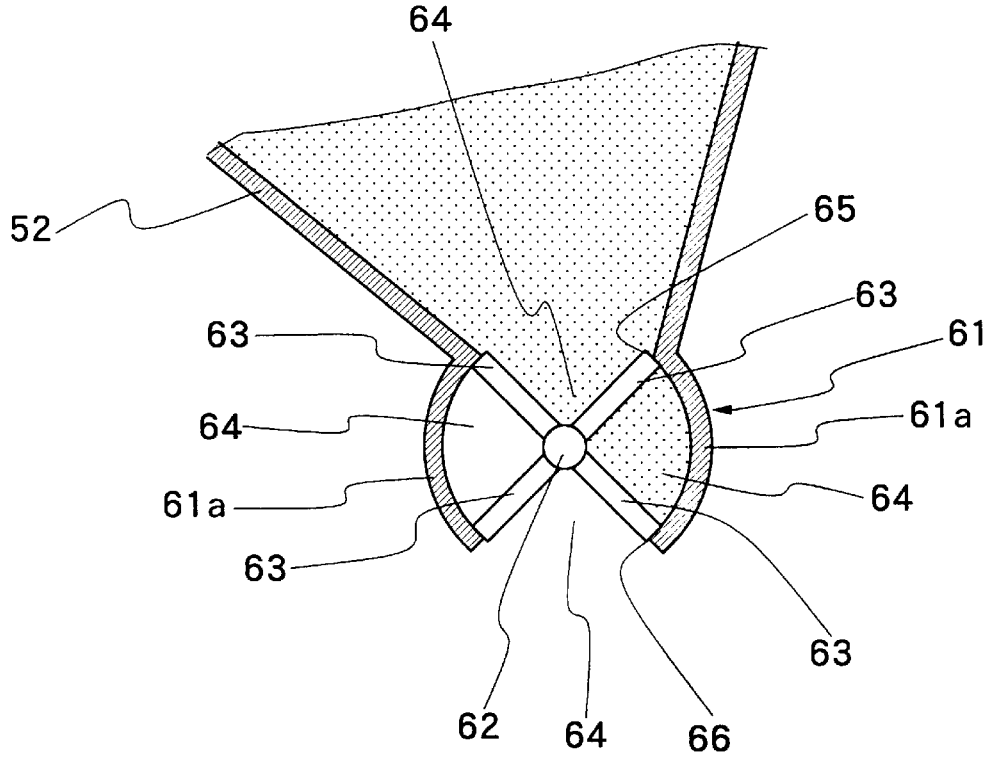
FIG. 21 is a schematic sectional view of a feeder member of the additive feed means.
Figure 22:
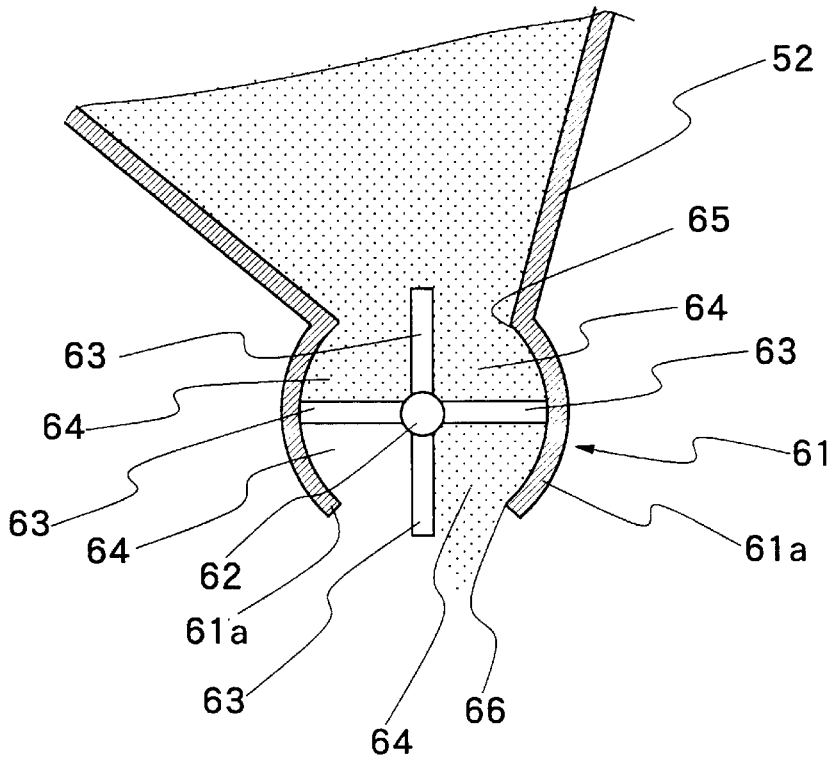
FIG. 22 is a schematic sectional view of the feeder member in a different phase of operation from FIG. 21.

Further, the additive feed hopper 52 is provided with a second feeder 61 at its bottom end. This feeder 61 constitutes a quantitative feed member which is arranged as shown in FIGS. 21 and 22. More specifically, the feeder 61 includes an opening which is provided in a lower end portion of the hopper 52 for quantitative supply of the soil improving material. The opening is defined by arcuate wall portions 61*a* which are formed on the front and rear sides of the hopper 51 in the travel direction of the machine. Passed transversely between the arcuate wall portions 61*a* is a rotational shaft 62 with partition plates 63 at predetermined angular intervals around its circumference (at intervals of 90 degrees in the case of the particular embodiment shown), forming V-shaped quantitative feeder containers 64 between adjacent plates 63. As the rotational shaft 62 is put in rotation, the respective partition plates 63 are turned about the axis of the rotational shaft 62, with the respective outer ends of the partition plates 63 in sliding contact with the arcuate walls 61*a*. Namely, the length of the partition plates 63 substantially corresponds to the radius of curvature of inner surfaces of the arcuate walls 61*a* at the lower end of the hopper 52.

Defined between the confronting upper and lower ends of the arcuate wall portions 61*a* are slot-like openings, i.e., an upper opening which functions as an inlet opening 65 for introducing the soil improving material from the hopper 52 into the quantitative feeder container 64, and a lower opening 66 which functions as an outlet opening for supplying a metered amount of the soil improving material from the quantitative feeder containers 64 to the continuous processing trough 20. Upon driving the rotational shaft 62 into rotation, a predetermined amount of soil improving material is successively supplied to the quantitative feeder containers 64 through the inlet opening 65. The soil improving material in a quantitative feeder container 64 is dropped into the continuous processing trough 20 as the container comes into communication with the outlet opening 66. When the rotational shaft 62 is held standstill, the outlet opening 66 is closed by at least two partition plates 63. In other words, the partition plates 63 which form the above-described quantitative feeder containers 64 also function as a shutter which controls the supply of soil improving material to the continuous processing trough 20. In this instance, upon every ¼ rotation of the rotational shaft 62 which is rotationally driven from the motor 67, a predetermined amount of soil improving material corresponding to the volume of the quantitative feeder containers 64 is supplied to the continuous processing trough 20. The motor 67 may be constituted by a hydraulic motor but from the standpoint of controllability it is preferred to be a variable speed electric motor operating on a battery. The feeder 61 has a length which substantially corresponds to the full width of the continuous processing trough 20, so that soil improving material is supplied uniformly across the width of the continuous processing trough 20.

It is for the purpose of reducing the frequency of replenishment of soil improving material that the additive feed means 50 is divided into the supply source unit 51 which is located on the side of the upper rotary body 2 and the additive feed hopper 52 which is located on the side of the base carrier 1 as described above. Normally, difficulties are encountered in finding a sufficient space on the base carrier 1 for a large supply source of soil improving material, as compared with the upper rotary body 2 which can provide a broader space for a larger supply source of soil improving material. However, in case the continuous processing trough 20 is provided on the part of the base carrier 1 separately from the upper rotary body 2 which is put in rotational movements during operation, there may arise situations in which direct supply of soil improving material to the continuous processing trough 20 is feasible only in an intermittent manner, making it difficult to maintain a specified mixing ratio. Considering such situations and for continuous supply of soil improving material to the continuous processing trough 20, it is more practical to provide the additive feed hopper 52, which is relatively small in quantitative capacity, on the part of the base carrier 1 which can provide only a limited space for this purpose.

The timing of supplying soil improving material from the supply source unit 51 to the additive feed hopper 52 is restricted by the angular position of the upper rotary body 2. Therefore, firstly, when the upper rotary body 2 is turned forward in the travel direction of the base carrier 1, the shape of the outlet passage 55*a* is so selected as to permit supply of soil improving material from the feed section 55 to the hopper 52. As will be described later, this is a position which is taken, for example, when excavating sand and soil and throwing excavated earth into the hopper 30 by means of the front working mechanism 3. On the basis of the shapes of openings of the outlet passage 55*a* of the soil improving material feed section 55 and of the hopper 52, soil improving material can be supplied until the upper rotary body 2 has been rotated to the right or left through a predetermined angle from that position. However, the supply of soil improving material becomes infeasible as soon as the outlet passage 55*a* of the soil improving material feed section 55 comes out of face-to-face relations with the hopper 52 as a result of rotation of the upper rotary body 2 through a certain angle.

Figure 23:
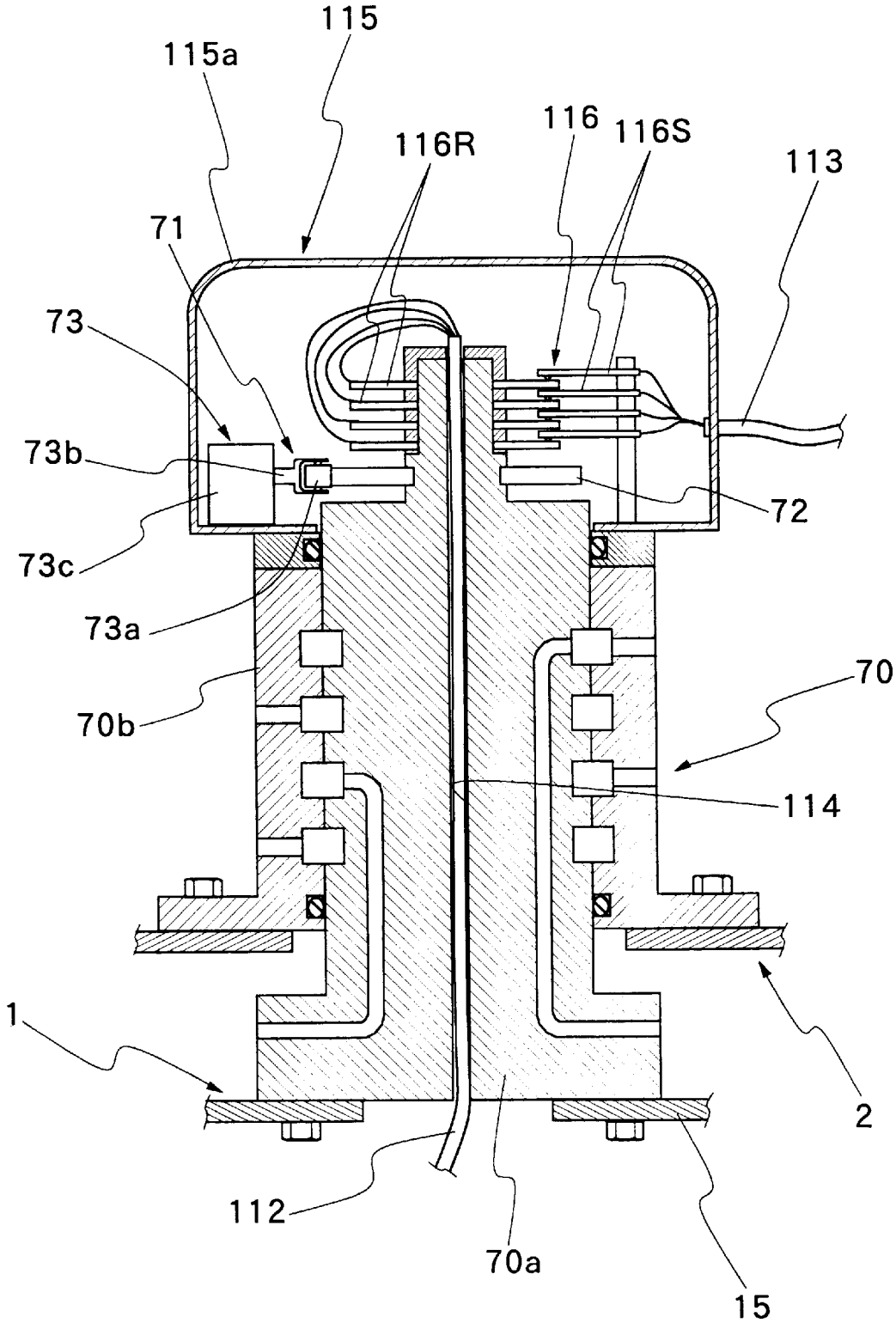
FIG. 23 is a schematic sectional view of a center joint.

Taking the foregoing situations into account, the timing of supply of soil improving material to the hopper 52 has to be controlled according to a detected rotational angle of the upper rotary body 2. Shown in FIG. 23 is an arrangement utilizing for this purpose a center joint 70 of the swivel mechanism 7, which is provided between the upper rotary body 2 and the base carrier 1 to permit circulation of an operating fluid to the vehicular drive motor etc. The center joint 70 includes a stationary member 70*a* which is mounted on the side of the base carrier 1, and a rotary member 70*b* which is mounted on the side of the upper rotary body 2. In this instance, the stationary member 70*a* is substantially in the form of a cylindrical column erected at the center of the swiveling movements, and the rotary member 70*b* is formed in a hollow cylindrical shape for fitting engagement with the stationary member 70*a*.

Figure 24:
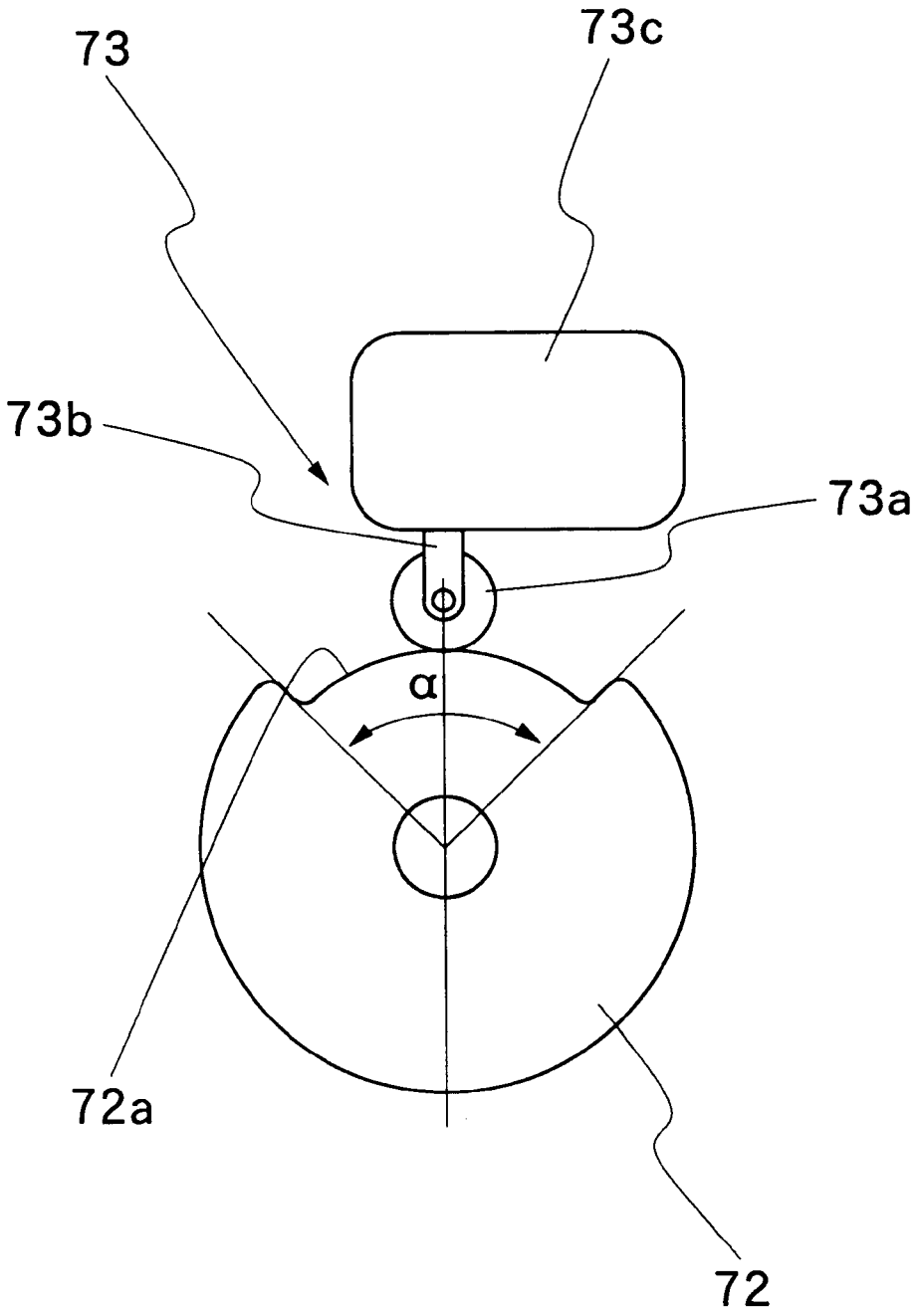
FIG. 24 is a schematic view of a rotational angle detection mechanism, employed for detection of angular position of an upper rotating body.

As shown in FIG. 24, an angle detection means 71 is constituted by a circular angle index plate 72 which is provided on the part of the stationary member 70*a* of the center joint 70, and an angle detector 73 which is provided on the part of the rotary member 70*b*. The angle index plate 72 is provided with an indented arc portion 72*a* of a reduced radius through angle $\alpha$ corresponding to an angular range in which the feed section 55 of the supply source unit 51 is in a position over the hopper 52. It follows that an indented arc portion 72*a* on the detector disk 72 is determined according to the angle $\alpha$. The angle detector 73 is constituted by a roller 73*a* which is held in rolling contact with outer marginal edges of the detector disk 72, an arm 73*a* which rotatably supports the roller 73*a*, and a detecting member 73*c* which detects the movements of the arm 73*b*. When the upper rotary body 2 is turned through a certain angle, the rotary member 70*b* of the center joint 70 is turned about the stationary member 70*a*. As a result, the roller 73*a* of the angle detector 73 is caused to move along outer marginal edges of the angle index plate 72. As soon as the roller 73*a* falls onto the indented arc portion 72*a* of the angle index plate 72, the arm 73*b* is stretched out, and this outward movement of the arm 73*b* is picked up at the detecting member 73*c*. In this instance, the position of abutting engagement of the roller 73*a* with the angle index plate 72, which is shown in FIG. 24, should coincide with the position at which excavated sand and soil is thrown into the hopper 30 by the bucket 18 of the front working mechanism 3 on the upper rotary body 2.

The angle detection means 71 functions to detect relative positional relations between the feed section 55 and the additive feed hopper 52. Overflow of additive soil improving material might take place if it is supplied to the hopper 52 which has already been filled substantially to its full capacity. In order to solve this problem, the hopper 52 is provided with a level sensor 74 thereby to detect the top level of additive soil improving material in the hopper and to hold the shutter 58 in a closed state as long as the hopper is full even if the upper rotary body 2 is in an angular position at which replenishment of additive soil improving material is otherwise permissible. In addition, a lower limit sensor 75 is provided on the hopper 52 which gives off an alarm signal when additive soil improving material in the hopper 52 has reduced conspicuously to such an amount as would become deficient before the upper rotary body 2 returns to a replenishment-feasible angular position. These upper and lower limit sensors 74 and 75 may be located, for example, in the positions as shown in FIG. 17.

Accordingly, the shutter drive cylinder 59 is actuated to open the shutter 58 when the top level of the soil improving material in the hopper 53 is below the position of the level sensor 74 and at the same time the upper rotary body 2 is detected by the angle detection means 71 as being in an angular position within a predetermined range in which replenishment of additive soil improving material is feasible. As soon as the shutter 58 is opened, additive soil improving material is fed to the hopper 52 from the supply source unit 51. The shutter 58 is closed when the upper rotary body 2 is turned into an angular position outside the feedable range or when the top level of the soil improving material in the hopper 52 is at a position which is detectible by the top level sensor 74. These opening and closing motions of the shutter 58 are detected by limit switches 76*a* and 76*b* which are located on the front and rear sides thereof as shown in FIG. 19.

The supply source unit 51 receives a supply of soil improving material from the flexible container 53. As soon as the flexible container 53 becomes empty, a fresh container should be set in position in place of the emptied one. In order to recognize a timing for replacement of the flexible container 53, a lower limit sensor 77 (FIG. 17) is provided on the feed section 55 of the supply source unit 51, thereby giving off a replacement signal before the flexible container 53 becomes empty.

With the arrangements just described, sand and soil is excavated by the bucket 18 of the front working mechanism 3, which constitutes an excavation means in this case, and thrown into the soil hopper 30 of the soil processing unit 4. At the same time, the screw conveyer 32 of the continuous processing trough 20 is actuated to transfer charged excavated sand and soil through the processing trough 20 in a vigorously agitated state. In the meantime, soil improving material is fed to the hopper 52 and uniformly mixed into sand and soil in the processing trough 20 to produce improved soil. The improved soil is then transferred from the continuous processing trough 20 to the soil discharging means 33, and discharged therefrom by the action of the soil discharging screw 35.

In this instance, the soil treatment through the continuous processing unit 4 proceeds concurrently or parallel with the operation of the front working mechanism 3 which successively excavates sand and soil and throws it into the soil hopper 30. Operation of the front working mechanism 3 as well as rotations of the upper rotary body 2 is controlled manually by way of manual control levers which are provided in the operator's cab 5. Soil treating operations however should be automated as much as possible so that one operator can easily control a soil excavating operation concurrently with the progress of a soil treating operation. For this purpose, the machine is provided with a control system as shown in FIG. 25, including a controller of FIG. 26 and a control panel of FIG. 27 which can automatically control soil treating operations.

Figure 25:
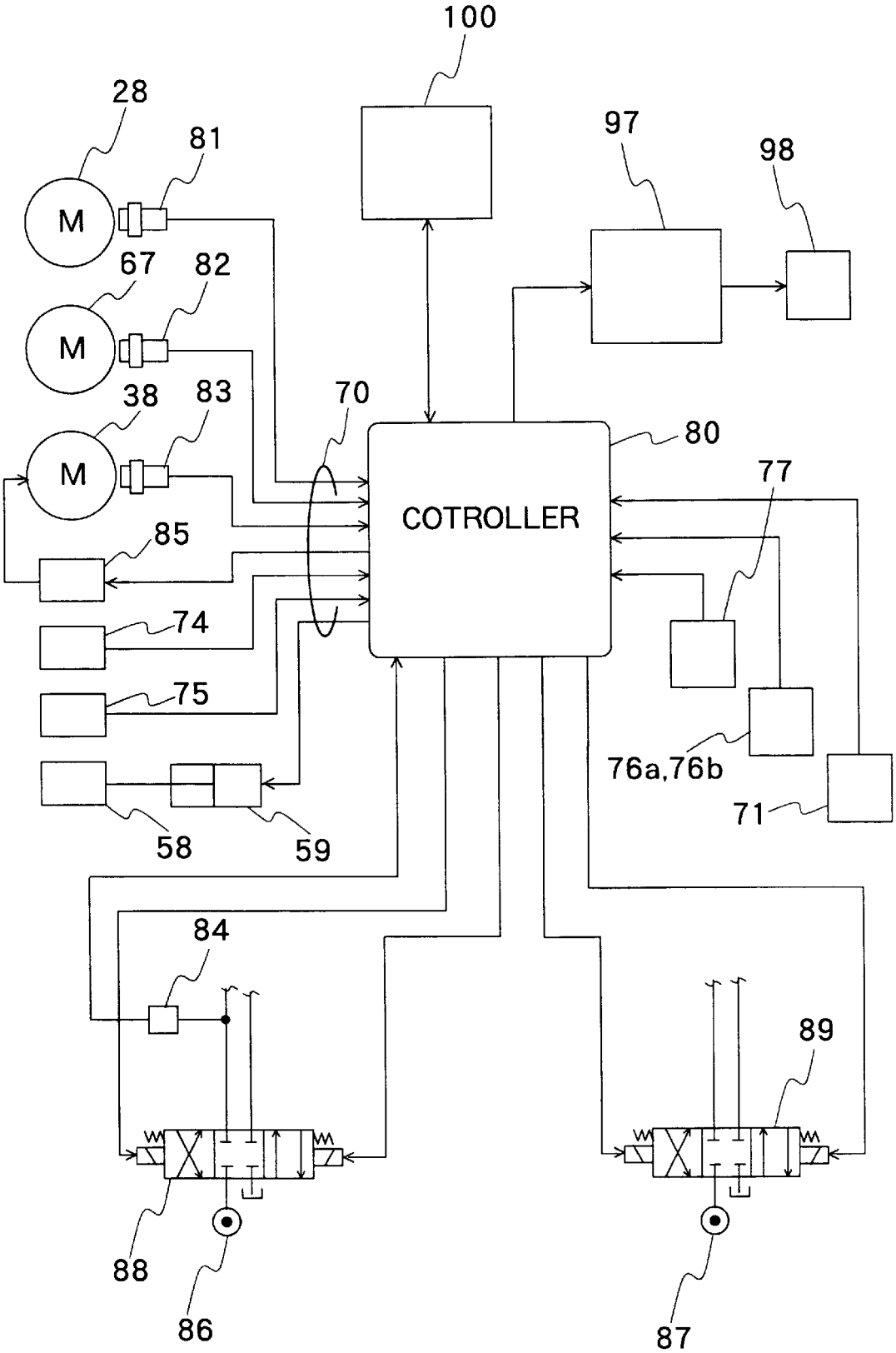
FIG. 25 is a soil treatment control circuit diagram.

Referring to FIG. 25 showing the above-mentioned soil treatment control system, indicated at 80 is a controller which produces control signals to various components on the basis of related input data or signals. Input signals to the controller 80 include signals of rotational speeds of the hydraulic mixing motors 28, additive feed motor 67 and hydraulic soil discharging motor 38. Rotational speeds of these motors 28, 67 and 38 are detected by rotational speed sensors 81, 82 and 83, respectively, and output signals of these rotational speed sensors are supplied to the controller 80. Depending on operating conditions of the continuous processing trough 20, the screw conveyer 21 could fall into an idling or locked state. In order to detect this, pressure on the high pressure side of the hydraulic mixing motor 28 which drives the screw conveyer 21 is detected by a pressure sensor 84, and output signal of the sensor 84 is also supplied to the controller 80 thereby to monitor operating conditions of the hydraulic mixing motor 28.

The controller 80 is also supplied with operating data signals of various components of the additive feed means 50. More particularly, the controller 80 is supplied with signals from the top level sensor 74 and the lower limit sensor 74 of the hopper 52 as well as signals from the lower limit sensor 77 of the supply source unit 51 and the limit switches 76*a* and 76*b* of the shutter 58. Signals of rotational angle from the angle detection means 71, which controls the on-off timing of the supply of the soil improving material, are likewise supplied to the controller 80.

At the controller 80, signals which are received from the above-mentioned various sensors or detectors are processed through predetermined arithmetic-logic operations to produce control signals to be dispatched to the respective components of the soil treatment to control their operations, mainly including operations of the additive motor 67, the shutter drive cylinder 60 which drives the shutter 58 into open and closed positions, the hydraulic mixing motor 28 and the hydraulic discharging motor 38.

Firstly, the feed motor 67 which is constituted by a variable speed electric motor is powered from a vehicle battery, and its operation is controlled by a servo circuit 85 which operates on control signals from the controller 80. The hydraulic mixing motor 28 and the hydraulic discharging motor 38 are driven from hydraulic pumps 86 and 87, respectively. If desired, arrangements may be made to drive these hydraulic motors 28 and 38 from a common hydraulic pump. Provided between the hydraulic motors 28 and 38 and the hydraulic pumps 85 and 86 are control valves 88 and 89 which are switched by signals from the controller 80. Although not shown in the drawings, the operation of the shutter drive cylinder 59 is also controlled by the use of a similar control valve.

Figure 26:
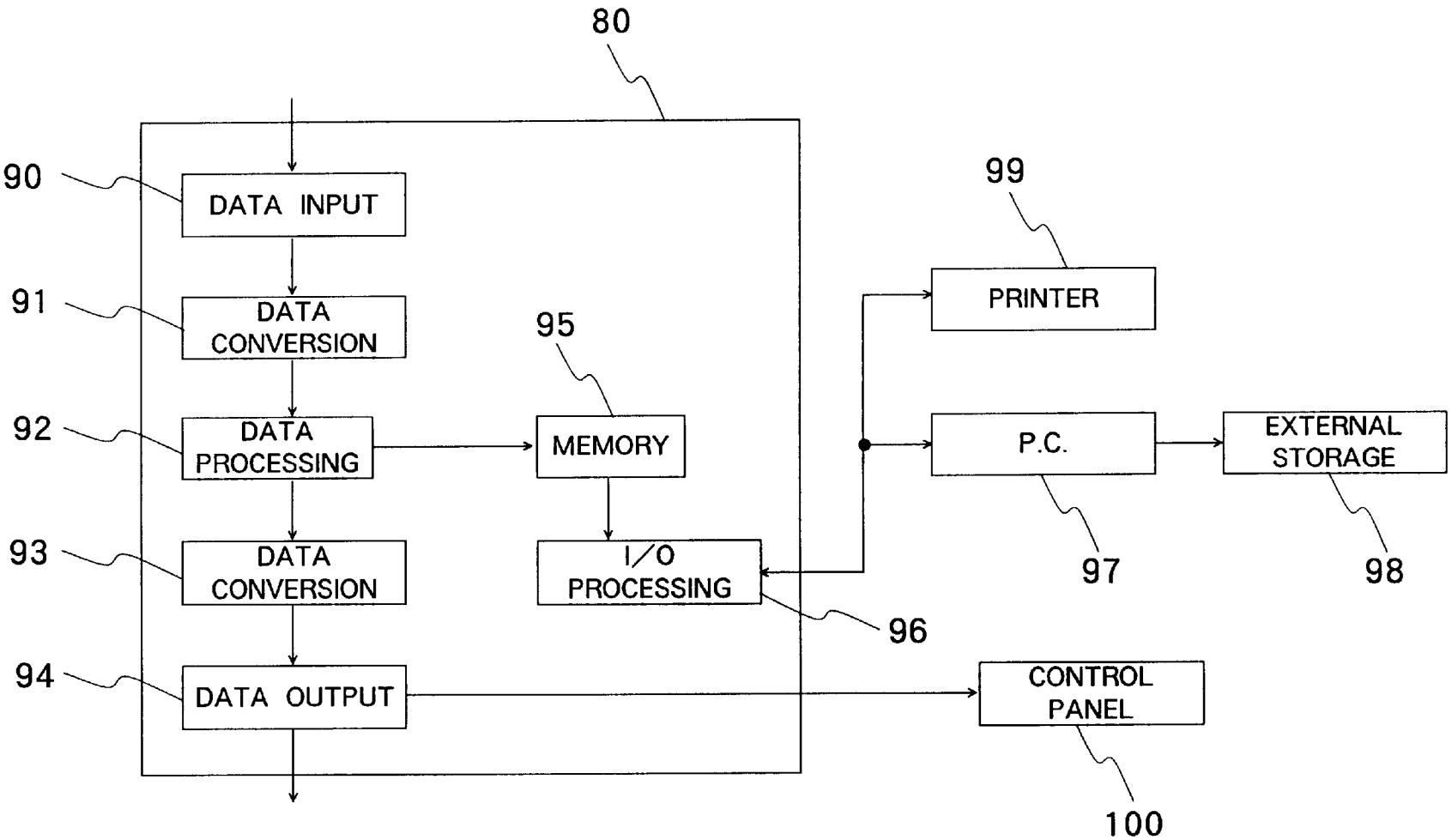
FIG. 26 is a block diagram of a controller.

Accordingly, the controller 80 can be arranged as shown in FIG. 26. More particularly, the controller can be constituted by a data input section 90 which performs necessary input signal processing operations for input signals from various sensors or detectors, a data converting section 91 which performs signal amplification and A/D conversion along with other signal processing operations, and a data processing section 92 which performs predetermined arithmetic-logical operations on the basis of input data. Further, according to the results of data processing at the data processing section 92, the controller produces control signals for various hydraulic actuators, control valves or other controlled means. The control signals are applied to the respective controlled means from a data output section 94 after D/A conversion or other necessary data conversion at the data converting section 93.

Various running data of a soil treating operation are stored in an internal memory or storage 95. Stored data in the memory 95 can be downloaded, for example, to a personal computer 97 through an I/O processor 96, and necessary data can be processed into a suitable structure according to a predetermined algorithm for storage in an external storage device 98 which is connected to the personal computer 97. If desired, necessary data can be hard-printed by the use of a printer 99. It is for storage and management purposes that soil treatment data of each operation are downloaded onto a personal computer 97 in this manner.

Figure 27:
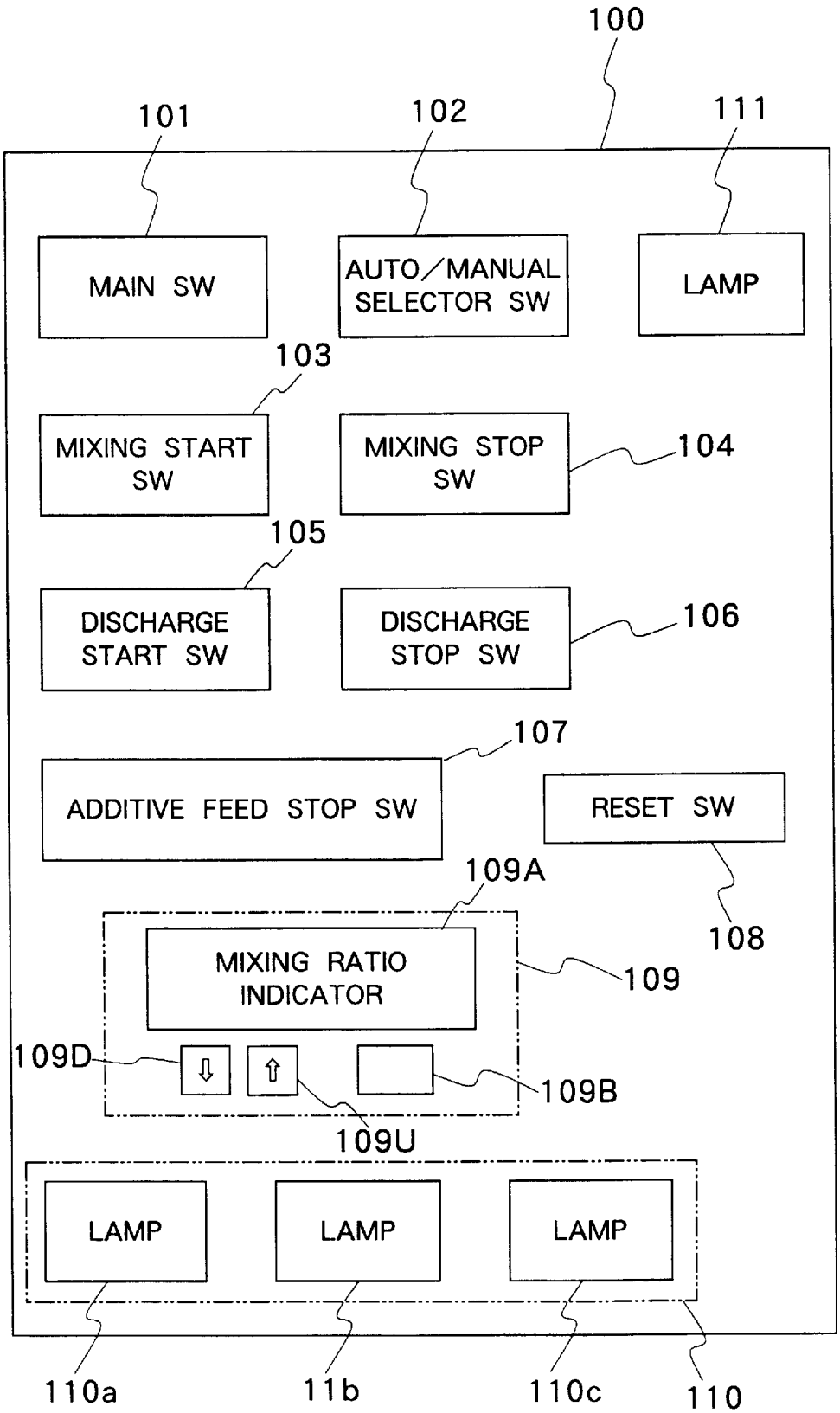
FIG. 27 is a block diagram of a control panel.

Further, by way of a control panel 100 which is provided within the operator's cab 6, operations of various components of the soil processing unit can be controlled and supervised. By way of example, one specific form of the control panel 100 is shown in FIG. 27.

In that figure, indicated at 101 is a main switch, which, when turned ON, connects the respective components of the soil processing unit operatively to a power supply. Denoted at 101 is an auto-manual selector switch by way of which either an automatic mode or a manual mode can be selected in controlling operations of the respective components of the soil treatment. Indicated at 103 is a "Mixing Start" switch which can be actuated in both manual and automatic modes, for starting a soil mixing operation when in the manual mode and for starting a soil treating operation when in the automatic mode. Designated at 104 is a "Mixing Stop" switch which is actuatable in both manual and automatic modes similarly to "Mixing Start" switch 103, for stopping a soil mixing operation when in the manual mode and for suspending a soil treating operation when in the automatic mode. Indicated at 105 and 106 are a "Discharge Start" switch and a "Discharge Stop" switch which function to start and stop the hydraulic soil discharging motor 38, respectively. In this instance, no "Start" switch is provided for the additive feed motor 67 which follows the movements of the hydraulic mixing motor 28. However, in order to make it possible to stop the additive feed motor manually, a manual "Stop" switch 107 is provided on the control panel. Further, indicated at 108 is a "Reset" switch which is actuatable to reset the controller 80 after a temporary suspension or an emergency stop of a soil treating operation.

Further provided on the control panel 100 is a mixing ratio setter 109 including an indicator 109A which indicates a mixing ratio of an additive soil improving material to sand and soil by way of numerals or other symbols, up- and down-buttons 109U and 109D, and a set-reset button 109B. The mixing ratio can be reset by depressing the set-reset button 109B, and the mixing ratio of the additive soil improving material can be increased or reduced by depressing the up-button 109U or down-button 109D. A desired mixing ratio of the additive material to excavated sand and soil for a current soil treating operation can be set by depressing the set-reset button 109 again as soon as the numerical value on the indicator reaches that ratio.

For the purpose of monitoring conditions of the additive material, an indicator lamp panel section 110 is provided on the control panel 100. The indicator lamp section 110 includes three indicator lamps 110*a* to 110*c*, of which the indicator lamp 110*a* is lit on while the top level of soil improving material in the hopper 52 is above the position of the top level sensor 74, that is to say, as long as an appropriate amount of soil improving material is pooled in the hopper 52. The indicator lamp 110*b* is lit on when the top level of soil improving material drops below the position of the lower limit sensor 75, that is to say, as soon as soil improving material in the hopper 52 becomes deficient. Further, the indicator lamp 110*c* is lit on when soil improving material in the feed section 55 on the side of the supply source unit 51 drops below the position of the lower limit sensor 77. By way of these indicator lamps on the control panel 100, the machine operator can check the feed conditions of soil improving material. In this instance, the mixing operation has to be stopped when the amount of soil improving material drops below the position of the lower limit sensor 75. On the other hand, the flexible container 53 needs to be replaced when soil improving material in the feed section of the supply source unit 51 drops below the position of the lower limit sensor 77. Therefore, it is desirable to give off an alarm sound when the indicator lamp 110*b* or 110*c* is lit on. The control panel 100 is further provided with an indicator lamp 111 which indicates completion of a setup procedure. Accordingly, when the indicator lamp 111 is lit on, it means that the soil processing unit 4 has been set up and ready for an operation.

Of the various components which are connected to the controller 80, the rotational speed sensors 81 to 83 of the motors 28, 67 and 38 are provided on the side of the base carrier 1, along with the top level and lower limit sensors 74 and 75 of the additive feed hopper 52. On the other hand, the controller 80 itself is provided on the side of the upper rotary body 2, more specifically, within or in the vicinity of the operator's cab 5. Therefore, as shown in FIG. 23, signal wires from the rotational speed sensors 81 to 83 and the sensors 74 and 75 are bundled together to form a cable 112 of the rotating side, which is connected through the center joint 70 to a cable 113 from the controller 80 on the fixed side. For this purpose, a cable passage 114 is bored through the rotary member 70*b* of the center joint 70, and a connector 115 is provided at the upper end of the center joint 70 to connect the cable 112 with the cable 113. In this instance, the connector 115 is in the form of a rotary connector assembly having, within a casing 115*a* provided on the stationary member 70*a*, a suitable number of pairs of rotating and stationary electrodes 116R and 116S in vertical rows. The rotating and stationary electrodes 116R and 116S are connected with the cables 112 and 113 from the rotating and stationary sides, respectively. The angle plate 72 of the angle detection means 71 which detects the rotational angle of the upper rotary body 2 is connected to the rotary member 70*b* within the casing 115*a* of the connector 115, along with the electrodes 116R on the rotating side. A signal cable from the detection member 73*c* of the detector 73 is passed through the cable 113 on the fixed side.

With the arrangements just described, while controlling and supervising a soil treating operation by way of the control panel 100, the operation the operator's cab 6 can control the vehicular drive as well as the rotation of the upper rotary body 2 and movements of the front working mechanism 3 at the job of soil excavation, by operating corresponding control levers and pedals.

More particularly, firstly the soil processing unit 4 is put in an operative state by turning the main switch 101 ON. This however would not start the operation of the soil processing unit 4 until a setup procedure is completed. In the first place, a desired mixing ratio of an additive soil improving material to sand and soil is entered by way of the setting buttons of the mixing ratio setter 109. An ideal mixing ratio to be used for a particular soil treating operation is determined beforehand by experiments on the basis of properties of foundational soil of a working site and a degree to which the foundation of the ground needs to be improved in hardness. Accordingly, a predetermined mixing ratio is set up through the up- and down-buttons 109U and 109D and the set-reset button 109B. The data of the entered mixing ratio is sent to the controller 80, which determines a rotational speed ratio of the hydraulic mixing motor 28 to the additive feed motor 67 according to the received data.

Further, the controller 80 checks if an appropriate amount of additive soil improving material is stored in the hopper 52 on the basis of signals from the top level sensor 74 and the lower limit sensor 75, and if a necessary amount of additive material exists on the side of the supply source unit 51 including the flexible container 53 according to a signal from the lower limit sensor 77. Unless these conditions are met, the supply of the additive soil improving material is regarded as infeasible because of incomplete setup, and the setup complete lamp 111 remains OFF. Therefore, even if the "Mixing Switch" 103 is turned ON, the soil processing unit 4 would not start. In case the top level of additive soil improving material is lower than the positions of the lower limit sensor 75 or 77, the indicator lamp 110*b* or 110*c* is lit ON, so that the operator can recognize this on the control panel 100.

Therefore, in case the amount of additive soil improving material within the hopper 52 is found to be deficient, it is supplemented to the hopper 52 from the supply source unit 51. The supply of soil improving material is suspended depending upon the angular position of the upper rotary body 51. In order to resume the supply, the upper rotary body 2 is turned forward in the travel direction of the base carrier 1 to take a position in which excavated sand and soil can be thrown into the hopper 30 by the front working mechanism 3. Upon turning the upper rotary body 2 to that position, its rotary movement is detected by the angle detection means 71 and the supply of additive soil improving material is resumed by actuating the shutter drive cylinder 59 to open the shutter 58. The supply of soil improving material is continued, and, as soon as it surpasses the position of the top level sensor 74, the shutter 58 is automatically closed to stop its supply. The opening and closing movements of the shutter 58 are detected by the limit switches 76*a* and 76*b*. In this state, the indicator lamp 110*a* is lit ON to let the operator acknowledge that a sufficient amount of additive soil improving material is now in the hopper 52. The operation of the soil processing unit 4 can be started when soil improving material is stored in the hopper 52 at least to a level above the lower limit sensor 75. In the initial setup stage, however, it is desirable to stock additive soil improving material to a level higher than the top level sensor 74.

On the other hand, in case the amount of additive soil improving material on the side of the supply source unit 51 drops below the position of the lower limit sensor 77 which is provided on the feed section 55, this means that the flexible container 53 is already in an empty state and needs to be replaced. In replacing the flexible container 53, for example, a crane may be used for mounting a heavy fresh flexible container which is fully packed with soil improving material. Alternatively, the front working mechanism 3 of the soil treating machine may be used for replacement of the flexible container 53. Upon setting a fresh flexible container 53 in position on the supply source unit 51, its lower end is cut open by the cutter 56, allowing soil improving material to flow down into the additive feeder section 55. Whereupon, the indicator lamp 151 is turned OFF.

As soon as a setup procedure is completed to put the soil processing unit in an operative state as described above, the "Setup Complete" indicator lamp turns ON, from which the operator can recognize that a setup procedure has been completed and the soil processing unit 4 is ready for a soil treating operation. In case automatic operation mode is selected by way of the "Auto-Manual" switch 102, a soil treating operation is started upon turning the "Mixing Start" switch 103 ON. In this operating condition of the soil processing unit 4, the hydraulic mixing motor 28 is actuated to drive the screw conveyer 21 and thereby sand and soil is mixed within the continuous processing trough 20 and transferred toward the discharging end of the latter. At the same time, the additive feed motor 67 is actuated to drive the rotational shaft 62, and thereby soil improving material is fed to the continuous processing trough 20 from the additive feeder 61. In the meantime, the hydraulic soil discharging motor 38 is actuated to drive the soil discharging conveyer 36 to start discharging of improved soil.

If all of these operations are commenced simultaneously at the start of the soil processing unit 4, there may arise a problematic situation in which soil improving material is fed to the continuous processing trough before sand and soil reaches a predetermined mixing position. In order to avoid such a situation, it is desirable to actuate the hydraulic mixing motor 28 and additive feed motor 67 in suitable timings which are preset in the controller 80. Besides, it is preferable that the discharging passage 35 of the soil discharging means 33 be emptied beforehand.

Accordingly, when automatic operation mode is selected by way of the "Auto-Manual" switch 102, the hydraulic discharging motor 38 is started in the first place, and the hydraulic mixing motor 28 is actuated with a predetermined time lag, then followed by actuation of the additive feed motor 67. It takes a certain time length for the hydraulic mixing motor 28 to reach a rated operating speed and for the excavated sand and soil in the continuous processing trough 20 to advance to a position which meets the hopper 52. This time lag is also preset in the controller 80. On the other hand, the operational timing is preset to actuate the discharging screw 35 to clear residual material in the discharging means 33, if any, before arrival in the discharging passage 35 of improved soil which is freshly produced by operation of the hydraulic mixing motor 28.

Thereafter, the operation of the processing unit 4 is started according to an operational routine which is set up in the controller 80. In case the manual operation mode is selected, the "Discharge Start" switch 105 is turned ON in the first place, and then the "Mixing Start" switch 103 is turned ON to start the operation of the processing unit 4 is started.

Actually, a soil treating operation cannot be carried out unless sand and soil has already been thrown into the hopper 31 and transferred into the continuous processing trough 20. Since the pressure on the high pressure side of the hydraulic mixing motor 28 is monitored by the pressure sensor 84, existence of sand and soil within the hopper 30 can be detected from output signal of the pressure sensor 84. Therefore, on the basis of a signal from the pressure sensor 84 monitoring load conditions of the hydraulic mixing motor 28, the controller 80 allows to continue the soil treating operation when the hydraulic mixing motor 28 is under predetermined load for a soil mixing and transferring operation. While the pressure signal from the sensor 84 is below a predetermined level, the controller 80 judges that the hopper 30 is empty and holds at least the additive feed motor 67 in a stand-by state.

Upon lapse of a predetermined time period (e.g., of some seconds) after actuation of the hydraulic mixing motor 28, which is put in a loaded condition as a result of accumulation of sand and soil which has been excavated and thrown into the hopper 30 by the bucket 18, the additive feed motor 67 is started to supply additive soil improving material from the feeder 61 for an improving treatment. By operation of the screw conveyers 21, sand and soil in the continuous processing trough 20 is transferred toward the discharging end of the latter and mixed uniformly with soil improving material which is supplied from the feeder 61. Treated soil is continuously discharged and accumulated in a specified field zone outside the machine. On the other hand, the additive soil improving material is successively fed to the continuous soil processing trough 20 each time one of the quantitative feeder containers 64 of the feeder 61 comes into a lower position confronting the inlet opening 65. The feed rate of the additive soil improving material is controlled by way of the operation of the feeder 61. Accordingly, during a soil treating operation, it suffices for the operator to throw excavated sand and soil successively into the hopper 30 by operating the front working mechanism 3 before the hopper 30 becomes empty.

In a soil improving operation as described above, the quality of treated soil which is obtained by mixing excavated soil with additive soil improving material depends on mixed conditions and mixing ratio of soil and additive soil improving material. In order to produce soil of high quality, excavated sand and soil has to be mixed with additive soil improving material uniformly and constantly in a predetermined mixing ratio because a foundation filled with a non-uniform mixture of soil and additive soil improving material will suffer from non-uniform sinking under the weight of a building or other structures as mentioned hereinbefore. In addition, soil has to be mixed with additive soil improving material quickly and efficiently within limited spaces of the continuous processing trough 20.

The continuous processing trough 20 is provided with four screw conveyers 21 which are arranged to rotate in the opposite directions relative to adjacently located screw or screws, so that they can completely disintegrate masses of soil and uniformly mix same with soil improving material. More particularly, the two centrally located screw conveyers act to induce soil flows in downward directions while the outer screw conveyers act to induce soil flows inversely in upward directions, producing extremely smooth tumbling and mixing effects on soil within the entire continuous processing trough 20.

Regarding the mixing ratio of additive soil improving material to excavated sand and soil, it is normally difficult to precisely control the feed rate of sand and soil which is excavated and thrown into the hoper 30 by an excavation means like the bucket 18. However, the screw conveyers 21 which are provided within the continuous processing trough 20 functions not only to disintegrate masses of soil and mix same with soil improving material but also to transfer contents of the continuous processing trough from the charging to discharging end thereof. Therefore, the soil transfer or feed rate by the screw conveyers 21 can be determined by multiplication of a displacement volume per rotation, which is determined by the number and acting surface areas of the paddles 23 on the rotational shafts 22, by the number of rotations of the screw conveyers 21.

On the other hand, additive soil improving material is fed through the feeder 61 which is provided on the additive hopper 52. This feeder 61 is provided with quantitative feeder containers 63 to feed a constant amount of additive soil improving material per rotation. The quantitative feeder containers 63 are rotationally driven from the additive feed motor 67 which is constituted by a variable speed electric motor as mentioned hereinbefore. It follows that the feed rate of additive soil improving material to the continuous processing trough 20 can be controlled by varying the rotational speed of the motor 67, that is, the rotational speed of the drive shaft 62. Although the screw conveyers 21 undergo changes in rotational speed due to large fluctuations in load acting thereon, the rotational speed of the additive feed motor 67 which is constituted by an electric motor 67 can be controlled finely because almost no fluctuations in load occur in feeding a relatively small amount of additive soil improving material from the hopper 52 to the continuous processing trough 20. Therefore, in order to control the mixing ratio accurately, the additive feed motor 67 is controlled in such a manner as to follow the rotational speed of the hydraulic mixing motor 28 which drives the screw conveyers 21.

A constant mixing ratio can be maintained for the soil and additive soil improving material in the continuous processing trough 20 by setting the additive feed motor 67 and hydraulic mixing motor 28 at predetermined values. However, in an actual soil treating operation, it is necessary to take into consideration that the rotational speed of the hydraulic mixing motor 28 varies depending upon the loads acting on the screw conveyers 21. Therefore, the additive feed motor 67 has to be controlled in such a way as to follow variations in rotational speed of the hydraulic mixing motor 28. For this purpose, the controller 80 adapted to adjust the rotational speed of the additive feed motor 67 by calculating an appropriate rotational speed at its data processing section 92 according to output signals of the rotational speed sensor 81 which is provided in association with the hydraulic mixing motor 28.

The rotational speed of the additive feed motor 67, which is constituted by a variable speed electric motor as mentioned hereinbefore, is varied according to a signal from the servo circuit 85. On the basis of a signal which is received from the rotational speed sensor 81, which is indicative of the rotational speed of the hydraulic mixing motor 28, the controller 80 produces a motor control signal to the servo circuit 85 thereby to adjust the rotational speed of the additive feed motor 67 according to variations in rotational speed of the mixing motor 28. Consequently, despite variations in rotational speed of the hydraulic mixing motor 28 as would result from variations in load conditions of the screw conveyers 21, soil and additive soil improving material are mixed constantly in a predetermined mixing ratio.

In this instance, in order to control the mixing ratio more accurately, it is desirable to suppress variations in rotational speed of the hydraulic mixing motor 28 as much as possible. The vehicular soil treating machine with an excavation means has the crawler 14 on the base carrier as a vehicular drive in addition to the rotating mechanism 8, which are both driven from a hydraulic motor. Besides, for excavation of soil, the front working mechanism 3 is provided with the boom 16, arm 17 and bucket 18 which are respectively driven by hydraulic cylinders 16*a* to 18*a*. All of these hydraulic motors and hydraulic actuators or cylinders are driven from a hydraulic pump similarly to the hydraulic mixing motor 28.

The hydraulic mixing motor 28, which serves as a common drive means for the respective screw conveyers in the continuous processing unit 20, is subjected to large loads during the tumbling and mixing operation. Because of large loads which are imposed by the front working mechanism 3 in an excavating operation, the machine is equipped with a hydraulic pump of a large capacity and that hydraulic pump is used to drive the hydraulic mixing motor 28 as well. The hydraulic mixing motor 28 should be operated in as stable a state as possible, free of fluctuations in rotational speed. For this purpose, it is necessary to supply operating oil from the hydraulic pump at a constant flow rate.

Figure 28:
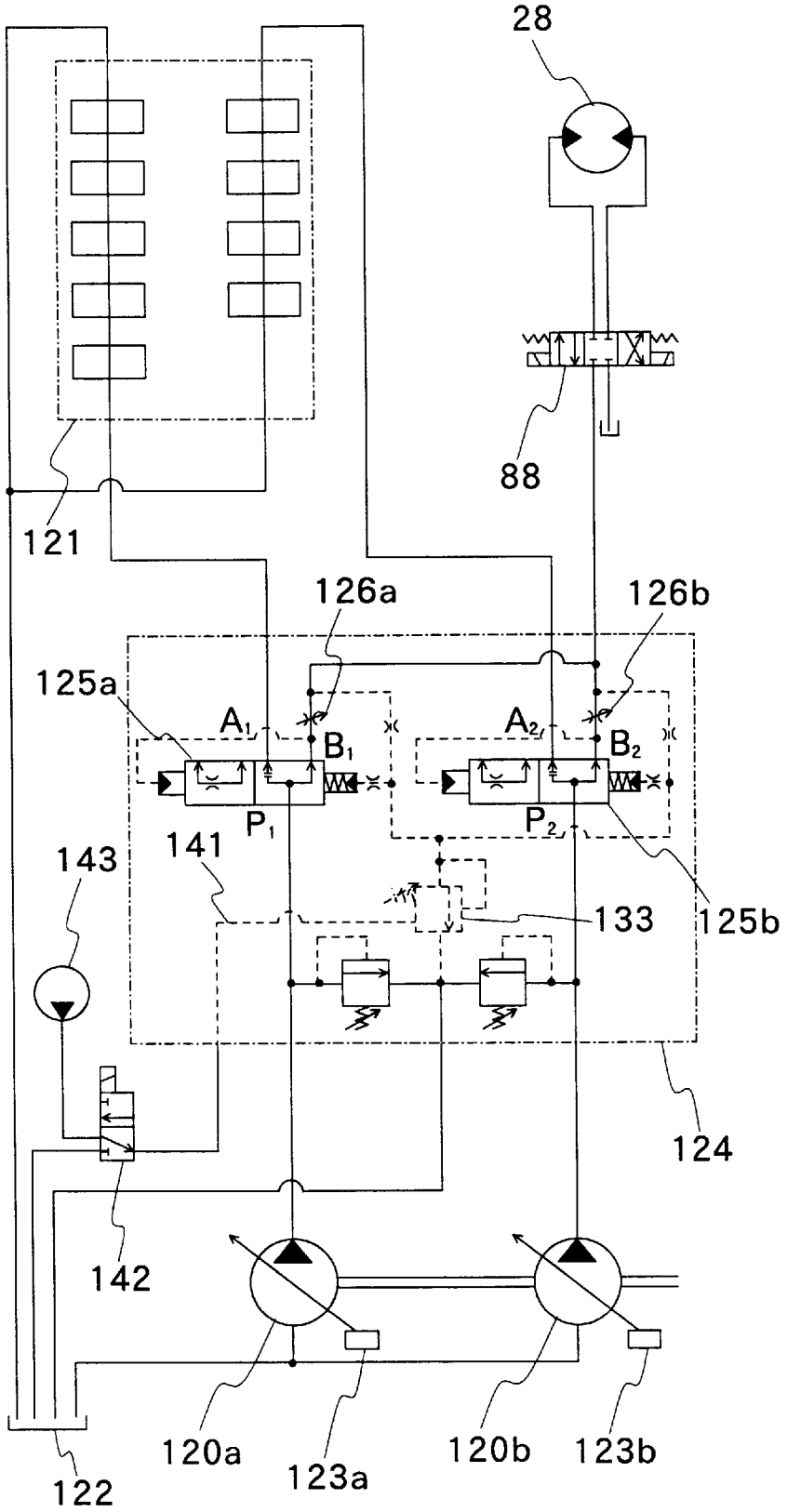
FIG. 28 is a hydraulic circuit diagram of a hydraulic drive mechanism for the soil treating machine.
Figure 29:
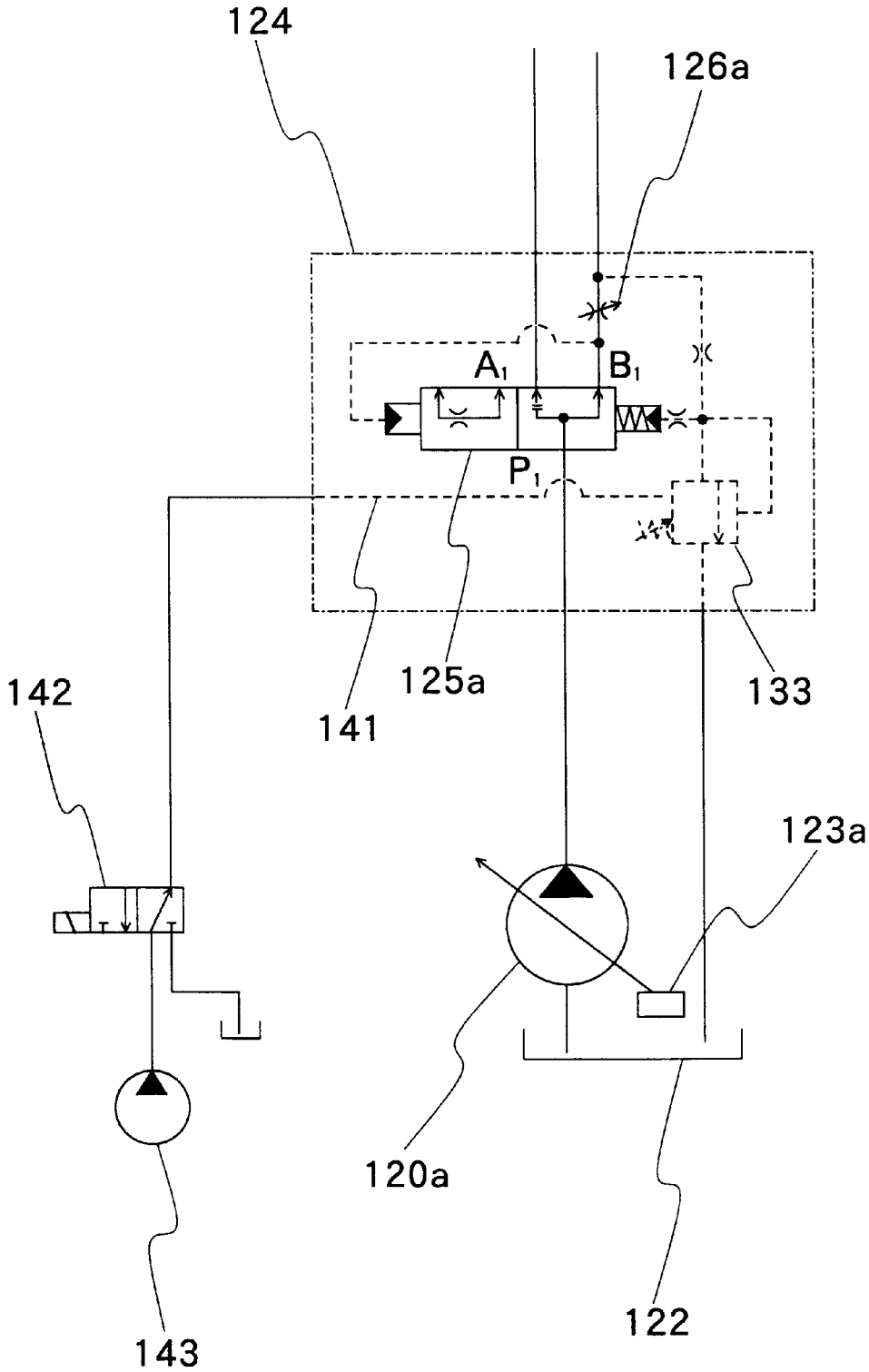
FIG. 29 is a circuit diagram of a flow rate preferential means.
Figure 30:
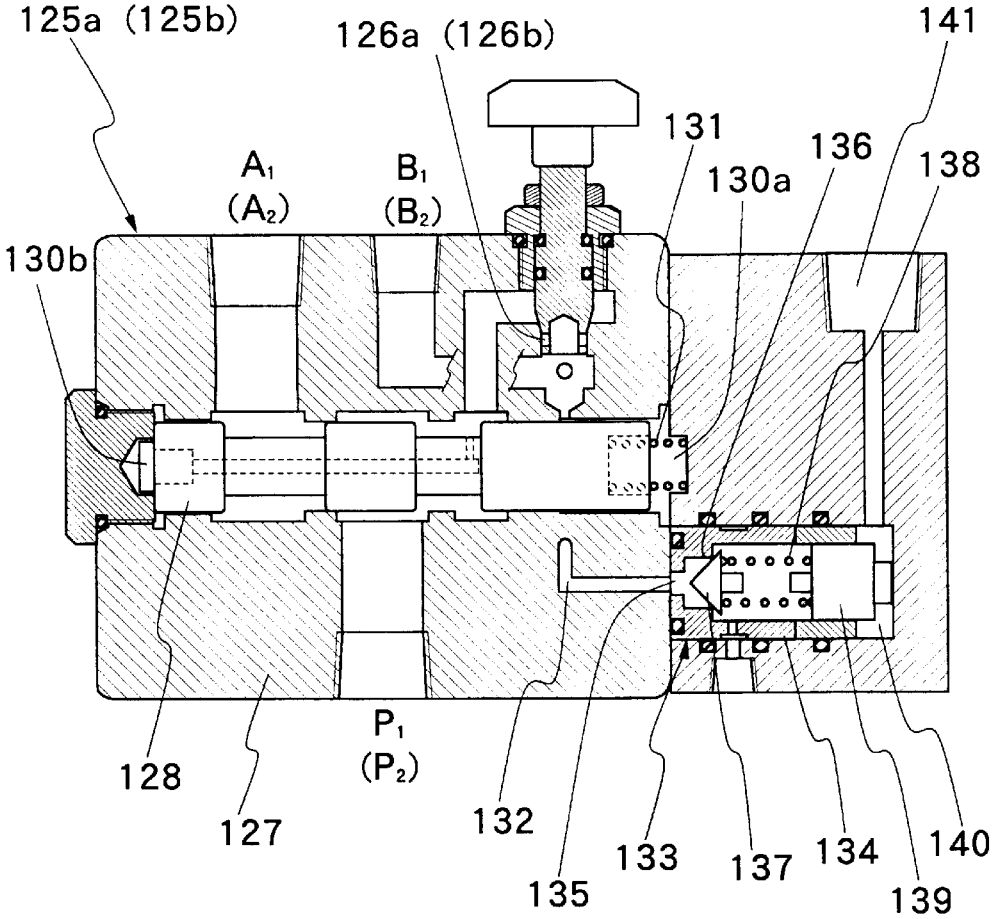
FIG. 30 is a schematic sectional view of a distribution control valve constituting the flow rate preferential means.

To this end, the machine is provided with hydraulic circuits which are arranged as shown in FIGS. 28 to 30. In these figures, indicated at 120*a* and 120*b* are main pumps, at 121 is a directional change-over valve, and 122 is an operating oil tank. The main pumps 120*a* and 120*b* are driven from an engine, which is not shown, to take in operating oil from the oil tank 122 and discharge pressurized operating oil. The pressurized oil passages from the two main pumps 120*a* and 120*b* are joined together on the way. The main pumps 120*a* and 120*b* are constituted by variable capacity hydraulic pumps, and the discharge flow rate of the main pumps is controlled by operating regulator valves 123*a* and 123*b* according to discharge pressures of the respective main pumps 120*a* and 120*b*.

Indicated at 121 is a control valve unit which is constituted by a plural number of directional change-over valves which are each connected to a hydraulic actuator. Accordingly, the oil pressure supplied from the two main pumps 120*a* and 120*b* is used to drive hydraulic actuators of various operating components of the working vehicle by switching the positions of the respective change-over valves. Manual operating means like control levers are provided within the driver's cab 6 for the purpose of switching the respective directional change-over valves which constitute the control valve unit 121. Thus, the operator can control the supply of pressurized operating oil to the respective hydraulic actuators by operating such control levers. In this instance, the hydraulic actuators to be controlled by the control valve unit 121 include a hydraulic vehicle drive motors for driving the crawler sprockets of the base carrier 1, hydraulic rotating motor for turning the upper rotary body 2, and hydraulic cylinders 16*a*, 17*a* and 18*a* which drive the boom 16, arm 17 and bucket 18 of the front working mechanism in a ground excavating operation or for other job.

In addition to the hydraulic actuators or cylinders mentioned above, large loads are also applied on the hydraulic mixing motor 28 through the screw conveyers 21 which are put in rotation within the continuous processing unit 20 of the soil processing unit 4 for tumbling and mixing sand and soil with additive soil improving material. Therefore, the hydraulic mixing motor 28 should be driven from the main pumps 120*a* and 120*b* along with the aforementioned various hydraulic actuators. The hydraulic mixing motor 28 is therefore connected to the main pumps 120*a* and 120*b* through a flow rate preferential means 124 and an electromagnetic mixing control valve 88, thereby to allocate a flow rate preferentially to other hydraulic actuators. More particularly, the flow rate preferential means 124 is provided with distribution control valves 125*a* and 125*b* having input ports $P_1$ and $P_2$ connected to discharge sides of the main pumps 120*a* and 120*b*, respectively. The distribution control valves 125*a* and 125*b* are provided with first output ports $A_1$ and $A_2$ along with second output ports $B_1$ and $B_2$, respectively. The first output ports $A_1$ and $A_2$ of the two distribution control valves 125*a* and 125*b* are each connected to the control valve unit 121, while the second output ports B1 and $B_2$ are joined together on the way and connected to the mixing control valve 88. Connected to the second output ports $B_1$ and $B_2$ are variable throttles 126*a* and 126*b*, respectively, which functions to supply pressurized operating oil to the hydraulic mixing motor 28 at a constant flow rate. Accordingly, after supplying a predetermined amount of pressurized oil to the hydraulic mixing motor 28, remaining oil pressure is supplied through the first output ports $A_1$ and $A_2$.

As seen in FIGS. 29 and 30 which more particularly show an example of valve construction for the distribution control valves 125*a* and 125*b*, each one of these valves has a spool 128 slidably fitted in a valve casing 127. By sliding movements of the spools 128 within the valve casings 127, the distribution control valves 125*a* and 125*b* are switched either to a position in which the input ports $P_1$ and $P_2$ are communicated with the second output ports $B_1$ and $B_2$ but blocked against communication with the first output ports $A_1$ and $A_2$ or to a position in which they are communicated with both of the second output ports $B_1$ and $B_1$ and the first output ports $A_1$ and $A_2$. In doing so, the open areas of the respective output ports are varied according to the positions of the spools 128. In this instance, the spools 128 are moved according to a pressure differential across the variable throttle 126*a* or 126*b*, and, for this purpose, the opposite ends of the spools 128 are disposed under the influence of pressures in pressure chambers 130*a* and 130*b*, respectively. Drawn into and prevailing in the pressure chambers 130*a* and 130*b* are pressures on the upstream and downstream sides of the variable throttle 126*a* or 126*b*. A spring 131 is provided in the pressure chamber 130*a* in which pressure on the upstream side of the variable throttle 126*a* or 126*b*, thereby biasing the spool 128 in the leftward direction in the drawing, namely, into a position in which the input ports $P_1$ and $P_1$ are communicated with the second output ports $B_1$ and $B_2$ but blocked against communication with the first output ports $A_1$ and $A_2$.

Connected to a conduit 132 on the side of the pressure chamber 130*a* is a relief valve 133 which is opened when the output pressure from the second output port $B_1$ or $B_2$ exceeds a predetermined value to relieve the pressure to an oil tank 122. Therefore, in the event the screw conveyers 21 which are connected to the hydraulic mixing motor 28 are stuck in a locked state by biting on rocks or for other reasons, the relief valve 133 is opened to prevent abnormal pressure increases which would otherwise cause damages to various parts of the hydraulic circuit.

In this instance, the relief valve 133 is provided with a poppet 137 to be seated on and off a valve seat 136 of a pressure relief passage 135 which is formed in a casing 135. The poppet 137 is constantly urged toward the valve seat 136 by a biasing spring 138, which is abutted at its other end against a balancing piston 139. The balancing piston 139 is movable within the casing 134 toward and away from the poppet 137 under the influence of a pressure prevailing in a back pressure chamber 140.

In this connection, in order to supply pressurized operating oil to the hydraulic mixing motor 28 at a constant flow rate through the variable throttles 126*a* and 126*b* as soon as the mixing control valve 88 is switched to actuate the hydraulic mixing motor 28 in the course of an excavating operation, the variable throttles 126*a* and 126*b* can be maintained in such a state as to permit pressurized oil to flow therethrough at a small flow rate. However, under such circumstances, if the mixing control valve 88 is maintained in a neutral position with the hydraulic mixing motor 28 in a de-actuated state during an excavating operation by the front working mechanism 3, for instance, the hydraulic mixing motor 28 can be put in a state which is similar to a locked state, and pressure at the second output port $B_1$ or $B_2$ is allowed to rise almost to the level of the pump pressure. As a result, the relief valve 133 is actuated, and the pump side pressure is elevated at least to the preset operating pressure level of the relief valve 133 although no jobs are being performed on the side of the second output port $B_1$ or $B_2$. Under such circumstances, the regulators 123*a* and 123*b* operate to lower the discharge flow rate of the main pumps 120*a* and 120*b* despite the possibilities of lowering operational efficiency of the front working mechanism 3 which is being operated for ground excavation or for a similar job.

In order to preclude the inconveniences as described, a vent conduit 141 is connected to the relief valve 133. Through a change-over valve 142, the vent conduit 141 is selectively connectible either to the oil tank 122 or to a fixed capacity type pilot pump 143. The change-over valve 142 is opened and closed in linked relation with the mixing control valve 88. More particularly, the change-over valve 142 is opened when the mixing control valve 88 is in a neutral position, holding the hydraulic mixing motor 28 in a de-actuated state, and closed as soon as the mixing control valve 88 is switched to either one of the two operating positions. As a consequence, pressure of a preset value is applied to the relief valve 133 while the hydraulic mixing motor 28 is in operation. When the operation of the hydraulic mixing motor 28 comes to a stop, the relief pressure of the relief valve 133 drops substantially to the level of tank pressure.

As soon as the relief valve 133 drops to the tank pressure, it similarly prevails in the pressure chambers 130*a*, so that the spools 128 of the distribution control valves 125*a* and 125*b* are each shifted to the rightmost position in the drawing, that is, to a position in which the open area of the first outport $A_1$ or $A_2$ becomes maximum in terms of a ratio of open area of the second output port $B_1$ or $B_2$ to the first output port $A_1$ to $A_2$. As a result, substantially the entire amount of pressurized oil from the main pumps 120*a* and 120*b* is supplied to the side of the control valve unit 121. Therefore, a necessary amount of pressurized oil can be supplied to each one of the hydraulic actuators on the machine by switching the position of the corresponding one of the directional change-over valves which constitute the control valve unit 121. It follows that, apart from a soil treating operation, solely a ground excavating operation can be carried out by operating the boom 16, arm 17 and bucket 18 of the front working mechanism 4. In such an excavating operation without soil treatment, of course, the upper rotary body 2 can be turned and the base carrier 1 can be put in travel in the usual manner.

On the other hand, in the case of a composite excavating and soil treating operation, involving a soil treating operation concurrently with an excavating operation, the screw conveyers 21 which are provided as a soil tumbling/mixing means in the continuous processing trough 20 of the soil processing unit 4 are put in operation simultaneously and in relation with the above-described operation of the front working mechanism 3. For this purpose, the hydraulic mixing motor 28 of the screw conveyers 21 has to be operated simultaneously or concurrently with at least hydraulic cylinders 16*a*, 17*a* and 18*a* which drive the boom 16, arm 17 and bucket 18 of the front working mechanism, respectively.

At the start of a composite excavating and soil treating operation, the mixing control valve 88 is switched from a neutral position to either one of two drive positions. Upon switching the mixing control valve 88, the change-over valve 142 is switched in an interlinked fashion, blocking communication of the vent conduit 141 with the oil tank 122 and instead connecting same with the pilot pump 143. Accordingly, the relief valve 133 is operated on its originally designed characteristics according to a preset relief pressure. In this instance, even when the machine is in an excavating operation alone, a flow passage of pressurized oil at an extremely small flow rate is established through the second output port $B_1$ ($B_2$). This flow of pressurized oil of an extremely small flow rate is returned to the oil tank 122 while the machine is at an excavating job alone. However, as soon as the change-over valve 142 is switched as mentioned above, the pressure of the pilot pump 143 is applied to the balancing piston 139, compressing the spring 138 and pushing the poppet 137. With a preset pressure prevailing upon, a pressure is allowed to build up on the upstream side of the relief valve 133, and this pressure is led to prevail in the pressure chamber 130*a*. As a result, the spool 128 is pushed toward the pressure chamber 130*b*.

Here, since the spool 128 is under the influence of the biasing action of the spring 131 on the side of the pressure chamber 130*a*, pressurized operating oil is preferentially supplied to the hydraulic mixing motor 28 from the second output port $B_1$ ($B_2$) at a flow rate which is necessary for driving the screw conveyers 21 at a rated rotational speed, as long as pressurized oil is supplied from the main pumps 120*a* and 120*b* at a flow rate higher than a preset value which is determined by the variable throttles 126*a* and 126*b*. If pressurized oil is supplied at a greater flow rate, the spool 128 is displaced to a greater degree to supply surplus pressurized oil to the first output port $A_1$ ($A_2$). Accordingly, it becomes possible to operate the front working mechanism 3 simultaneously with operation of the soil processing unit 4 for a composite excavating and soil treating operation, in which, while sand and soil is excavated and thrown into the soil hopper by operation of the front working mechanism, excavated sand and soil with soil improving material within the continuous processing trough 20 by tumbling and mixing actions of the screw conveyers 21.

With a hydraulic control system of the arrangements as described above, even if the pressure of operating oil from the main pumps 120*a* and 120*b* is increased by a large resistance of excavation during a soil excavating operation by the front working mechanism 3, followed by a drop in discharge flow rate, pressurized oil can always be supplied to the hydraulic mixing motor 28 at a necessary flow rate. Besides, the flow rate of pressurized operating oil to the hydraulic mixing motor 28 is adjustable by way of the flow rate preferential means 124. An appropriate flow rate, which is necessary for the hydraulic mixing motor 28 in producing uniform and efficient mixing effects in the continuous processing trough 20, can be secured by adjusting the open areas of the variable throttles 126*a* and 126*b* according to the nature or properties of soil to be treated.

Even in a case where the hydraulic drive circuit for the mixing motor 28 is arranged as described above, there are still possibilities of variations occurring to the rotational speed of the hydraulic mixing motor 28. There are a number of factors which would cause such variations. Firstly, large loads are imposed on the hydraulic mixing motor 28 which, as drive means for the soil processing unit 4, functions to agitate and mix the contents of the continuous processing trough 20. For example, by nature the soil hopper 30 is arranged to hold a certain amount of extra soil, and this extra soil is imposed as a load on the hydraulic mixing motor 28 which drives the screw conveyers 21. Besides, since excavated soil is intermittently thrown in by the bucket 18, the amount of soil in the hopper 30 changes and therefore a varying load is imposed on the hydraulic mixing motor 28 to cause variations in its rotational speed.

Figure 31:
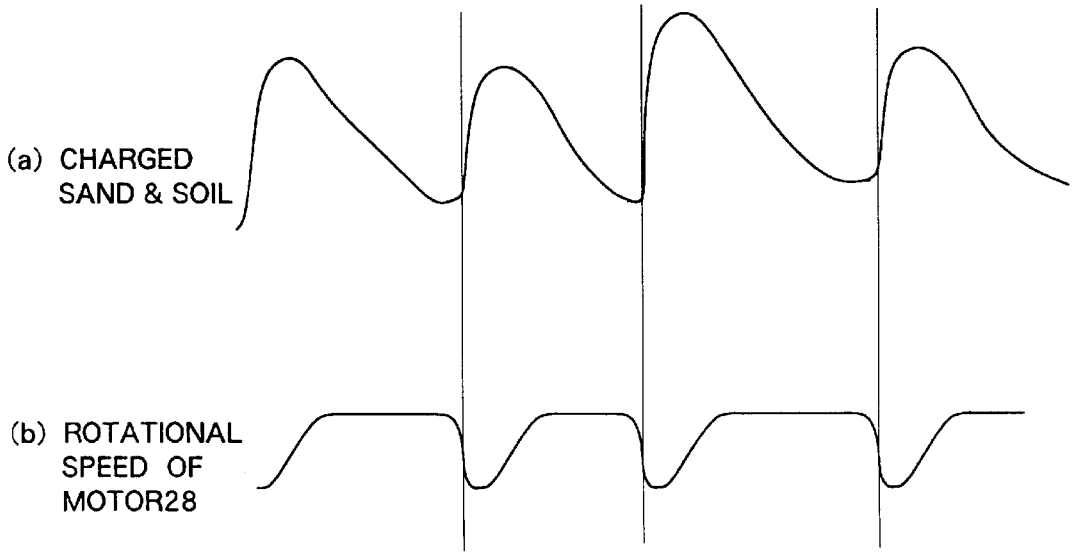
FIG. 31 is a diagram showing the relationship between soil feed rate to the hopper and rotational speed of a hydraulic mixing motor.

Referring to FIG. 31, considering that soil is intermittently into the hopper 30, the amount of soil stored in that hopper varies in a sawtooth-like pattern as indicated at (a). When the amount of stored soil is at the peak, that is, immediately after soil is thrown in by the bucket 18, abruptly a large load is imposed on the hydraulic mixing motor 28, causing the motor speed to drop temporarily as indicated at (b) of the same figure. After a conspicuous drop, the rotational speed gradually returns to a normal speed, and these fluctuations in rotational speed are helplessly repeated every time soil is thrown in.

Further, fluctuations in load conditions of the hydraulic mixing motor 28 also occur due to variations in resistance to mixing actions to the tumbling/mixing means within the continuous processing trough 20. Although the soil hopper 30 is provided with the grate 31 thereby to remove large rocks or other solid and hard masses beforehand. However, it is difficult to prevent rocks or other solid foreign substances completely by the grate 31 alone. In this connection, in order to permit passage of gravel and pebbles which are relatively small in diameter which would rather contribute to improvement of soil construction, the grate 31 is provided with apertures 31*a* which are broad enough for this purpose. In addition, fragments of sheet-like foreign objects like PVC sheets can get into the continuous processing unit 20 through the grate 31. Thus, besides sand and soil, various foreign matter or bodies can get into the continuous processing trough 20 to vary the resistance to mixing actions. Above all, large rocks or stones getting between the paddles 23 can increase the resistance to a considerable degree, causing the screw conveyers 21 to stop in a locked state. In the case of a sheet-like foreign object, it can be entwined around the screw conveyers 21 to disturb the rotational speed or to block the rotational movements thereof.

For the reasons as explained above, it is difficult to prevent fluctuations in rotational speed of the hydraulic mixing motor 28 as caused by spontaneous changes in mixing resistance. However, data of rotational speeds of the hydraulic mixing motor 28 and the additive feed motor 67 are fed to the controller 80 from the rotational speed sensors 81 and 82, respectively. Actually, the mixing ratio which has been set in the mixing ratio setter 109 through the control panel 100 needs to be varied depending upon the ratio of rotational speed of the hydraulic mixing motor 28 to that of the additive feed motor 67. Therefor, a servo motor control signal is applied to the servo circuit 85 on the basis of a signal of rotational speed of the hydraulic mixing motor 28 which is received from the rotational speed sensor 81, thereby to control the rotational speed of the additive feed motor 67 in such a way as to follow that of the hydraulic mixing motor 28. In addition, the additive feed motor 67 is constituted by an electric variable speed motor which has sufficiently high response characteristics for fine control of its rotational speed.

Accordingly, the processed soil product resulting from a soil treating operation by the above-described machine has high quality as ascertained in experimental stages. More particularly, by mixing a minimum necessary amount of additive soil improving material, the machine can continuously produce soil of improved quality which has uniform hardening properties, from the start to the end of the operation.

Excavated soil which has been thrown into the continuous processing trough 20 has to be uniformly mixed with additive soil improving material within a limited transfer distance of the trough 20. For this purpose, the paddles 23 on the four screw conveyers 21 of the continuous processing trough 20 are located at a relatively close distance from adjacent paddles. Therefore, there are possibilities of rocks or large stones getting between adjacent paddles in such a way as to block the rotations of the screw conveyers 21, bring about the so-called locked state. On such an occasion, the transfer of soil is stopped unless the screw conveyers 21 are unlocked from obstructing rocks. If additive soil improving material is supplied continuously during suspension of the soil transfer, it is inevitable that a conspicuous change in mixing ratio will occur to part of processed soil to be obtained. For the purpose of preventing such a change in mixing ratio, arrangements are made to detect a locked state of the screw conveyers 21 immediately, and, if detected, to stop the operation of the additive feed motor and automatically release the conveyers from a locked state.

If the hydraulic mixing motor 28 falls into a locked state, a pressure increase occur to the operating oil which is being supplied to the hydraulic mixing motor 20, and this pressure increase is detected by the pressure sensor 84. At this time, since the hydraulic mixing motor 28 is provided with the relief valve 133, there is no possibility of the supply pressure exceeding the preset operating pressure of the relief valve 133. Pressure signal is constantly supplied from the sensor 84 to the controller 80 for comparison with a value which is preset in the controller 80 as an indicator of a locked state. More specifically, when the hydraulic mixing motor 28 is locked for some reason, it can be detected by comparing a pressure level from the pressure sensor 84 with a locking pressure level which is preset in the data processing section 92 of the controller. However, a locked state may last only for an extremely short period of time. The efficiency of the soil treatment will be degraded considerably if an unlocking operation is to be performed on each one of pressure increases of short durations which are attributable to temporary or instantaneous locking. In order to disregard such temporary or instantaneous pressure increases, a locked state is declared only when a high pressure detected by the pressure sensor 84 remains at a higher level for more than several seconds.

When the hydraulic mixing motor 28 is found to be in a locked state, firstly the additive feed motor 67 is turned off to stop the supply of soil improving material to the continuous processing trough 20. However, the soil discharging means 33 is allowed to continue its operation because its continued operation will not give rise to any problem in particular. Then, the hydraulic mixing motor 28 is rotated in the reverse direction for unlocking purposes. Namely, the four screw conveyers 21 are rotated in an opposite direction relative to an adjacent screw conveyer or conveyers, normally such that the paddles 23 on adjacent screw conveyers 21 are turned in directions toward each other. However, when the rotation is reversed, the paddles 23 are turned in directions away from each other to release a rock or rocks which have been trapped between paddles 23. Accordingly, in most cases, the hydraulic mixing motor 28 can be freed by rotating same in the reverse direction for several seconds. In case a rock has been trapped between a paddle and an inner wall surface of the continuous processing trough 20, however, it may become difficult to unlock the hydraulic mixing motor 28 by reverse rotation or to put it in reverse rotation. When it is difficult to unlock the hydraulic mixing motor 28 by a reverse rotation, in other words, when a detected high pressure from the pressure sensor 93*a* would not drop despite a reverse rotation, the operation of the soil processing unit 4 is suspended for an emergency stop. Therefore, in such an emergency case, the operator needs to inspect the continuous processing trough 20 and to remove a trapped rock or the like. Upon pressing the reset switch 108 after unlocking, the "Setup Complete" indicator lamp 111 is lit ON if the soil processing unit 4 in conditions for re-starting the operation, and the processing operation is resumed upon turning the "Mixing Start" switch 103 ON.

Further, should a PCV sheet or the like get into the continuous processing trough 20 and entwine around the screw conveyers 21, it would increase the resistance to rotation and lower the efficiency of the mixing operation. In such a case, it is difficult to remove the obstructive sheet material simply by reversing the rotation of the hydraulic mixing motor 28. Upon lapse of a certain period of time, the hydraulic mixing motor 28 should return to its rated operating speed irrespective of the amount of excavated sand and soil in the hopper 31. Therefore, in case it is detected from a signal from the rotational speed sensor 81 that the motor has not returned to its rated operational speed for more than several minutes, for example, the operation of the soil processing unit 4 should be stopped to check for a cause of the trouble even if the screw conveyers 21 are not in a locked state.

A locked state can occur on the side of the soil discharging means 33. If the screw 35 of the soil discharging means 33 gets stuck in a locked state, it will elevate the pressure on the high pressure side of the hydraulic soil discharging motor 38. Therefore, a locked state of this motor can be detected substantially in the same manner as in the case of the hydraulic mixing motor 28. If the discharging screw 35 falls into a locked state, it will give rise to stagnation of soil within the continuous processing trough 20. In that case, operations of the hydraulic mixing motor 28 and additive feed motor 67 in response to signals from the controller 80. After that, operation of the hydraulic discharging motor 38 needs to be stopped as well because, if the discharging motor 38 is rotated in reverse direction for unlocking purposes, a reverse flow of soil will occur within the soil discharging passage 34. Then, the can take a necessary action to release the discharging means 33 from a locked state.

Excavated sand and soil is supplied to the continuous processing trough 20 by the front working mechanism 3, which can keep on the supply almost endlessly as long as it is operated by an operator. In contrast, additive soil improving material is supplied to the continuous processing trough 20 by the additive feed means 50 through the additive feed hopper 52 of a relatively small capacity which is provided on the side of the base carrier. The additive supply source unit 51 which is provided on the side of the upper rotary body 2 receives a supply of additive soil improving material from the flexible container 53 holding a limited amount of soil improving material. Accordingly, the controller 80 further includes functions of controlling the supply of additive soil improving material.

Firstly, additive soil improving material is successively replenished to the hopper 52 from the feed section 55 of the additive supply source unit 51 as it is consumed by supply to the continuous processing trough 20. However, the replenishment of additive soil improving material is not always possible but is possible only when the upper rotary body 2 is in a position within a predetermined angular range. While the soil processing unit 4 is in operation, sand and soil is excavated and thrown into the hopper 31 by the bucket 18 in association with rotating movements of the upper rotary body 2. In so doing, rotational angles of the upper rotary body 2 are detected by the angle detection means 71 which is provided on the center joint 70. The angle index plate 72 which constitutes one part of the angle detection means 71 is provided with an indented arc portion 72*a* through a predetermined angle. The roller 73*a* of the angle detector 73, which is adapted to run along and in contact with outer marginal edges of the index disk 72, drops into the indented arc portion 72*a*, and this movement is detected by the detecting member 73*c*. Accordingly, an angular position signal is supplied to the controller 80, along with a signal from the top level sensor 74. Feasibility of additive supply can be judged by a signal from the angle detection means 71, while necessity of additive supply can be judged by a signal from the top level sensor 74. Accordingly, the shutter 58 is opened to replenish additive soil improving material to the hopper 52 only when its supply is feasible and necessary.

The replenishment of additive soil improving material is continued as long as it is judged to be feasible and necessary. The shutter 58 is closed either when the upper rotary body 2 is turned into an infeasible position or when the top level of stored additive material in the hopper 52 has exceeded the position of the top level sensor 74. The shutter 58 is opened and closed by the shutter drive cylinder 59, and actual opening and closing of the shutter 58 are confirmed by means of limit switches 76*a* and 76*b*. Therefore, on the basis of signals from the sensors mentioned above, the controller 80 produces a shutter error signal or an alarm to arouse operator's attention when the shutter 58 would not open despite replenishment of additive material is necessary and feasible, or when the shutter 58 remains in an open position to continue replenishment of additive soil improving material even after the top level of additive material in the hopper 52 has exceeded the position of the top level sensor 74.

While the soil processing unit 4 is in operation, if the upper rotary body 2 remains in a replenishment-infeasible angular position for a long period of time, the hopper 52 could become empty due to a long suspension of replenishment of the additive soil improving material. In such a case, however, as soon as the level of additive material in the hopper 52 drop below the lower limit sensor 75 which is provided on the hopper 52, a shortage signal is sent to the controller 80, and operations of the additive feed motor 67 and hydraulic mixing motor 28 are stopped by a command signal from the controller 80. At this time, the indicator lamp 110*b* in the indicator lamp section 110 of the control panel 100 is lit ON so that the operator can recognize the shortage of additive soil improving material. Under such circumstances, the shutter 58 on the additive feed section 55 is opened to resume replenishment of additive material to the hopper 52 as soon as the upper rotary body 2 is turned to an angular position in which replenishment is feasible, for example, to a position in which excavated sand and soil can be thrown into the hopper 30 by means of the bucket 18 of the front working mechanism 3. As soon as additive storage level rises over the position of the lower limit sensor 75, the indicator lamp 110*a* is lit ON and a soil treating operation is resumed automatically by re-starting the additive feed motor 67 and the hydraulic mixing motor 28.

On the other hand, on the side of the additive supply source unit 51, additive soil improving material is supplied from the flexible container 53. The flexible container 53 has to be replaced as soon as it becomes empty. A timing replacing the flexible container 53 is determined by a signal from the lower limit sensor 77 which is provided on the feed section of the additive feeder unit 51. By way of output signals of the lower limit sensor 77, the amount of additive soil improving material on the side of the feeder unit 51 constantly monitored by the controller 80. As soon as the top level of additive material on the side of the feeder unit 51 drops below the position of the lower limit sensor 77, the indicator lamp 110*c* on the indicator lamp section 110 of the control panel 100 is lit ON. Accordingly, the operator can recognize a timing for replacement of the flexible container 53 from the indicator lamp 119*c*. Further, in response to a signal from the controller 80, operations of the additive feed motor 67 and hydraulic mixing motor 28 are stopped. In this case, since the job of replacing the flexible container 53 takes a certain period of time, it is desirable to stop operation of the hydraulic discharging motor 38 of the soil discharging means 33 as well.

As described above, on the basis of signals from the rotational speed sensors 81 to 83 of the hydraulic mixing motor 28, additive feed motor 28 and soil discharging motor 38, signal of angular position of the upper rotary body 2 from the angle detector 71, signals from the top level sensor 74 and lower limit sensors 75 and 75, signals from the limit switches 76*a* and 76*b* and the pressure sensors 84 and 109, and a signal from the pressure sensor 84 in association with the relief valve 133, necessary data are processed at the data processing section 91 of the controller 80 for controlling operations of the mixing control valve 88, the servo circuit 85 for the additive feed motor 67, and the discharge control valve 89. Therefore, once started, a continuous soil treating operation is carried out automatically unless it is suspended or interrupted by a trouble or troubles as described above. During a continuous soil treating operation, the operator can concentrate his or her attention on the job of excavating sand and soil and throwing it into the hopper 31. As a consequence, the two different operations, i.e., excavation of a ground and treatment of excavated soil, can be carried out quite smoothly under control of a single operator who is seated in the operator's cab 6. Besides, when it becomes necessary to stop the soil treating operation for some reason, the hydraulic mixing motor 28, additive feed motor 67 and hydraulic discharging motor 38 can be stopped by turning the "Mixing Stop" switch 104 ON. The operated can be re-started by turning the "Reset" switch 108 ON and, after confirming that the "Setup Complete" lamp 111 is lit ON, turning the "Mixing Start" switch 103 ON. In case the "Setup Complete" lamp 111 remains OFF even after pressing the "Reset" switch 104, it becomes necessary for the operator to check out suspected parts of the machine.

Figure 32:
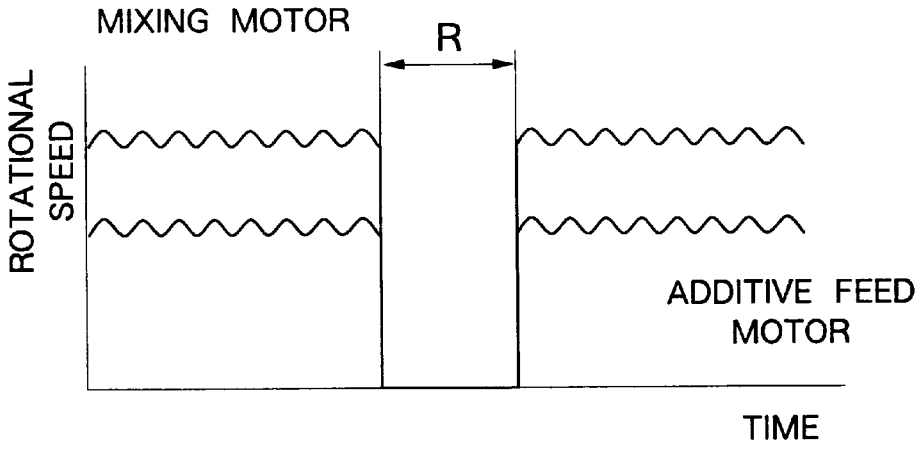
FIG. 32 is a diagram showing, as an example of soil processing data, variations with time in rotational speeds of the hydraulic mixing motor and hydraulic additive feed motor.

In order to enhance the reliability of soil treating operations, it is desirable to save the operational data which will be useful in analyzing the results of a soil treating operation in relation with actually adopted operational factors on a later day. Especially, it is essential to save the data regarding the total amount of soil processed by a soil treating operation and applied mixing ratio or ratios of soil to additive soil improving material. In this regard, since excavated soil is treated successively by a continuous operation, the data of mixing ratio need to be saved in the form of time-based data. Further, time-based data of at least the rotational speeds of the hydraulic mixing motor 20 and additive feed motor 67 from the rotational speed sensors 81 and 82 should be stored in the memory or storage device 95 of the controller 80. As explained hereinbefore, the transfer rate or feed rate of excavated sand and soil to and in the continuous processing trough 20 is determined by the rotational speed of the hydraulic mixing motor 28, while the feed rate of additive soil improving material is determined by the rotational speed of the additive feed motor 67. Accordingly, from these speed sensors, time-based data of the mixing ratio of excavated sand and soil to additive soil improving material can be obtained as shown in FIG. 32. In that figure, the letter "R" indicates a time period over which a soil treating operation was interrupted due to locking of the hydraulic mixing motor 28, including reverse rotation of the hydraulic mixing motor 28 for unlocking purposes. Thus, in this case, the memory 95 stores data of rotational speed of the hydraulic mixing motor 28 when in the forward rotation, excluding data in interrupted time periods or in reverse rotation. The total amount of processed soil can be determined from the two data sources mentioned above. However, in case the hydraulic discharging motor 38 is controlled in relation with the operation of the hydraulic mixing motor 28, the total amount of processed soil can be calculated on the basis of rotational speed data of the hydraulic discharging motor 38, stored in the memory 95.

After finishing an operation, the above-mentioned data can be downloaded to a personal computer 97 by connecting same to the I/O processor 96 of the controller 80. Further, downloaded data can be stored in the storage device 98 of the personal computer 97, for example, in a non-volatile storage such as flexible magnetic data storage disk, photomagnetic data storage disk, memory card or the like, for later data management, analysis, verification or for other purposes.

In the embodiment described above, the continuous processing trough 20 is fixedly mounted on the center frame 15 of the base carrier 1. However, in an excavating operation on a ground area which is on the side of the continuous processing trough 20 as indicated at F1 in FIG. 1, the trough 20 itself may hinder excavating operations by the front working mechanism if it is projected on the front side of the base carrier 1. Therefore, it is desirable to retract the continuous processing trough 20 into a receded or rear position while the machine is used solely for an excavating operation, and to advance it to a front position during a soil treating operation to facilitate the operations of excavating and throwing sand and soil into the hopper by the bucket. For this purpose, the machine may be arranged as shown in FIGS. 33 through 36.

Figure 33:
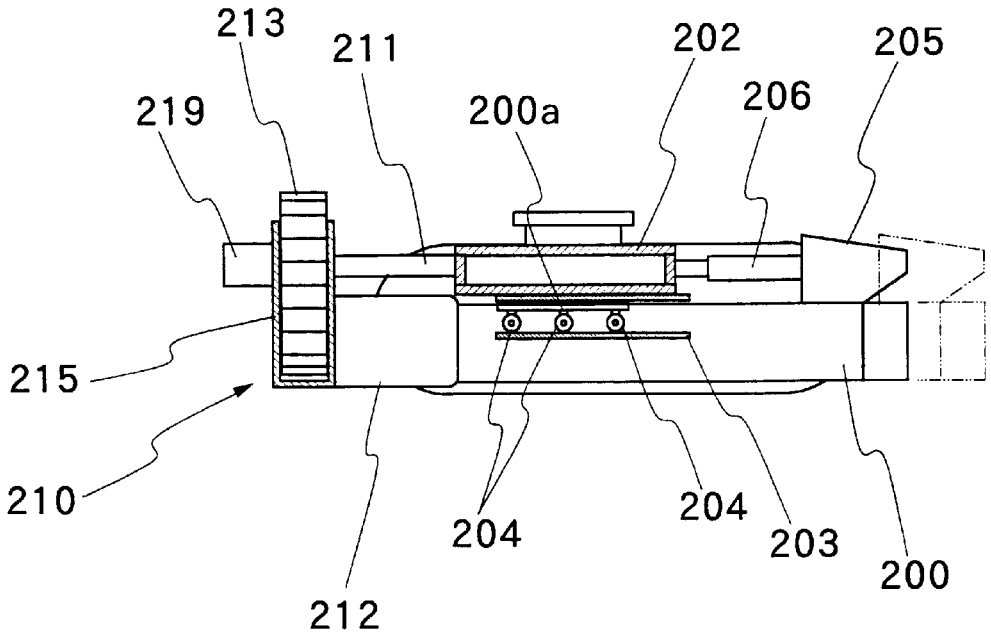
FIG. 33 is a schematic view of a drive mechanism for driving the continuous soil treating trough in forward and backward directions, employed in another embodiment of the present invention.
Figure 34:
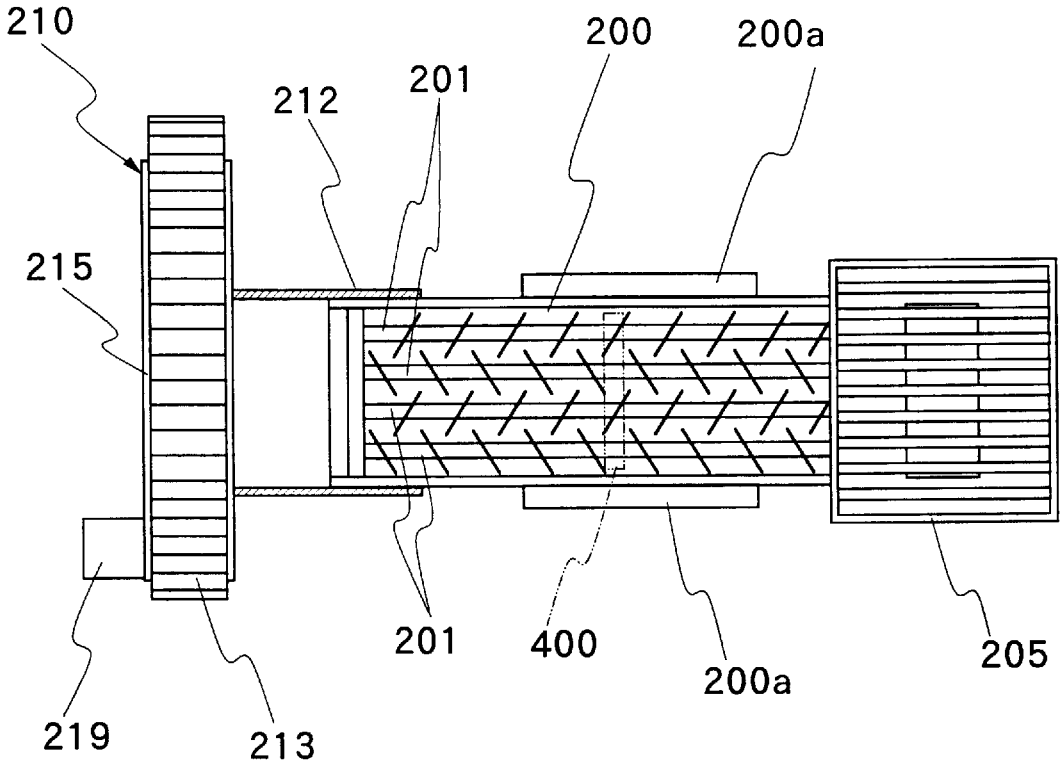
FIG. 34 is a schematic plan view of the continuous treating trough shown in FIG. 33 and a soil charging hopper connected thereto.
Figure 35:
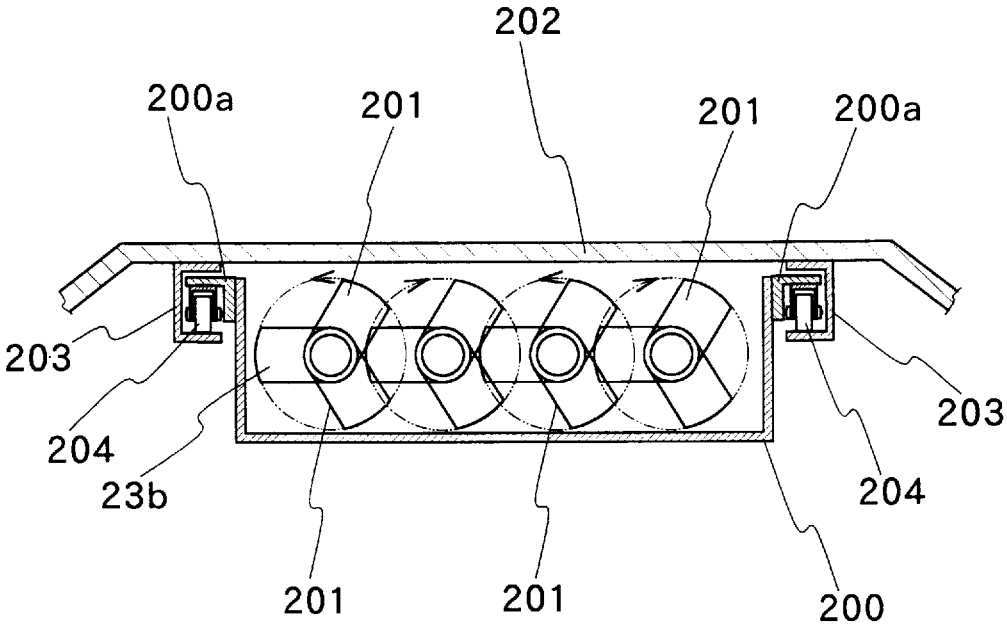
FIG. 35 is a schematic cross-sectional view of the continuous treating trough shown in FIG. 33.
Figure 36:
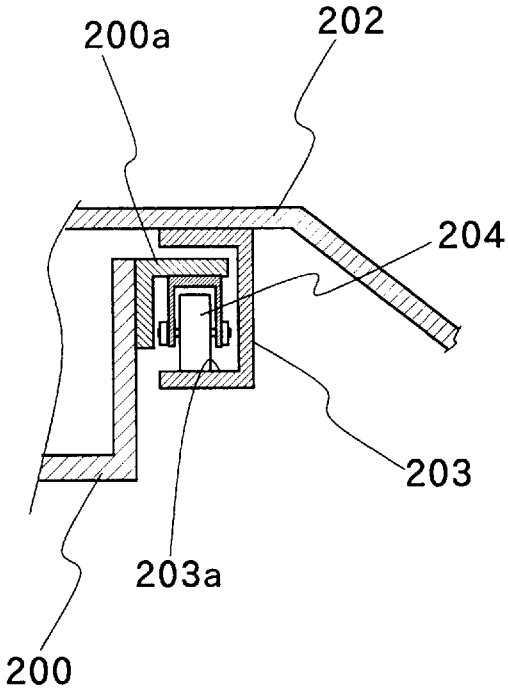
FIG. 36 is an enlarged view of some essential components in the embodiment shown FIG. 35.

In FIGS. 33 and 34, indicated at 200 is a continuous processing trough which is similarly provided four screw conveyers 201 as a soil mixing and transferring mechanism. Fixedly provided on a center frame 202 of a vehicular base carrier are guide rails 203 which are extended along the opposite sides of the center frame longitudinally in the traveling direction of the base carrier. The continuous processing trough 200 is provided with longitudinal narrow side ledges 200*a* on its opposite lateral sides. As shown in FIGS. 35 and 36, a plural number of rollers 204 are mounted on each one of the side ledges 200*a*. The rollers 204 are mounted on the guide rails 203 to run along guide surfaces 203*a* of the latter. Consequently, the continuous processing trough 20 is movable back and forth in the longitudinal direction on and relative to the center frame 202.

A soil hopper 205 is fixedly mounted on the center frame 202, and a hydraulic cylinder 205 is connected between a side wall of the soil hopper 205 and the center frame 202. Accordingly, the continuous processing trough 200 is pushed forward into a front position when the hydraulic cylinder 206 is extended, and drawn back into a rear position when the hydraulic cylinder 206 is contracted. Namely, when the machine is to be used for an excavating operation alone, the hydraulic cylinder 206 is contracted to retract the continuous processing trough 200 toward the center frame 202 as indicated by solid line in FIG. 33. In this state, the front working mechanism including a bucket can be smoothly operated by an operator who can see an excavating ground portion clearly in operating control levers of the front working mechanism within the operator's cab. On the other hand, in case the machine is to be used for a soil treating operation, the hydraulic cylinder 206 is stretched as indicated by imaginary line in FIG. 33 to push the continuous processing trough 20 into a front position, with the soil hopper 203 projected on the front side so that excavated soil can be thrown thereinto smooth by the bucket.

Improved soil coming out of the continuous processing trough 200 is handed over to the soil discharging means 210. However, in case the continuous processing trough 200 is longitudinally movable between front and rear positions as described above, and, if the soil discharging means is made movable back and forth in linked relation with shifts of the continuous processing trough position, it may be collided against the upper rotary body. To preclude such a collision, the soil discharging means 210 should be supported on the center frame 202 independently of the continuous processing trough 200. Therefore, the soil discharging means 210 is connected to the center frame 202 through a support rod 211.

If the continuous processing trough 200 with the soil hopper 205 is moved back and forth between its front and rear positions while fixedly retaining the soil discharging means 210 in position on the side of the base carrier, the distance between these two components varies with movement of the continuous processing trough 200. This problem can be solved by movably fitting an end portion of the continuous processing trough 200 in a box-like connector frame 212 which is fixed to the soil discharging means 210. Forward and backward movements of the continuous processing trough 200 absorbed by the connector frame 212, and at the same time improved soil coming out of the continuous processing trough 200 can be securely delivered to the soil discharging means 210 through the connector frame 212. No forced transfer mechanism is provided in the connector frame 212. However, because of a box-like shape of the connector frame 212, improved soil is continuously transferred to the soil discharging means 210 as it is pushed forward by following soil which is continuously pushed in from the continuous processing trough 200. In order to transfer improved soil more smoothly to the soil discharging mens 210 through the connector frame 212, a continuous paddle may be provided on rear end portions of the screw conveyers 201.

Figure 37:
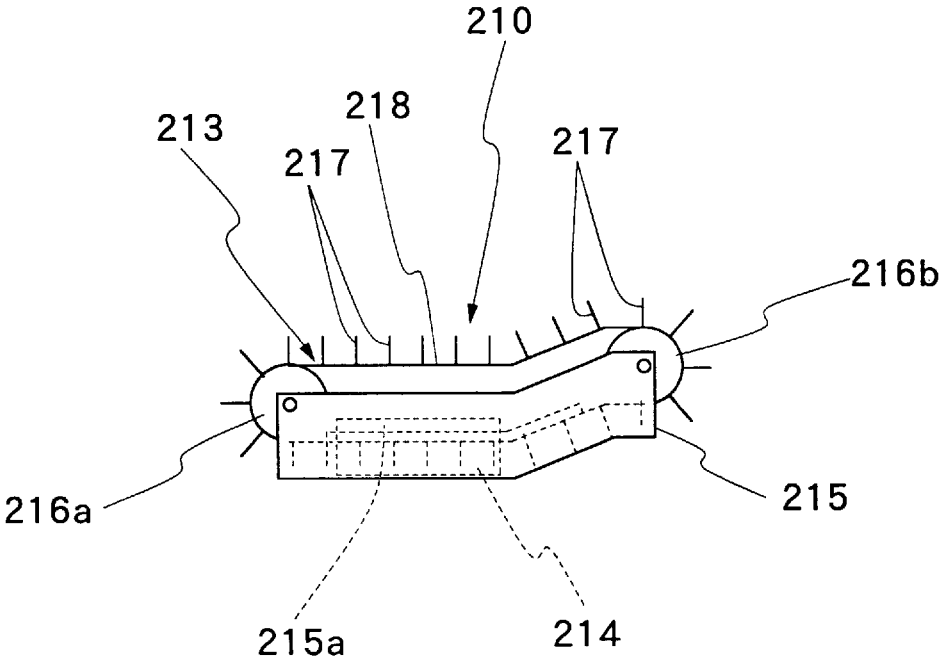
FIG. 37 is a schematic view of a modification of the soil discharging means.

Different from the soil discharging means 33 of the foregoing embodiment, the soil discharging means 210 of this embodiment employs a belt conveyer 213 with soil dumping plates. The construction of this soil discharging means 210 is schematically shown in FIG. 37. The belt conveyer 213 is constituted by a bottom plate and front and rear riser walls. Pulleys 216*a* and 216*b* are rotatably mounted on opposite end portions of a riser wall of a discharging passage structure 215, which is located on the side of the connector frame 212 and which is provided with an entrance opening 214. Passed around the pulleys 216*a* and 216*b* is a belt 218 which has a large number of soil dumping plates 217 projected on the outer side thereof. One of the pulleys 216*a* and 216*b* is coupled with a hydraulic drive motor 219. Upon actuating the hydraulic drive motor, the belt 218 is turned around the two pulleys, and treated soil entering the discharging passage structure 215 through the entrance opening 214 is pushed toward an exit opening 215*a* of the passage structure 215 by the actions of the soil dumping plates 217 moving along with the belt 218.

The internal passage of the discharging passage structure 215 is formed in a direction perpendicular to the travel direction of the vehicular base carrier, the soil discharging passage having the exit opening 215*a* at a position on the outer side of treading surfaces of a crawler belt. The soil discharging passage structure 215 is sloped upward toward the exit opening 215*a* so that it can discharge treated soil from a position higher than the ground level. Therefore, treated soil can be piled up to a higher level. In this instance, the belt 218 to be wrapped around the pulleys 216*a* and 216*b* is formed of a flexible material. It follows that the belt 218 should be retained in an appropriate shape without deformations at least in those portions where the belt is required to carry treated soil. For this purpose, a guide plate 215*a* is provided on the riser wall of the discharging passage structure 215 thereby to guide the belt 218 by sliding contact with the back side of the latter, that is, the side opposite to the front side of the belt which carries the soil dumping plates 217.

The continuous processing trough 200 may be positioned horizontally if desired, but it may be positioned in an inclined state in the longitudinal direction. When inclined, it is desirable to set it along an upward slope toward the soil discharging means 210 to transfer soil and additive soil improving material against gravitational forces. The inclined arrangement of the continuous processing trough 200 makes it possible to enhance mixing efficiency because soil and additive soil improving material are allowed to dwell in the trough for a longer time period than in a horizontal processing trough. Besides, in an inclined soil processing trough, masses of soil which have not been broken down by the screw conveyers 21 tumble down by gravity and move in a direction inverse to the transfer direction as they are exposed to surfaces by mixing actions of the screw conveyers 21. Returned soil masses are crushed into pieces by the actions of the screw conveyers 21 as they are transferred again toward the downstream side of the trough.

Figure 38:
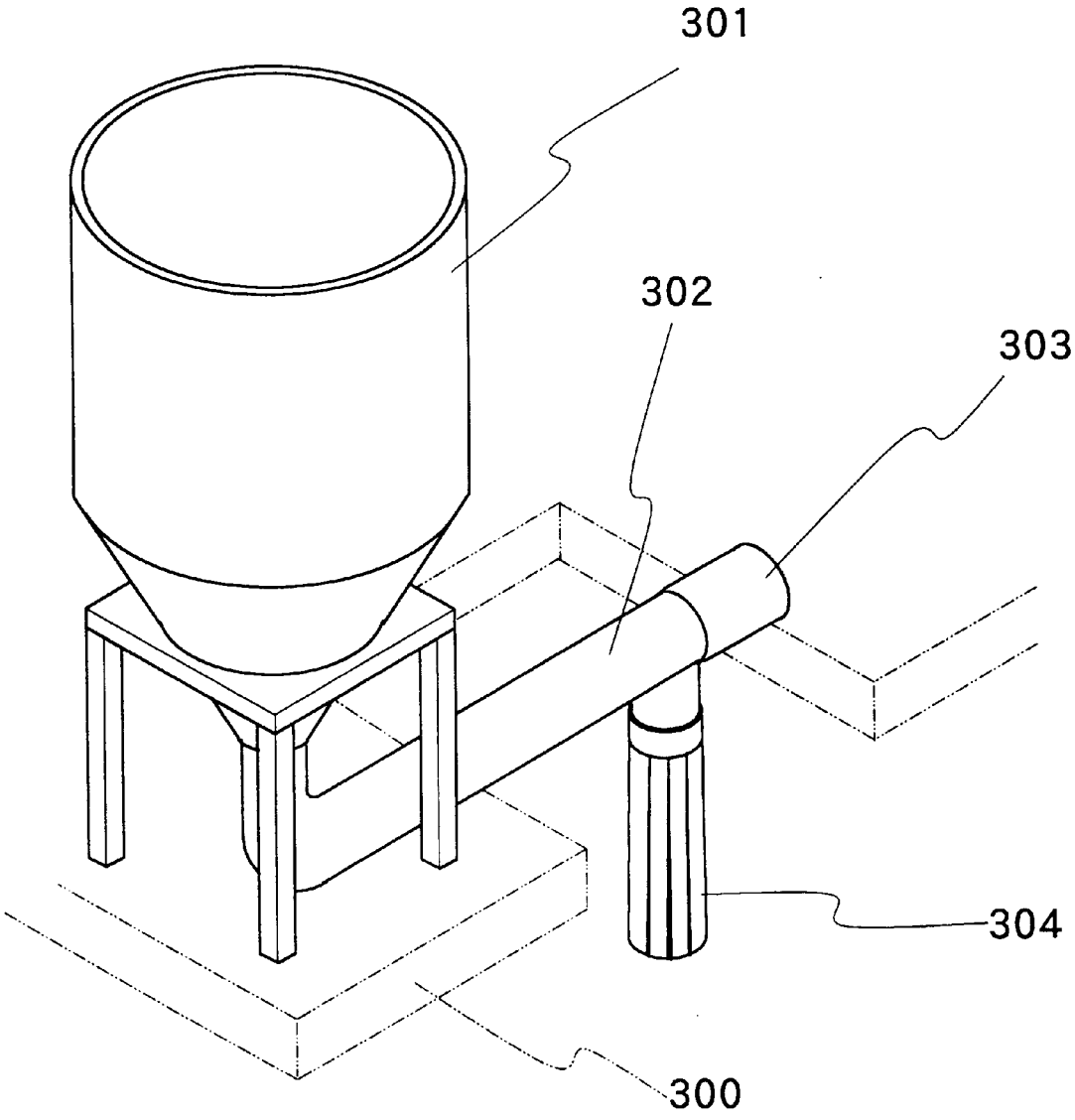
FIG. 38 is a schematic outer view of a modification of the additive feed means.
Figure 39:
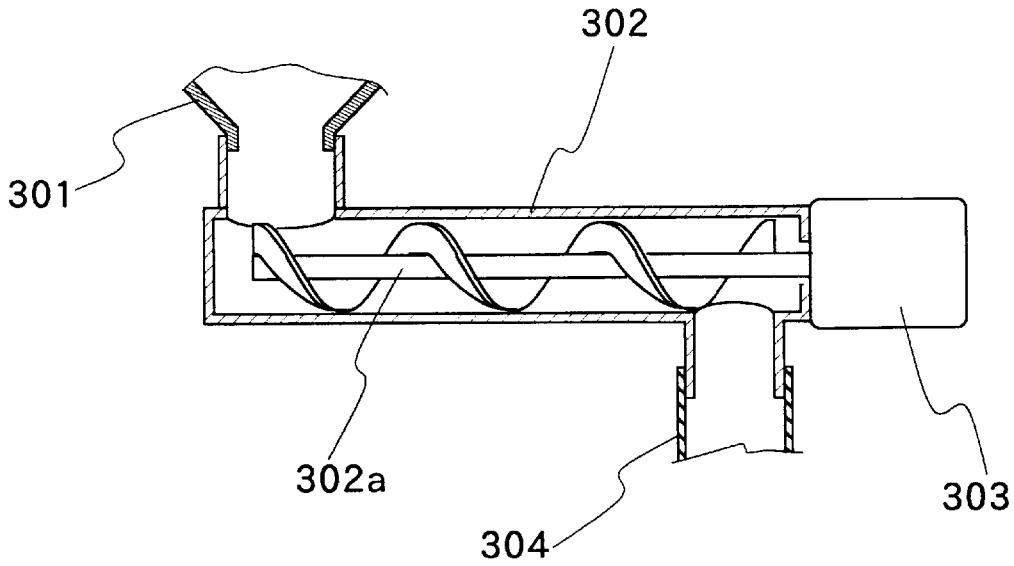
FIG. 39 is a schematic sectional view of a continuous treating trough of a modified form suitable for use on the soil treating machine.

For instance, the additive feed mans may be arranged as shown in FIGS. 38 and 39. In these figures, indicated at 300 is a frame of the upper rotary body. Mounted on the frame 300 is a additive storage tank 301 having a body of a generally cylindrical shape which is converged in a conical shape at its lower end. A feeder 302 is connected to the lower end of the tank 301.

The feeder 302 is in the form of a tube which is bent in the horizontal direction from a vertically rising section which is connected to the lower end of the tank 301. As shown particularly in FIG. 39, a feeder screw 302*a* is provided in the horizontal extending section of the feeder 302. The screw 302*a* is rotationally driven from a hydraulic motor 303 to feed additive soil improving material from the tank 301 continuously at a specified rate. The tubular body of the feeder 301 is bent again in the downward direction at the end of the horizontal section. The feeder 301 is located at a higher level than the frame 300 of the upper rotary body, and as an additive feed section a flexible tube 304 is connected to the downwardly turned end portion of the feeder 302. The flexible tube 304 is formed of relatively stiff rubber material, and, except for its upper portion, provided with longitudinal slits toward its lower end in the fashion of a streamer. When the upper rotary body 2 is turned forward in the travel direction of the vehicle, the flexible tube 304 is opened substantially toward an intermediate position of the continuous processing trough.

In this instance, at the time of a soil treating operation, firstly excavated sand and soil is scooped up in the bucket and thrown into the soil hopper, from a pile of sand and soil which was excavated and accumulated in a predetermined place by a prior excavating operation. Therefore, at this time, there is no need for turning the upper rotary body through a large angle. Besides, in turning the upper rotary body, a large shift in position would not occur to the flexible tube 304 which is connected to the feeder 302, as long as it is located in as close a position as to the turn radius of the upper rotary body. Accordingly, depending upon turn angles and the position of the flexible tube 304 during a soil treating, the above arrangements make it possible to feed additive soil improving material to constantly to the continuous processing trough. In doing so, there is no need for determining the timing of feeding additive soil improving material from the additive feeder unit to the hopper, permitting to simplify its feed control mechanism. Alternatively, additive soil improving material can be supplied directly to the continuous processing trough from the flexible tube 304. Nevertheless, there may be employed an additive feed hopper similar to the one as shown in the foregoing first embodiment, if desired.

Further, it is possible to use the center joint as a feed passage for additive soil improving material. More specifically, the cable passage hole 114, which is bored through the rotary member 70*a* of the center joint 70 as shown in FIG. 23, can be utilized as an additive material feed passage.

For concretion, sand and soil to be treated should have a suitable moisture content. In the case of a soil treatment on an extremely hot day or in the case of treating soil with an extremely small moisture content, there may arise a necessity for sprinkling water in the continuous processing trough. For this purpose, the center joint can also be utilized as a water feed passage of water sprinkling means. Namely, the cable passage hole 114 of the center joint 70 may be enlarged in diameter to a suitable degree to accommodate a water feed pipe which supplies water, for example, to a water sprinkling nozzle 400 as indicated by imaginary line in FIG. 34.

Figure 40:
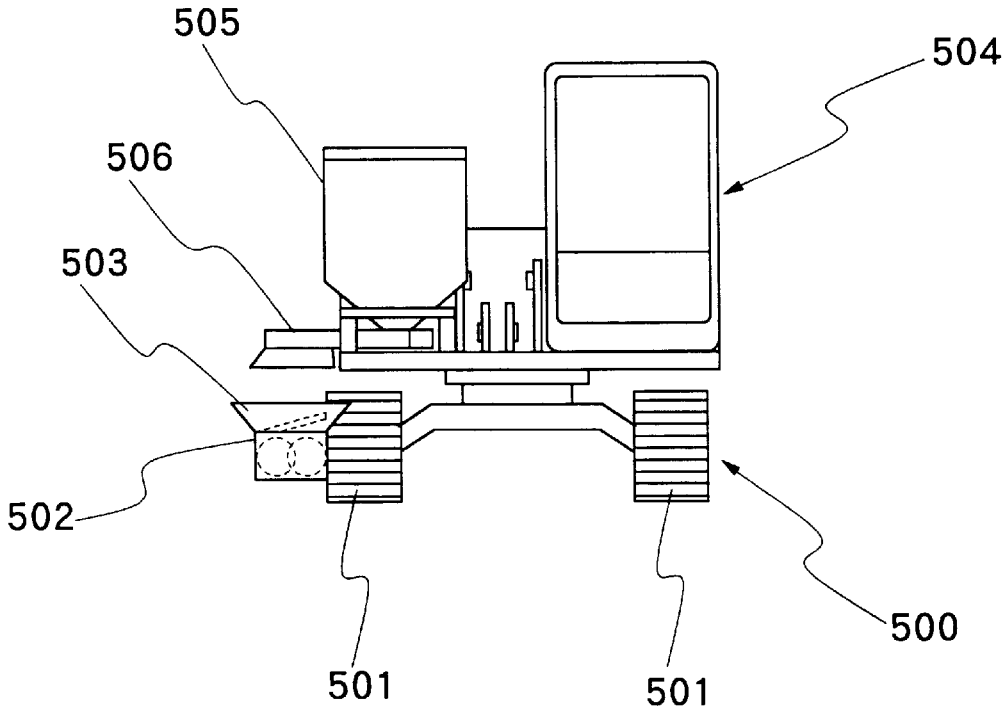
FIG. 40 is a schematic front view of another modification of the continuous treating trough.

Further, if desired, a continuous processing trough 502 and a sand hopper 503 may be located on the outer side of a crawler belt 501 of a vehicular base carrier 500 as illustrated in FIG. 40. From an additive feed hopper 505 which is provided on an upper rotary body 504, additive soil improving material is fed to the continuous processing trough 502 through an additive feeder 506 with a screw conveyer. In this instance, treated soil can be discharged to the outside through a rear end portion of the continuous processing trough 502, without using a soil discharging means.

Figure 41:
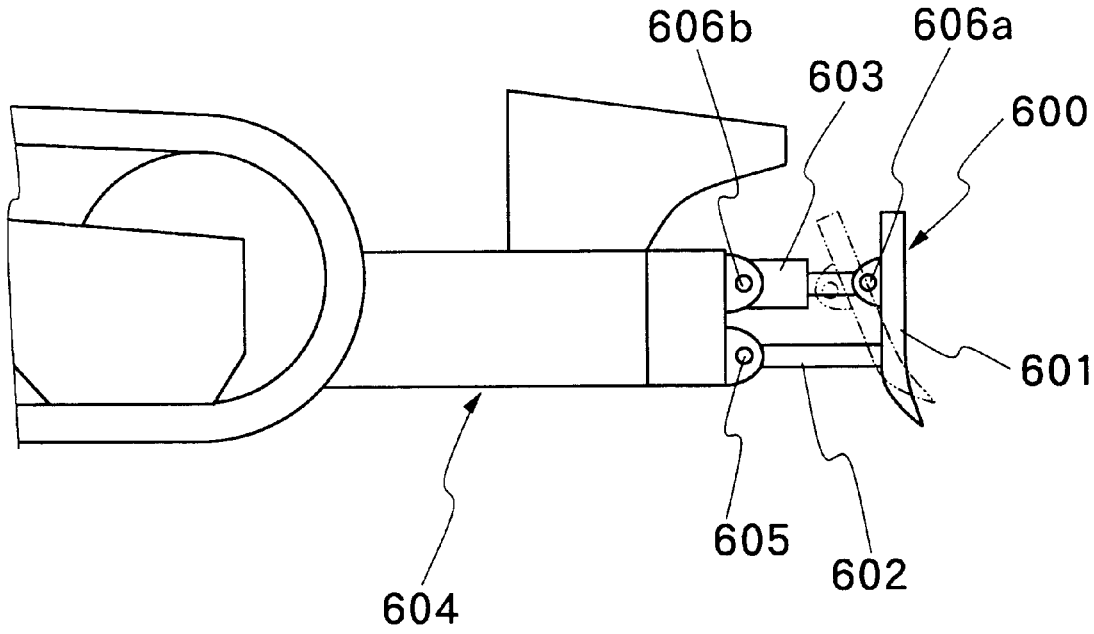
FIG. 41 is a schematic view of a leveling blade attached to the base carrier of the soil treating machine.

After refilling excavated ground with treated soil, the ground surface is leveled either by the use of the bucket or by the use of a leveling blade 600 as shown in FIG. 41. The leveling blade 600 has a blade body proper 601 and, for rocking the blade body 601 up and down in the vertical direction, a lever 602 and a hydraulic blade drive cylinder 603. The fore end of the lever 602 is fixedly connected to the blade body 601 and pivotally supported at its rear end on a front end portion of the continuous processing trough 604 through a pin 605. The opposite ends of the hydraulic cylinder 603 are pivotally connected to the blade body 601 and the processing trough 604 through pins 606*a* and 606*b*, respectively. Accordingly, by contracting the hydraulic cylinder 603, the blade body 501 is turned upward into a tilted position, clear of the ground surface or other obstacles which may exist on the ground surface to ensure smooth travel of the vehicular body. On the other hand, by stretching the hydraulic cylinder 603, the blade body 601 turned downward into a vertical position to level and smoothen out ups and downs on refilled ground surfaces when the lower vehicular body is running thereon for leveling purposes.

Possibilities of Industrial Utilization

According to the present invention, all the operations for excavation of a ground, treatment of excavated sand and soil and refilling of treated soil are performed by one and single machine, while preventing additive soil improving material from scattering around and giving adverse effects or causing inconveniences to the environment while being mixed with excavated sand and soil. Besides, a ground can be excavated to a desired depth by an excavation means concurrently with a continuous soil treating operation, so that foundational soil of a ground can be improved accurately and efficiently.

What is claimed for patent is:

1. A vehicular soil treating machine comprising:

a traveling vehicular body including a base carrier driven by a pair of crawler belts and an upper rotary body rotatably mounted on said base carrier;

an excavating means supported on said upper rotary body and provided with a bucket for excavating earth;

a continuous processing trough provided on a side of said base carrier and having a soil tumbling/mixing means with a hollow elongated body having a predetermined length in a longitudinal direction of said base carrier;

a soil charging means mounted on one end of said continuous processing trough for receiving excavated sand and soil from said bucket; and an additive feed means located in a position rearward of said soil charging means to feed additive soil improving material to said continuous processing trough.

2. The vehicular soil treating machine as defined in claim 1, wherein said continuous processing trough is supported on said base carrier in an intermediate position between said crawler belts.

3. The vehicular soil treating machine as defined in claim 2, wherein said continuous processing trough is supported on a center frame of said base carrier.

4. The vehicular soil treating machine as defined in claim 3, wherein said continuous processing trough is supported on said center frame and is movable in said longitudinal direction to and from a front position and a receded rear position.

5. The vehicular soil treating machine as defined in claim 1, wherein said continuous processing trough is supported on said base carrier in a position on an outer side of one of said pair of crawler belts.

6. The vehicular soil treating machine as defined in claim 1, wherein said soil tumbling/mixing means includes at least one mixing conveyer having a plurality of mixing paddle on circumferential surfaces of at least one rotational shaft extending longitudinally and internally of said continuous processing trough.

7. The vehicular soil treating machine as defined in claim 6, wherein said at least one mixing conveyer includes a plurality of mixing conveyers which are provided side by side within said continuous processing trough.

8. The vehicular soil treating machine as defined in claim 7, wherein said plurality of mixing conveyers within said processing trough are rotationally interlinked with each other such that all of said plurality of mixing conveyers are concurrently put in rotation when a rotational shaft of one of said plurality of mixing conveyers is rotationally driven from a single hydraulic mixing motor.

9. The vehicular soil treating machine as defined in claim 8, wherein an even number of said plurality of mixing conveyers are provided side by side within said continuous processing trough, and even-numbered ones of said plurality of mixing conveyers are arranged to rotate in an opposite direction relative to at least one adjacently located mixing conveyer of said plurality of mixing conveyers.

10. The vehicular soil treating machine as defined in claim 9, further comprising a hydraulic cylinder for driving said excavating means, hydraulic motors for driving said base carrier and turning said upper rotary body, and a hydraulic pump for driving various hydraulic actuators of said machine including said hydraulic cylinder and motors, said hydraulic pump being commonly used as a drive for said hydraulic mixing motor and adapted to supply pressurized oil preferentially thereto through a flow rate preferential member.

11. The vehicular soil treating machine as defined in claim 10, wherein said flow rate preferential member has a distribution control valve connected to a discharge side of said hydraulic pump for distribution of pressurized oil, said distribution control valve having a preferential flow passage connected to said hydraulic mixing motor through a control valve, and a throttle provided between said control valve and said distribution control valve thereby to supply pressurized oil to said hydraulic mixing motor at a predetermined flow rate.

12. The vehicular soil treating machine as defined in claim 11, wherein said throttle is constituted by a variable throttle.

13. The vehicular soil treating machine as defined in claim 11, further comprising a relief valve connected to a downstream side of said throttle, a vent passage connected at a first end thereof to said relief valve and at a second end to an oil tank through an on-off valve, said on-off valve being closed when said hydraulic mixing motor is in operation and opened to connected said vent passage to said oil tank when said hydraulic mixing motor is at rest.

14. The vehicular soil treating machine as defined in claim 13, wherein said on-off valve is opened and closed in interlinked relation with a directional change-over valve in control of operation of said hydraulic mixing motor.

15. The vehicular soil treating machine as defined in claim 1, further comprising a water sprinkling means provided in said continuous processing trough.

16. The vehicular soil treating machine as defined in claim 1, wherein said soil charging means is a hopper mounted on said continuous processing trough and provided with a sieve member for separating solid foreign material from excavated sand and soil.

17. The vehicular soil treating machine as defined in claim 16, further comprising a feed means fitted in said hopper for forcibly sending said excavated sand and soil, that has been sieved, into said continuous processing trough.

18. The vehicular soil treating machine as defined in claim 1, further comprising a soil discharging means contiguously provided to a posterior end of said continuous processing trough, said soil discharging means being adapted to transfer treated soil in a direction perpendicular to said longitudinal direction of said base carrier to discharge said treated soil to an outside through an exit opening located on an outer side of treading portions of said pair of crawler belts and provided with a connecting passage to receive said treated soil flowing in from said continuous processing trough.

19. The vehicular soil treating machine as defined in claim 18, wherein said soil discharging means has a hollow tubular passage structure for said treated soil flowing in from said connecting passage, and a treated soil transfer means for forcibly sending said treated soil toward said exit opening.

20. The vehicular soil treating machine as defined in claim 19, wherein said treated soil transfer means is constituted by a belt conveyer being any of one with and without soil dumping plates or a screw conveyer.

21. The vehicular soil treating machine as defined in claim 19, wherein said treated soil transfer means is adapted to be driven from a hydraulic motor.

22. The vehicular soil treating machine as defined in claim 19, wherein said soil discharging means is supported on said base carrier independently of said continuous processing trough.

23. The vehicular soil treating machine as defined in claim 1, wherein said additive feed means is constituted by an additive supply source provided on said upper rotary body, and an additive feed hopper mounted on said continuous processing trough.

24. The vehicular soil treating machine as defined in claim 23, wherein said additive supply source is constituted by a container holder for supporting in position a flexible container packed with additive soil improving material, and a tentative additive receptacle arranged to hold tentatively a predetermined amount of said additive soil improving material and provided with a shutter for controlling a feed rate of said additive soil improving material to said additive feed hopper.

25. The vehicular soil treating machine as defined in claim 23, wherein said tentative additive receptacle is provided with a cutter means for cutting out a bottom portion of said flexible container.

26. The vehicular soil treating machine as defined in claim 23, wherein said shutter is opened and closed according to a signal from a rotational angle detection means provided on said upper rotary body to check out whether or not said upper rotary body is in an angular position relative to said base carrier in which supply of said additive soil improving material from said tentative additive container to said additive feed hopper is feasible.

27. The vehicular soil treating machine as defined in claim 26, further comprising a top level sensor provided on said additive feed hopper to check out whether or not said additive soil improving material is stored to a predetermined level within said additive feed hopper.

28. The vehicular soil treating machine as defined in claim 27, further comprising a lower limit sensor provided on said additive feed hopper to check out whether or not said additive soil improving material is stored in said additive feed hopper in excess of a lower limit level.

29. The vehicular soil treating machine as defined in claim 23, wherein said additive feed hopper is provided with an additive outlet extending across an entire width of said continuous processing trough.

30. The vehicular soil treating machine as defined in claim 29, further comprising a screw conveyer provided in said additive feed hopper to distribute an additive soil improving material over an entire length thereof upon reception from a tentative additive container of an additive supply source.

31. The vehicular soil treating machine as defined in claim 23, wherein said additive feed hopper is provided with a quantitative feed means for feeding an additive soil improving material to said continuous processing trough at a specified rate.

32. The vehicular soil treating machine as defined in claim 31, wherein said quantitative feed means is constituted by a rotary container of a predetermined capacity mounted on a rotational drive shaft to receive a predetermined amount of the additive soil improving material from said additive feed hopper and deliver the predetermined amount of the soil improving material to said continuous processing trough in relation with rotation of said rotational drive shaft of said quantitative feed means.

33. The vehicular soil treating machine as defined in claim 1, wherein said additive feed means is constituted by an additive storage tank provided on said upper rotary body, and an additive feeder mounted on said additive storage tank to feed additive soil improving material to said continuous processing trough.

34. The vehicular soil treating machine as defined in claim 33, further comprising a flexible tube of predetermined length and width connected to an additive outlet opening of said additive feeder.

35. The vehicular soil treating machine as defined in claim 33, wherein said additive feeder is provided with a quantitative feed means for quantitatively feeding the additive soil improving material to said continuous processing trough.

36. The vehicular soil treating machine as defined in claim 33, further comprising an additive feed hopper mounted on said continuous processing trough, wherein said additive feeder has an additive outlet end which opens into said additive feed hopper.

37. The vehicular soil treating machine as defined in claim 1, wherein said tumbling/mixing means is constituted by a rotary mixing conveyer capable of transferring a predetermined amount of soil per revolution, and said additive feed means is arranged to feed additive soil improving material quantitatively and substantially continuously to said continuous processing trough under control of a mixing ratio control means which controls a feed rate of the additive soil improving material from said additive feed means according to transfer rate of sand and soil by said tumbling/mixing means.

38. The vehicular soil treating machine as defined in claim 37, wherein said additive feed means is constituted by a rotary quantitative feed means, and said mixing ratio control means is adapted to change rotational speed of said additive feed means in such a way as to follow a rotational speed of said rotary mixing conveyer.

39. The vehicular soil treating machine as defined in claim 38, wherein a drive means for said rotary mixing conveyer is constituted by a hydraulic mixing motor, a drive means for said rotary quantitative feed means is constituted by an additive feed motor in the form of a variable speed electric motor, and said mixing ratio control means is at least constituted by a rotational speed sensor adapted to detect a speed of said hydraulic mixing motor and a controller adapted to vary a rotational speed of said additive feed motor to follow variations in said speed of said hydraulic mixing motor.

40. The vehicular soil treating machine as defined in claim 39, wherein said controller is connected to a control panel with first manual command means for starting and stopping a soil treating operation and adapted to carry out a soil treating operation according to a predetermined routine once said soil treating operation is started, and said excavating means is operated through second manual control means provided on said upper rotary body.

41. The vehicular soil treating machine as defined in claim 39, wherein said controller is adapted to stop said additive feed motor of said additive feed means in response to a signal from a sensor means indicating that said rotary mixing conveyer has been stopped rotation in a locked state while being rotated by said hydraulic mixing motor.

42. The vehicular soil treating machine as defined in claim 39, wherein said hydraulic mixing motor has been stopped in a locked state, and said controller is adapted to produce a signal for rotating said hydraulic mixing motor in a reverse direction for unlocking purposes.

43. The vehicular soil treating machine as defined in claim 38, wherein said controller is provided with a data recording means for recording time series data of said speed of said hydraulic mixing motor and said rotational speed of said additive feed motor during operation.

44. The vehicular soil treating machine as defined in claim 43, wherein said data recording means is arranged to record at least speeds of forward rotations of said hydraulic mixing motor in operation.

45. The vehicular soil treating machine as defined in claim 43, wherein said controller is connectible to an external data storage means to download contents of said data recording means.

46. The vehicular soil treating machine as defined in claim 45, wherein said external data storage means is constituted by a nonvolatile storage means.

47. The vehicular soil treating machine as defined in claim 1, wherein said excavating means includes a boom mounted on said upper rotary body for lifting a load up and down and an arm pivotally connected to a fore end portion of said boom for upward and downward pivoting movements, and said bucket is pivotally supported on a fore end portion of said arm.

48. The vehicular soil treating machine as defined in claim 1, further comprising a leveling blade pivotally supported at least on a front or rear side of said base carrier.

* * * * *